US007068957B2

(12) United States Patent
Shimura et al.

(10) Patent No.: US 7,068,957 B2
(45) Date of Patent: Jun. 27, 2006

(54) IMAGE FORMING APPARATUS AND IMAGE FORMING METHOD INVOLVING APPLICATION OF A DEVELOPING BIAS TO A TONER CARRIER

(75) Inventors: Hidetsugu Shimura, Nagano-ken (JP); Takashi Hama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/622,193

(22) Filed: Jul. 18, 2003

(65) Prior Publication Data

US 2004/0037577 A1 Feb. 26, 2004

(30) Foreign Application Priority Data

| | | |
|---|---|---|
| Jul. 19, 2002 | (JP) | 2002-211582 |
| Jul. 19, 2002 | (JP) | 2002-211583 |
| Jul. 24, 2002 | (JP) | 2002-214681 |
| Aug. 6, 2002 | (JP) | 2002-228754 |
| Jul. 1, 2003 | (JP) | 2003-189473 |
| Jul. 1, 2003 | (JP) | 2003-189474 |
| Jul. 1, 2003 | (JP) | 2003-189475 |
| Jul. 1, 2003 | (JP) | 2003-189476 |

(51) Int. Cl.
*G03G 15/00* (2006.01)
*G03G 21/00* (2006.01)

(52) U.S. Cl. ..... 399/49; 399/127

(58) Field of Classification Search ..... 399/49, 399/127, 43, 50, 51, 53, 55, 66
See application file for complete search history.

(56) References Cited

U.S. PATENT DOCUMENTS

| | | | | |
|---|---|---|---|---|
| 5,351,107 | A | 9/1994 | Nakane et al. | |
| 5,754,919 | A | 5/1998 | Sugimoto et al. | |
| 5,808,651 | A | 9/1998 | Horiuchi | |
| 5,839,018 | A | 11/1998 | Asanuma et al. | |
| 6,226,467 | B1 * | 5/2001 | Nakagawa et al. | 399/55 |
| 6,243,542 | B1 * | 6/2001 | Fujimoto et al. | 399/49 |
| 6,349,183 | B1 | 2/2002 | Nagamine et al. | |
| 6,505,012 | B1 | 1/2003 | Maebashi et al. | |
| 6,711,372 | B1 * | 3/2004 | Noda et al. | 399/286 |
| 2002/0028084 | A1 | 3/2002 | Maebashi et al. | |
| 2004/0141765 | A1 * | 7/2004 | Shimura et al. | 399/49 |

FOREIGN PATENT DOCUMENTS

| | | | |
|---|---|---|---|
| EP | 0589131 | A2 | 3/1994 |
| EP | 0732631 | A2 | 9/1996 |
| EP | 0 736 815 | A1 | 10/1996 |
| EP | 1 059 570 | A2 | 12/2000 |
| EP | 1 184 731 | A2 | 3/2002 |
| JP | 6-102734 | A | 4/1994 |
| JP | 6-110285 | A | 4/1994 |
| JP | 6-110286 | A | 4/1994 |
| JP | 8-166700 | A | 6/1996 |
| JP | 8-254861 | A | 10/1996 |

(Continued)

*Primary Examiner*—Quana Grainger
(74) *Attorney, Agent, or Firm*—Sughrue Mion, PLLC

(57) ABSTRACT

Optimization of a density control factor accompanying formation of a patch image is executed every time a predetermined period of time elapses since the end of a preceding image forming operation. Since an image is formed at regular intervals in this manner, it is possible to suppress a density variation which is created as toner carried on a developer roller is left unused for long. This effect further improves when the developer roller is rotated idle prior to formation of a patch image or regularly at predetermined timing.

28 Claims, 35 Drawing Sheets

FOREIGN PATENT DOCUMENTS

| | | | |
|---|---|---|---|
| JP | 8-272202 | A | 10/1996 |
| JP | 9-6120 | A | 1/1997 |
| JP | 9-90816 | A | 4/1997 |
| JP | 3131115 | B2 | 11/2000 |
| JP | 2001-312134 | A | 11/2001 |
| JP | 3261285 | B2 | 12/2001 |
| JP | 2002-72584 | A | 3/2002 |

* cited by examiner

FIG. 14A HIGH-DENSITY PATCH IMAGE

| TONER CHARACTER INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.990 | 0.988 | 0.984 | 0.982 |
| | ~2000000 | 0.988 | 0.984 | 0.982 | 0.982 |
| | ~6666666 | 0.984 | 0.982 | 0.982 | 0.982 |
| | ~12000000 | 0.982 | 0.982 | 0.982 | 0.982 |

FIG. 14B LOW-DENSITY PATCH IMAGE

| TONER CHARACTER INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.185 | 0.182 | 0.181 | 0.180 |
| | ~2000000 | 0.182 | 0.181 | 0.180 | 0.180 |
| | ~6666666 | 0.181 | 0.180 | 0.180 | 0.180 |
| | ~12000000 | 0.180 | 0.180 | 0.180 | 0.180 |

tw<t9 tw≧t9

IMAGE FORMING APPARATUS AND IMAGE FORMING METHOD INVOLVING APPLICATION OF A DEVELOPING BIAS TO A TONER CARRIER

BACKGROUND OF THE INVENTION

1. Field of the Invention

The present invention relates to an image forming apparatus and an image forming method which require that a developing bias is applied upon a toner carrier with an image carrier seating an electrostatic latent image positioned facing the toner carrier which carries toner so that the toner accordingly moves to the image carrier from the toner carrier and the electrostatic latent image is visualized.

2. Description of the Related Art

Known as image forming apparatuses, such as copier machines, printers and facsimile machines, to which electrophotographic techniques are applied are two types: those apparatuses of the contact developing type according to which an image carrier and a toner carrier are held abutting on each other; and those apparatuses of the non-contact developing type according to which an image carrier and a toner carrier are held away from each other. Of these, in an image forming apparatus of the contact developing type, a toner carrier is applied a developing bias with a direct current voltage or a voltage which is obtained by superimposing an alternating current voltage upon a direct current voltage, and when toner carried by a surface of the toner carrier contacts an electrostatic latent image which is formed on an image carrier, the toner partially moves toward the image carrier in accordance with a surface potential of the electrostatic latent image, and a toner image is consequently formed.

Meanwhile, in an image forming apparatus of the non-contact developing type, an alternating voltage serving as a developing bias is applied upon a toner carrier, an alternating field develops in a gap between the toner carrier and an image carrier, toner transfers owing to the function of the alternating field, and a toner image is consequently formed.

In an apparatus with electrophotographic techniques, an image density of a toner image may vary because of an individual difference which the apparatus has, a change with time, a change in environment surrounding the apparatus such as a temperature and humidity, etc. Noting this, various types of techniques have been proposed which aim at image density stabilization. Such techniques include one which requires to form a small test image (patch image) on an image carrier to thereby optimize a density control factor which influences an image density based on a density of the patch image. According to this technique, predetermined patch images are formed on an image carrier while changing a density control factor, a density sensor disposed in the vicinity of the image carrier detects an image density of the patch images and the density control factor is adjusted such that the density will match with a predetermined target density, in an effort to obtain a desired image density.

For example, according to an image density control technique described in Japanese Patent Application Laid-Open Gazette No. 2002-72584, (1) when a power source of an apparatus main unit is ON, (2) at the time of exchanging a process cartridge or a developer cartridge, (3) upon receipt of a new print instruction in a condition that the apparatus has not long been used, and (4) when a predetermined number of pages have been printed, a predetermined toner patch is formed prior to formation of the next image, a developing bias serving as a density control factor is changed based on a density of the toner patch, and an image density is accordingly controlled.

With respect to an apparatus of this type, it is known that when a power source is OFF or when an operation-suspended state that image formation is not executed has been continuing for long time even through the power source is ON, an image formed through a subsequent image forming operation may show cyclic density variations. While such density variations are gradually eliminated as the image forming operation is repeated a few times, if the operation-suspended state lasts for long, a longer period of time will be necessary to eliminate density variations and an image quality may deteriorate even to a measurable extent in some cases.

In an image forming apparatus according to a conventional technique in particular which requires to form a patch image for adjustment of a density control factor, when a patch image is formed after such an operation-suspended state, a density variation as that described above may lead to a variation in density of the patch image. This causes a problem that it is difficult to accurately adjust the density control factor based on a density of the patch image and it therefore is difficult to form a stable image.

SUMMARY OF THE INVENTION

A first object of the present invention is to provide an image forming apparatus and an image forming method according to which a patch image with less density variation is formed and a density control factor is optimized based on a density of the patch image so that a toner image having an excellent image quality is formed in a stable manner.

A second object of the present invention is to provide an image forming apparatus and an image forming method according to which it is possible to suppress a density variation which will appear in an image after long continuation of an operation-suspended state, so that a toner image having an excellent image quality is formed in a stable manner.

From the results of a variety of experiments, the inventors of the present invention found the following, with respect to a cause of a cyclic density variation which appears during an image forming operation after continuation of an operation-suspended state. That is, a major cause of such a variation density is that as toner is left adhered to a surface of a toner carrier for a long period of time, a bond between the toner carrier and the toner becomes gradually strong and therefore larger force becomes necessary to separate the toner from the toner carrier, and that since a surface condition of the toner carrier in suspension is not uniform but is rather uneven due to different densities of the toner which is in contact with the surface of the toner carrier at different positions or for other reason, the strength of the bond between the toner carrier and the toner is also uneven.

Noting this, according to a first aspect of the present invention, to achieve the first object described above, a toner carrier is made rotate one round or more prior to formation of a patch image. This eliminates the lack of the uniformity of the toner on the toner carrier and hence prevents a density variation in a patch image.

According to a second aspect of the present invention, to achieve the second object described above, optimization of the image forming condition is executed when image formation is not to be performed beyond a predetermined period of time. This prevents an operation-suspended state from lasting over a long period of time.

According to a third aspect of the present invention, to achieve the second object described above, the toner carrier is made rotate for every predetermined period. This eliminates the lack of the uniformity of the toner on the toner carrier and hence prevents a density variation in an image.

According to a fourth aspect of the present invention, to achieve the second object described above, when there is a request for next image formation received after a predetermined period of time from the preceding image formation, prior to formation of an image, the toner carrier is made rotate one round or more. This eliminates the lack of the uniformity of the toner on the toner carrier and hence prevents a density variation in an image.

These inventions may be implemented in combination when needed.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 14A and 14B are drawings which show examples of look-up tables which are for calculating a control target value;

DETAILED DESCRIPTION OF THE PREFERRED EMBODIMENTS

Six preferred embodiments and modified examples of an image forming apparatus to which the present invention is applied will now be described. A structure of the apparatus remains basically the same across these preferred embodiments, leaving only some differences in some of operations of the apparatus. Therefore, a structure and an operation of the apparatus will be described first in relation to a first preferred embodiment. As for the other preferred embodiments, differences from the first preferred embodiment will be described mainly.

First Preferred Embodiment (1) Structure of Apparatus

Figure 1:
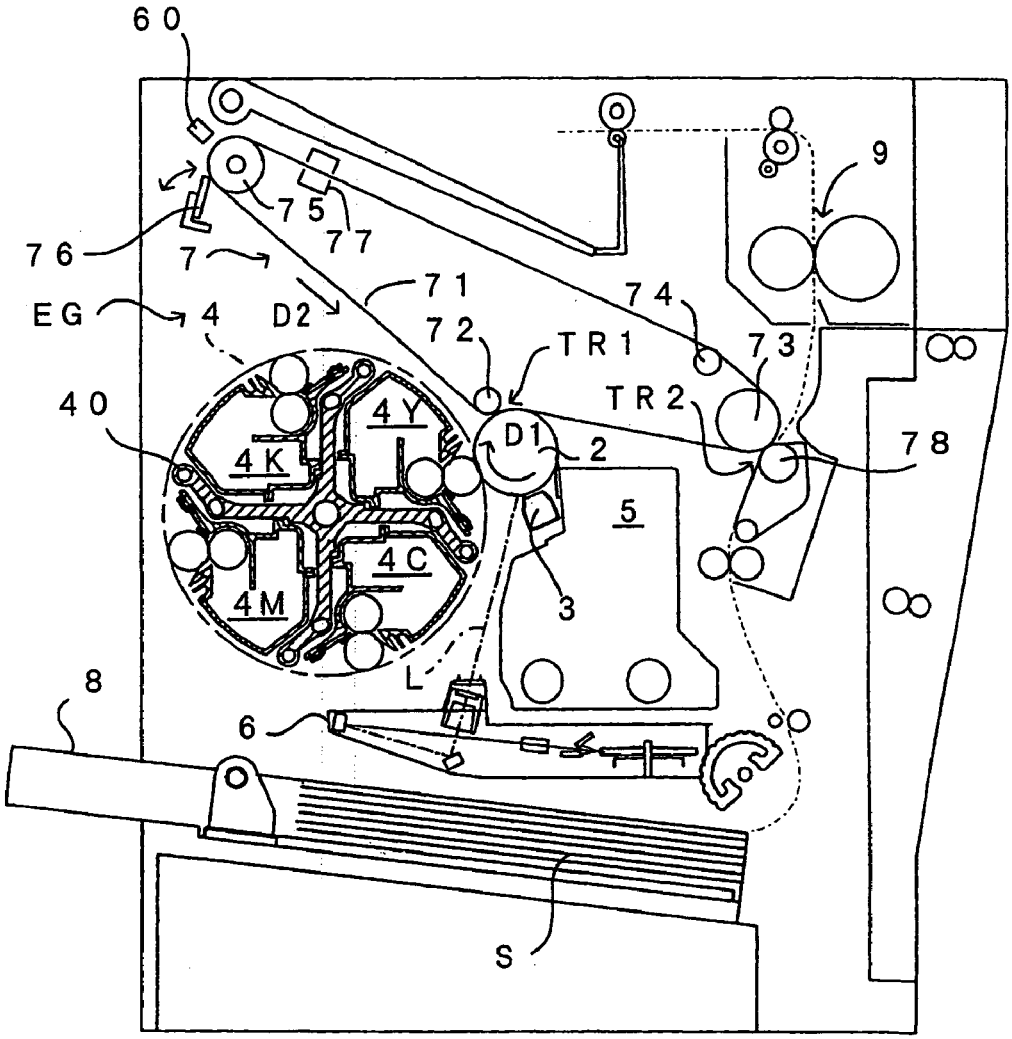
FIG. 1 is a drawing of a first preferred embodiment of an image forming apparatus according to the present invention.
Figure 2:
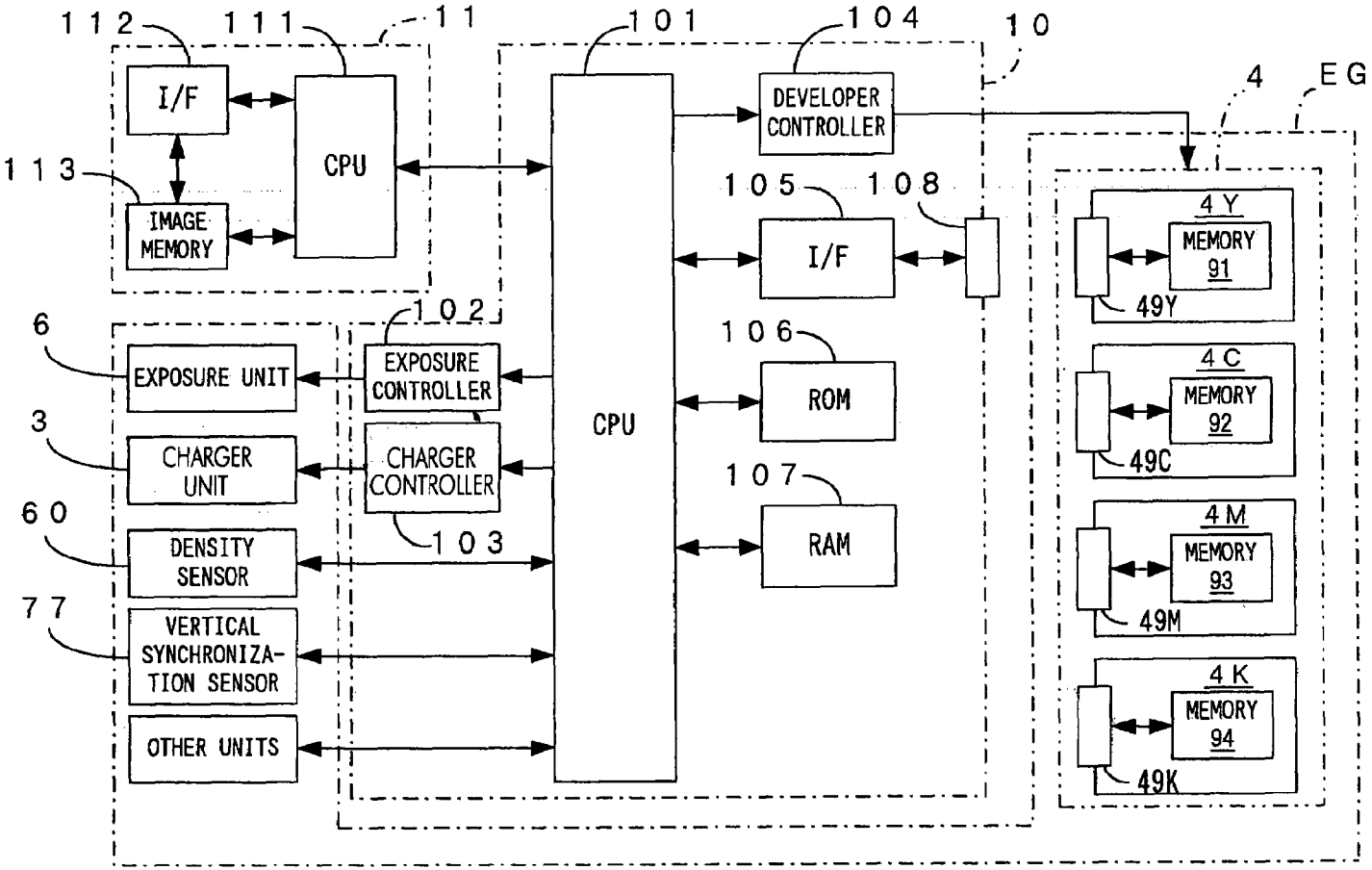
FIG. 2 is a block diagram of an electric structure of the image forming apparatus which is shown in FIG. 1.

FIG. 1 is a drawing of a first preferred embodiment of an image forming apparatus according to the present invention. FIG. 2 is a block diagram of an electric structure of the image forming apparatus which is shown in FIG. 1. This image forming apparatus is an apparatus which superposes toner in four colors of yellow (Y), magenta (M), cyan (C) and black (K) and accordingly forms a full-color image, or uses only toner in black (K) and accordingly forms a monochrome image. In this image forming apparatus, when an image signal is fed to a main controller 11 from an external apparatus such as a host computer in response to an image formation request from a user, an engine controller 10 controls respective portions of an engine EG in accordance with an instruction received from the main controller 11 and an image which corresponds to the image signal is formed on a sheet S. As described later, the engine controller 10 functions as an "image forming means" of the present invention.

In the engine EG, a photosensitive member 2 is disposed so that the photosensitive member 2 can freely rotate in the arrow direction D1 in FIG. 1. Around the photosensitive member 2, a charger unit 3, a rotary developer unit 4 and a cleaner 5 are disposed in the rotation direction D1. A charger controller 103 applies a charging bias upon the charger unit 3, whereby an outer circumferential surface of the photosensitive member 2 is charged uniformly to a predetermined surface potential. In this fashion, the charger unit 3 functions as "charging means" of the present invention, according to this embodiment.

An exposure unit 6 emits a light beam L toward the outer circumferential surface of the photosensitive member 2 which is thus charged by the charger unit 3. The exposure unit 6, thus functioning as "exposure means" of the present invention, makes the light beam L expose on the photosensitive member 2 in accordance with a control instruction fed from an exposure controller 102 and forms an electrostatic latent image corresponding to the image signal. For instance, when an image signal is fed to a CPU 111 of the main controller 11 via an interface 112 from an external apparatus such as a host computer, a CPU 101 of the engine controller 10 outputs a control signal corresponding to the image signal at predetermined timing, the exposure unit 6 emits the light beam L upon the photosensitive member 2, and an electrostatic latent image corresponding to the image signal is formed on the photosensitive member 2. Further, when a patch image which will be described later is to be formed in accordance with a necessity, a control signal corresponding to a patch image signal which expresses a predetermined pattern is fed from the CPU 101 to the exposure controller 102, and an electrostatic latent image corresponding to this pattern is formed on the photosensitive member 2. In this fashion, the photosensitive member 2 functions as an "image carrier" of the present invention, according to this embodiment.

The developer unit 4 develops thus formed electrostatic latent image with toner. In other words, the developer unit 4 comprises a support frame 40 which is disposed for free rotation about a shaft, a rotation driver not shown, and a yellow developer 4Y, a cyan developer 4C, a magenta developer 4M and a black developer 4K which are freely attachable to and detachable from the support frame 40 and house toner of the respective colors. A developer controller 104 controls the developer unit 4 as shown in FIG. 2. The developer unit 4 is driven into rotations based on a control instruction from the developer controller 104, and the developers 4Y, 4C, 4M and 4K are selectively positioned at a predetermined developing position facing the photosensitive member 2 and supply the toner of the selected color onto the surface of the photosensitive member 2. As a result, the electrostatic latent image on the photosensitive member 2 is visualized with the toner of the selected color. Shown in FIG. 1 is a state that the yellow developer 4Y is positioned at the developing position.

Figure 3:
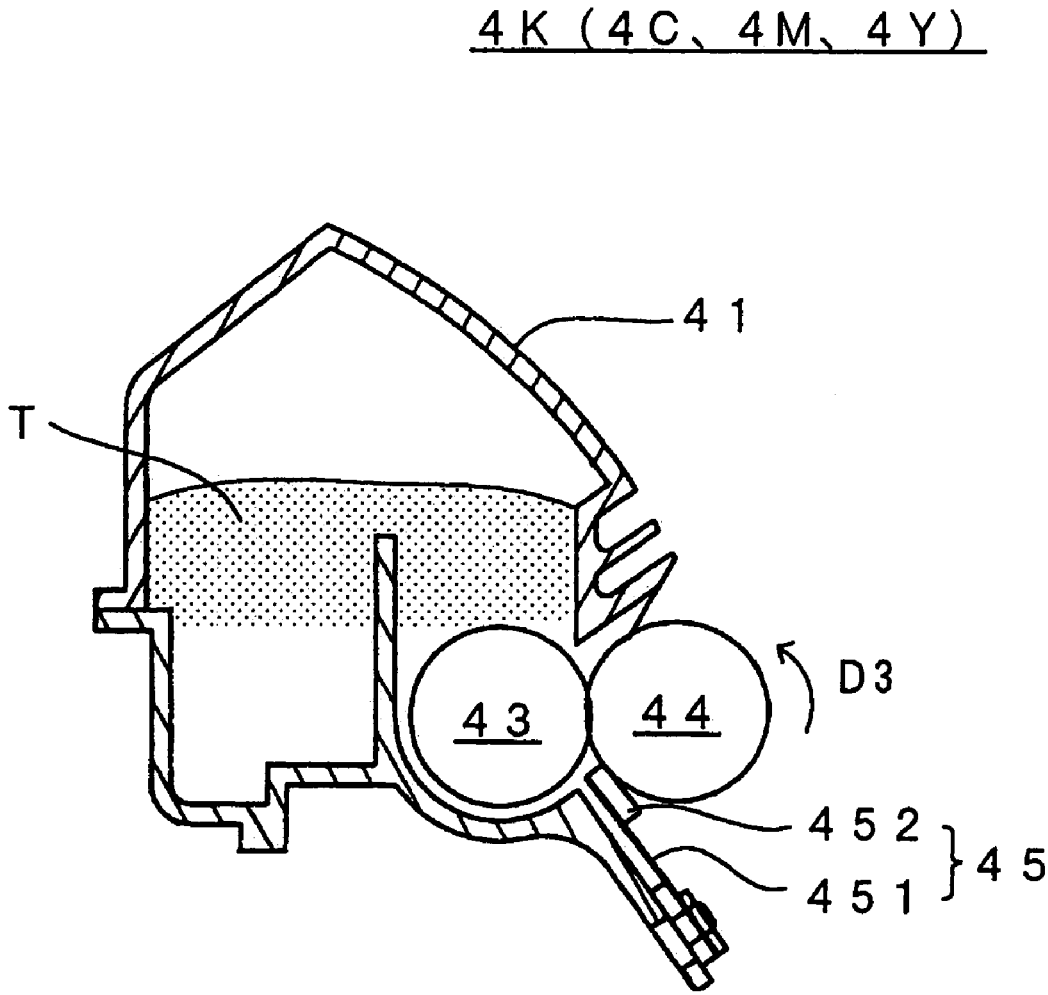
FIG. 3 is a cross sectional view of a developer of the image forming apparatus.

Since the developers 4Y, 4C, 4M and 4K all have the same structure, a structure of the developer 4K will now be described in more detail with reference to FIG. 3. The other developers 4Y, 4C and 4M remain the same in structure and function. FIG. 3 is a cross sectional view of the developer of the image forming apparatus. In this developer 4K, a supply roller 43 and a developer roller 44 are axially attached to a housing 41 which houses toner T inside. As the developer 4K is positioned at the developing position described above, the developer roller 44 which functions as a "toner carrier" of the present invention abuts on the photosensitive member 2 or gets positioned at an opposed position with a predetermined gap from the photosensitive member 2, and the rollers 43 and 44 rotate in a predetermined direction as they are engaged with the rotation driver (not shown) which is disposed to the main section. The developer roller 44 is made as a cylinder of metal, such as iron, copper and aluminum, or an alloy such as stainless steel, or so as to receive a developing bias as described later. As the two rollers 43 and 44 rotate while remaining in contact, the black toner is rubbed against a surface of the developer roller 44 and a toner layer having predetermined thickness is accordingly formed on the surface of the developer roller 44.

Further, in the developer 4K, a restriction blade 45 is disposed which restricts the thickness of the toner layer formed on the surface of the developer roller 44 into the predetermined thickness. The restriction blade 45 comprises a plate-like member 451 of stainless steel, phosphor bronze or the like and an elastic member 452 of rubber, a resin material or the like attached to a front edge of the plate-like member 451. A rear edge of the plate-like member 451 is fixed to the housing 41, which ensures that the elastic member 452 attached to the front edge of the plate-like member 451 is positioned on the upstream side to the rear edge of the plate-like member 451 in a rotation direction D3 of the developer roller 44. The elastic member 452 elastically abuts on the surface of the developer roller 44, thereby restricting the toner layer formed on the surface of the developer roller 44 finally into the predetermined thickness.

And further, disposed to the edge of the housing 41 above the developer roller 44 is a seal member 46 which prevents the toner inside the housing 41 from leaking outside the developer. The seal member 46 is made of an elastic material such as a resin and metal for instance, and formed into a shape like a thin plate. One end of the seal member 46 is fixed to the housing 41, while the other end of the seal member 46 flexibly abuts on the surface of the developer roller 44. Hence, the toner transported to above the developer roller 44 while remaining carried by the developer roller 44 moves through this abutting portion with the seal member 46, and is then guided back into the housing 41 again. Due to friction with the supply roller 43 which rotates in a direction D4 shown in FIG. 3, remaining toner is scraped off from the surface of the developer roller 44 while fresh toner inside the developer is supplied to the surface of the developer roller 44.

In this fashion, the restriction blade 45 functions as "restricting means" of the present invention and the supply roller 43 functions as "peeling means" of the present invention according to this embodiment. Further, in a condition that the developer 4K having such a structure is positioned at the developing position, the restriction blade 45 is located below the developer roller 44 as shown in FIG. 3. Meanwhile, a position at which the supply roller 43 peels the toner off from the developer roller 44 (peeling position) is on the upstream side to an abutting position (restricting position) at which the developer roller 44 and the restriction blade 45 abut on each other in the rotation direction D3 of the developer roller 44, and further, is also above the restricting position.

Toner particles which form the toner layer formed on the surface of the developer roller 44 are charged, due to friction with the supply roller 43 and the restriction blade 45. Although the example described below assumes that the toner has been negatively charged, it is possible to use toner which becomes positively charged as potentials at the respective portions of the apparatus are appropriately changed.

The toner layer thus formed on the surface of the developer roller 44 is gradually transported, owing to the rotations of the developer roller 44, to an opposed position facing the photosensitive member 2 on which surface the electrostatic latent image has been formed. As the developing bias from the developer controller 104 is applied upon the developer roller 44, the toner carried on the developer roller 44 partially adheres to respective portions within the surface of the photosensitive member 2 in accordance with surface potentials in these portions. The electrostatic latent image on the surface of the photosensitive member 2 is visualized as a toner image in this toner color in this manner.

While the developing bias applied upon the developer roller 44 may be a direct current voltage or a developing bias which is obtained by superimposing an alternating current voltage upon a direct current voltage, in an image forming apparatus of the non-contact developing type in which the photosensitive member 2 and the developer roller 44 in particular are located away from each other and toner transfers between the two for the purpose of development with the toner, it is preferable for efficient toner transfer that the developing bias has a voltage waveform which is obtained by superimposing an alternating current voltage, such as a sine wave, a chopping wave and a square wave, upon a direct current voltage. Although the value of a direct current voltage and the amplitude, the frequency, the duty ratio and the like of an alternating current voltage may have any desired values, in the following description, a direct current component (average value) of the developing bias will be referred to as a n average developing bias Vavg, regardless of whether the developing bias contains an alternating current component.

A preferable example of the developing bias described above used in an image forming apparatus of the non-contact developing type will now be described. For instance, the waveform of the developing bias is obtained by superimposing an alternating current voltage having a square wave upon a direct current voltage, the frequency of the square wave is 3 kHz and a peak-to-peak voltage Vpp is 1400 V. In addition, as described later, although it is possible to change the developing bias. Vavg as one of density control factors in this preferred embodiment. The developing bias may be changed in the variable range of (−110 V) to (−330 V) for example, considering an influence over an image density, a variation in characteristics of the photosensitive member 2, etc. These numerical figures are not limited to those mentioned above, but should rather be appropriately changed in accordance with the structure of the apparatus.

In addition, as shown in FIG. 2, memories 91 through 94, which store data regarding a production batch and/or the history of use of the developers, characteristics of the toner inside and the like, are disposed to the respective developers 4Y, 4C, 4M and 4K. Connectors 49Y, 49C, 49M and 49K are disposed to the respective developers 4Y, 4C, 4M and 4K. These are selectively connected with a connector 108 which is disposed to the main section in accordance with a necessity, allow that data are transferred between the CPU 101 and the respective memories 91 through 94 via an interface 105, and thus manage various types of information on the developers such as management of consumables. While data are sent and received with the connector 108 of the main section and the connector 49Y and the like of the developers mechanically fit with each other in this embodiment, the data transfer may be non-contact data transfer using other electromagnetic means such as radio communications. Further, the memories 91 through 94 which store data unique to the respective developers 4Y, 4C, 4M and 4K are preferably nonvolatile memories which are capable of saving the unique data even when a power source is OFF, when the developers have been detached from the main section or on other occasions. Flash memories, ferroelectric memories, EEPROMs and the like may be used as such non-volatile memories.

The structure of the apparatus will be described continuously, referring to FIG. 1 again. The toner image developed by the developer unit 4 in the manner described above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby drive the intermediate transfer belt 71 into rotations in a predetermined rotation direction D2. At a position facing the roller 73 across the intermediate transfer belt 71, a secondary transfer roller 78 is disposed which is attached to and detached from a surface of the belt 71 by an electromagnetic clutch not shown. For transfer of a color image onto the sheet S, toner images in the respective colors on the photosensitive member 2 are superposed one atop the other on the intermediate transfer belt 71, thereby forming a color image. Further, on the sheet S unloaded from a cassette 8 and transported to a secondary transfer region TR2 which is located between the intermediate transfer belt 71 and the secondary transfer roller 78, the color image is secondarily transferred. The sheet S now seating thus formed color image is transported to a discharging tray which is disposed to a top surface portion of the main section of the apparatus via a fixing unit 9. Static eliminating means not shown resets a surface potential of the photosensitive member 2 as it is after the primary transfer of the toner image onto the intermediate transfer belt 71. After removal of the toner remaining on the surface of the photosensitive member 2 by a cleaner 5, the charger unit 3 charges the photosensitive member 2.

When it is necessary to further form images, the operation above is repeated, a necessary number of images are accordingly formed, and the series of image forming operation ends. The apparatus remains on standby until a new image signal is received, and for the purpose of suppressing an energy consumption in the standby state, the apparatus switches from the standby operation to a suspended state. In short, the photosensitive member 2, the developer roller 44, the intermediate transfer belt 71 and the like stop rotating and the application of the developing biases upon the developer roller 44 and the charger unit 3 is stopped, whereby the apparatus enters the operation-suspended state.

Further, a cleaner 76, a density sensor 60 and a vertical synchronization sensor 77 are disposed in the vicinity of the roller 75. Of these, the cleaner 76 can move freely to be attached to and detached from the roller 75, owing to the electromagnetic clutch not shown. In a condition that the cleaner 76 has moved to the roller 75, a blade of the cleaner 76 abuts on the surface of the intermediate transfer belt 71 which runs around the roller 75 and removes the toner which remains adhering to the outer circumferential surface of the intermediate transfer belt 71 after the secondary transfer. Meanwhile, the vertical synchronization sensor 77 is a sensor which detects a reference position of the intermediate transfer belt 71, and functions as a vertical synchronization sensor which is for obtaining a synchronizing signal which is outputted in relation to rotations of the intermediate transfer belt 71, namely, a vertical synchronizing signal Vsync. In this apparatus, the operations of the respective portions of the apparatus are controlled based on the vertical synchronizing signal Vsync, to thereby time the operations of the respective portions to each other and to accurately superimpose toner images of the respective colors one atop the other. In addition, the density sensor 60 is disposed facing the surface of the intermediate transfer belt 71, and has such a structure which permits the density sensor 60 to measure a density of a patch image which is formed on the outer circumferential surface of the intermediate transfer belt 71.

In FIG. 2, denoted at 113 is an image memory which is disposed to the main controller 11 to store an image signal which is fed from an external apparatus such as a host computer via the interface 112. Denoted at 106 is a ROM which stores a calculation program executed by the CPU 101, control data for control of the engine EG, etc. Denoted at 107 is a RAM which temporarily stores a calculation result derived by the CPU 101, other data, etc.

Figure 4:
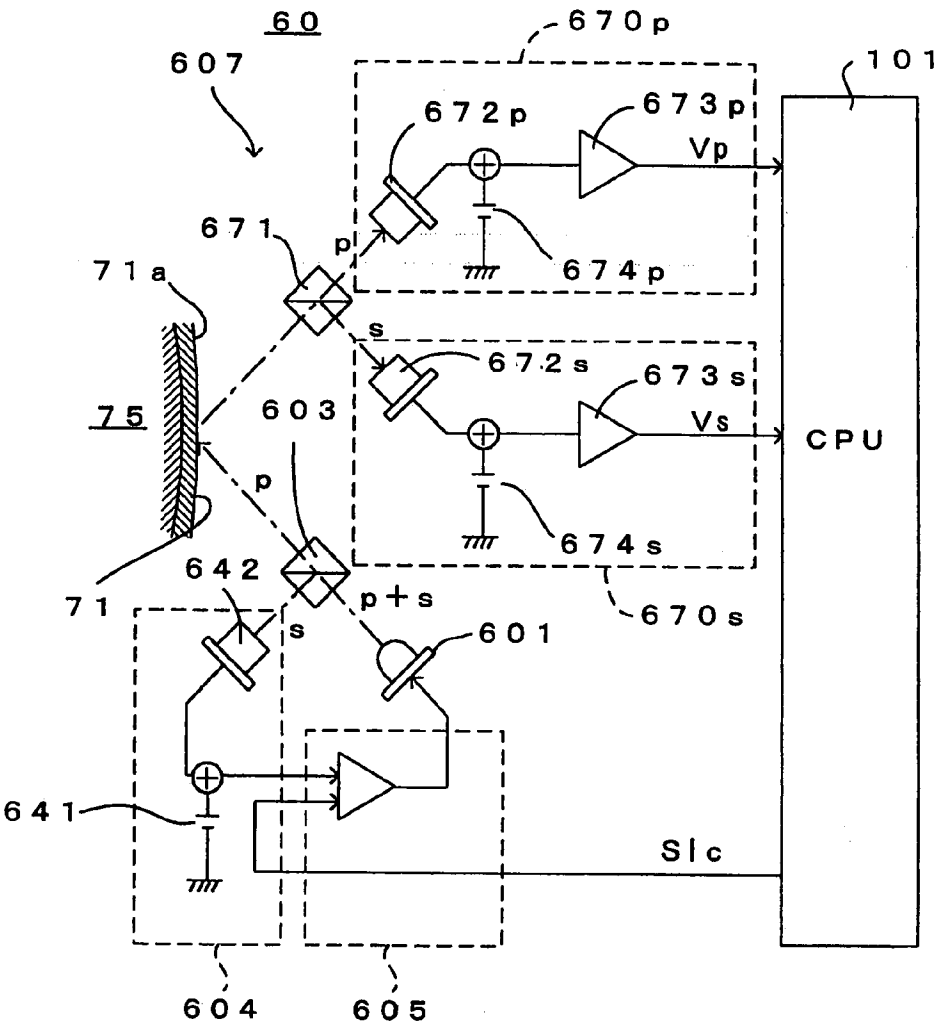
FIG. 4 is a drawing which shows a structure of a density sensor.

FIG. 4 is a drawing which shows a structure of the density sensor. The density sensor 60 comprises a light emitter element 601, such as an LED, which functions as "light emitting means" of the present invention and which irradiates light upon a wound area 71*a* which corresponds to a surface area of the intermediate transfer belt 71 which lies on the roller 75. Disposed to the density sensor 60 are a polarizer beam splitter 603, a light receiver unit for monitoring irradiated light amount 604 and an irradiated light amount adjusting unit 605, for the purpose of adjusting the irradiated light amount of irradiation light in accordance with a light amount control signal Sic which is fed from the CPU 101 as described later.

The polarizer beam splitter 603 is, as shown in FIG. 4, disposed between the light emitter element 601 and the intermediate transfer belt 71. The polarizer beam splitter 603 splits light emitted from the light emitter element 601 into p-polarized light, whose polarizing direction is parallel to the surface of incidence of the irradiation light on the intermediate transfer belt 71, and s-polarized light whose polarizing direction is perpendicular to the surface of incidence of the irradiation light. The p-polarized light impinges as it is upon the intermediate transfer belt 71, while the s-polarized light impinges upon the light receiver unit 604 for monitoring irradiated light amount after emitted from the polarizer beam splitter 603, so that a signal which is in proportion to the irradiated light amount is outputted to the irradiated light amount adjusting unit 605 from a light receiver element 642 of the light receiver unit 604.

Based on the signal from the light receiver unit 604 and a light amount control signal Sic from the CPU 101 of the engine controller 10, the irradiated light amount adjusting unit 605 feedback-controls the light emitter element 601 and adjusts the irradiated light amount of the light irradiated upon the intermediate transfer belt 71 from the light emitter element 601 into a value which corresponds to the light amount control signal Slc. The irradiated light amount can thus be changed and adjusted appropriately within a wide range according to this embodiment.

In addition, an input offset voltage 641 is applied to the output side of the light receiver element 642 of the light receiver unit 604 for monitoring irradiated light amount, and the light emitter element 601 is maintained turned off unless the light amount control signal Sic exceeds a certain signal level according to this embodiment. This prevents the light emitter element 601 from erroneously turning on because of a noise, a temperature drift, etc.

As the light amount control signal Slc having a predetermined level is fed to the irradiated light amount adjusting unit 605 is fed from the CPU 101, the light emitter element 601 turns on and p-polarized light is irradiated as irradiation light upon the intermediate transfer belt 71. The p-polarized light is reflected by the intermediate transfer belt 71. Of light components of the reflection light, a reflection light amount detector unit 607 detects the light amount of the p-polarized light and the light amount of the s-polarized light respectively, and signals corresponding to the respective light amounts are outputted to the CPU 101.

As shown in FIG. 4, the reflection light amount detector unit 607 comprises a polarized light beam splitter 671, a light receiver unit 670*p* and a light receiver unit 670*s*. The polarized light beam splitter 671 is disposed on an optical path of the reflection light. The light receiver unit 670*p* receives p-polarized light transmitted by the polarization light beam splitter 671 and outputs a signal which corresponds to the light amount of the p-polarized light. And the light receiver unit 670*s* receives s-polarized light split by the polarization light beam splitter 671 and outputs a signal which corresponds to the light amount of the s-polarized light. In the light receiver unit 670*p*, a light receiver element 672*p* receives the p-polarized light from the polarization light beam splitter 671, and after an amplifier circuit 673*p* amplifies an output from the light receiver element 672*p*, an amplified signal is outputted as a signal Vp which corresponds to the light amount of the p-polarized light to the CPU 101. Meanwhile, like the light receiver unit 670*p*, the light receiver unit 670*s* comprises a light receiver unit 672*s* and an amplifier circuit 673*s* and outputs a signal Vs which corresponds to the light amount of the s-polarized light. Hence, it is possible to independently calculate the light amounts of the mutually different two component light (the p-polarized light and the s-polarized light) among the light components of the reflection light. The light receiver units 670*p* and 670*s* function as "light amount detecting means" of the present invention.

Further, in this embodiment, output offset voltages 674*p* and 674*s* are respectively applied to the output side of the light receiver elements 672*p* and 672*s*, and even when outputs from the respective light receiver elements are zero, that is, even when the reflection light amounts are zero, the amplifier circuits 673*p* and 673*s* reach a predetermined positive potential. This permits to output appropriate output voltages which correspond to the reflection light amounts while avoiding a dead zone in the vicinity of the zero inputs to the amplifier circuits 673*p* and 673*s*.

The signals representing these output voltages Vp and Vs are fed to the CPU 101 via an A/D convertor circuit not shown, and the output voltages Vp and Vs are sampled at predetermined time intervals (which are 8 msec in this embodiment). Based on the results of the sampling, the CPU 101 adjusts density control factors for stabilization of an image density, such as the developing bias and the exposure energy, which affect an image density. The adjustment operation is executed at proper timing which may be the time of turning on of the power source of the apparatus, immediately after any of the units has been exchanged, etc. To be more specific, while changing the density control factors above over multiple stages for each one of the toner colors, the image forming operation is executed in accordance with an image signal which is image data which correspond to a predetermined patch image pattern and are stored in advance in the ROM 106, whereby a small test image (patch image) corresponding to the image signal is formed. The density sensor 60 then detects a patch image density, and each density control factor is adjusted so that an optimal image forming condition to achieve a desired image density based on the result of the detection will be obtained. Adjustment operation of the density control factors will now be described.

(2) Adjustment Operation

Figure 5:
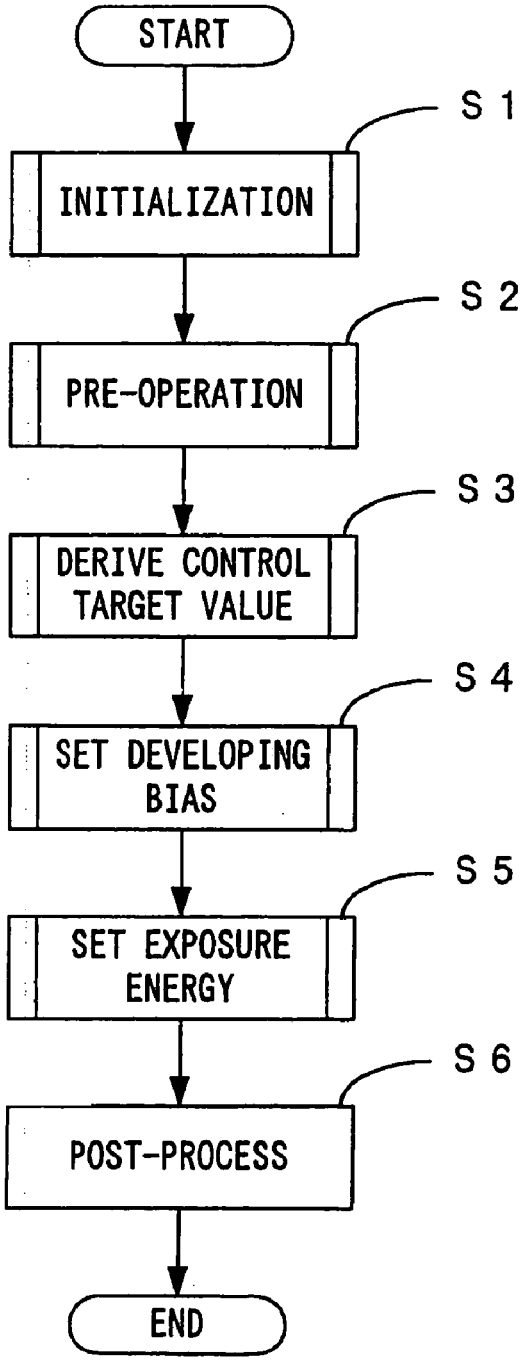
FIG. 5 is a flow chart which shows the outline of optimization of a density control factor in the first preferred embodiment.

FIG. 5 is a flow chart which shows the outline of the adjustment operation of the density control factors in this preferred embodiment. The operation includes six sequences in the following order: initialization (Step S1); a pre-operation (Step S2); a process of deriving a control target value (Step S3); a developing bias setting process (Step S4); an exposure energy setting process. (Step S5); and a post-process (Step S6). In these sequences, steps S3 through S5 correspond to an "optimization" of the present invention. Detailed operations in the respective sequences will now be described.

A. Initialization

Figure 6:
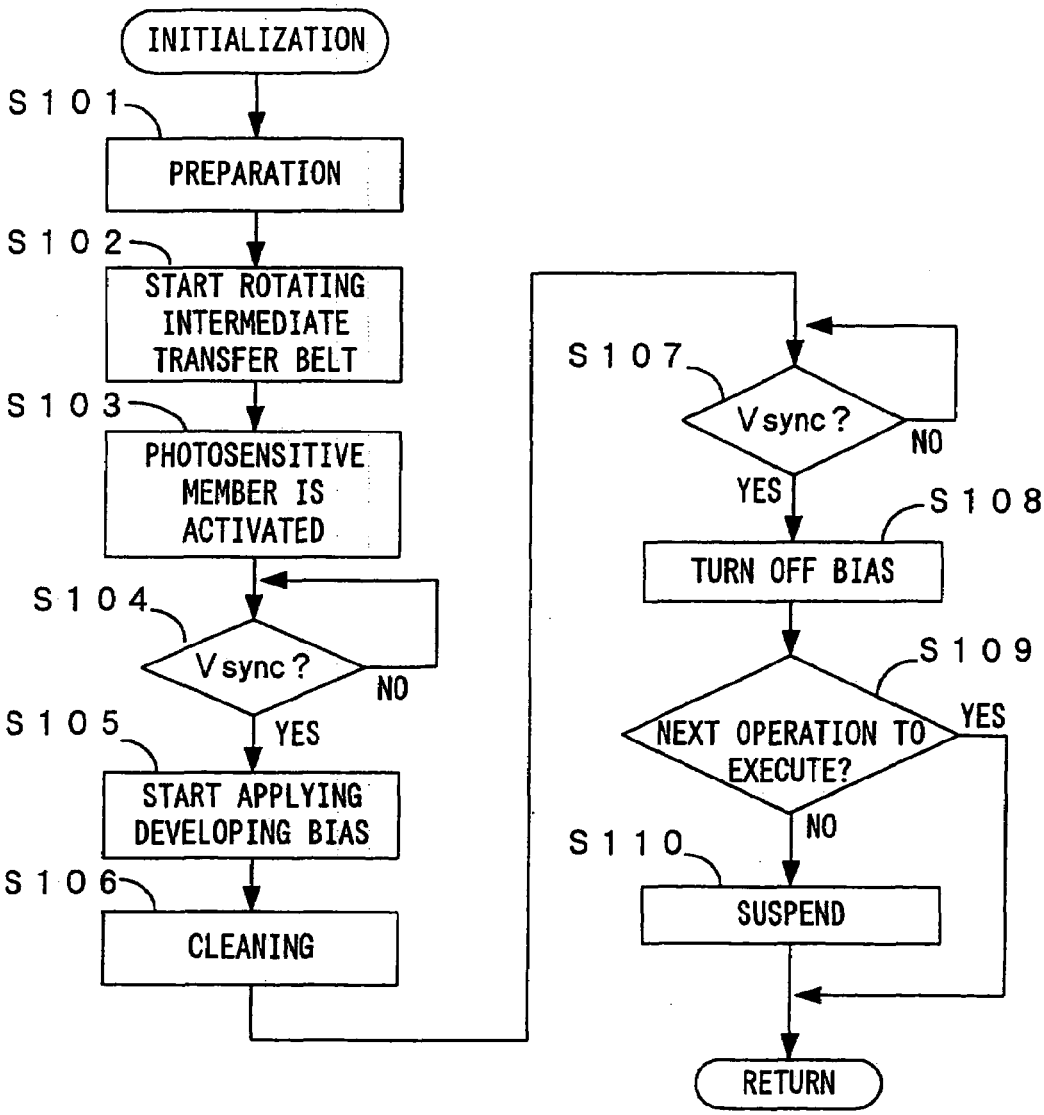
FIG. 6 is a flow chart which shows initialization in the first preferred embodiment.

FIG. 6 is a flow chart which shows initialization in this embodiment. During the initialization, first, as preparation (Step S101), the developer unit 4 is driven into rotations and positioned at a so-called home position, and the cleaner 76 and the secondary transfer roller 78 are moved to positions away from the intermediate transfer belt 71 using the electromagnetic clutch. In this condition, driving of the intermediate transfer belt 71 is started (Step S102) and the photosensitive member 2 is driven into rotations and static elimination is started so that the photosensitive member 2 is activated (Step S103).

As the vertical synchronizing signal Vsync which is indicative of the reference position of the intermediate transfer belt 71 is detected and rotations of the intermediate transfer belt 71 is accordingly confirmed (Step S104), application of predetermined biases upon the respective portions of the apparatus is started (Step S105). That is, the charger controller 103 applies the charging bias upon the charger unit 3 to thereby charge the photosensitive member 2 to a predetermined surface potential, and a bias generator not shown then applies a predetermined primary transfer bias upon the intermediate transfer belt 71.

In this condition, the intermediate transfer belt 71 is cleaned (Step S106). In short, the cleaner 76 abuts on the surface of the intermediate transfer belt 71 and the intermediate transfer belt 71 is then rotated approximately one round in this condition, thereby removing the toner, dirt and the like which remain adhering to the surface of the intermediate transfer belt 71. The secondary transfer roller 78 applied with a cleaning bias then abuts on the intermediate transfer belt 71. The cleaning bias has the opposite polarity to that of a secondary transfer bias which is applied upon the secondary transfer roller 78 during execution of an ordinary image forming operation. Hence, the toner which remains adhering to the secondary transfer roller 78 moves to the surface of the intermediate transfer belt 71, and the cleaner 76 removes the toner off from the surface of the intermediate transfer belt 71. As the cleaning of the intermediate transfer belt 71 and the secondary transfer roller 78 ends in this fashion, the secondary transfer roller 78 is moved away from the intermediate transfer belt 71 and the cleaning bias is turned off. Upon receipt of the next vertical synchronizing signal Vsync (Step S107), the charging bias and the primary transfer bias are turned off (Step S108).

Further, in this embodiment, the CPU 101 can execute initialization not only when adjustment of density control factors is to be performed but instead when needed independently of other processing. So, when the next process is to be executed following this (Step S109), the initialization is ended in the condition that the process has been executed up to the step S108 described above, and the next process is carried out. When the next process is not in a plan, as a suspend process (Step S110), the cleaner 76 is moved away from the intermediate transfer belt 71, and the static eliminating process and the drive-rotations of the intermediate transfer belt 71 is stopped. In this case, it is preferable that the intermediate transfer belt 71 is stopped in such a manner that the reference position of the intermediate transfer belt 71 is immediately before an opposed position facing the vertical synchronization sensor 77. This is because the state the intermediate transfer belt 71 is rotating is confirmed by means of detection of the vertical synchronizing signal Vsync when the intermediate transfer belt 71 is in rotations in subsequent processing, and it is therefore possible to determine in a short period of time whether there is abnormality based on whether the vertical synchronizing signal Vsync is detected immediately after the start of the driving in the manner described above.

B. Pre-Operation

Figure 7:
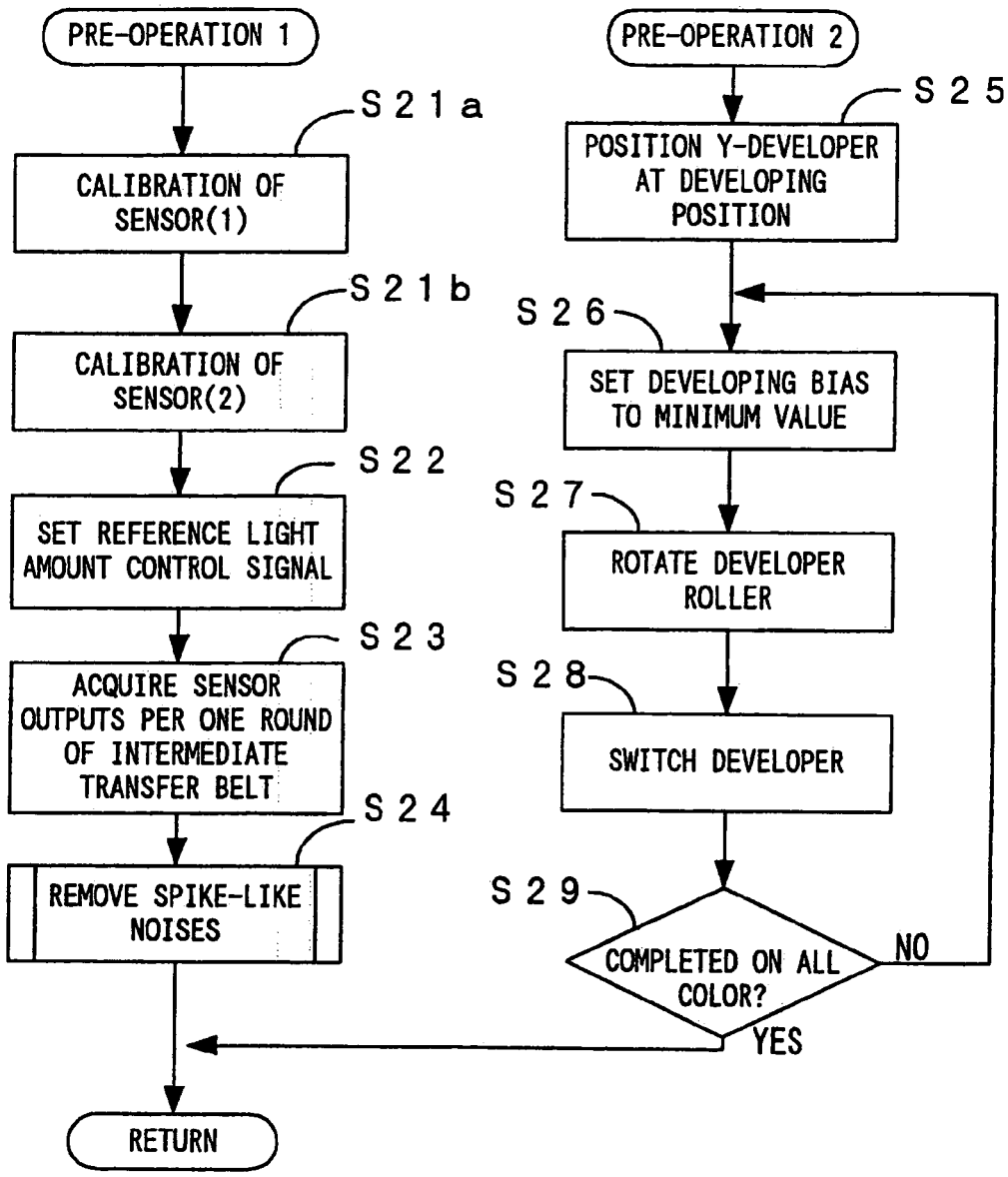
FIG. 7 is a flow chart which shows a pre-operation in the first preferred embodiment.

FIG. 7 is a flow chart which shows a pre-operation in this preferred embodiment. During the pre-operation, as pre-processing prior to formation of a patch image which will be described later, two processes are performed in parallel. More specifically, in parallel to adjustment of operating conditions for the respective portions of the apparatus in an effort to accurately optimize the density control factors (a pre-operation 1), the developer rollers 44 disposed to the respective developers 4Y, 4C, 4M and 4K are rotated idle (a pre-operation 2).

B-1. Setting Operating Conditions (Pre-Operation 1)

During the left-hand side flow (the pre-operation 1) in FIG. 7, first, the density sensor 60 is calibrated (Step S21*a*, Step S21*b*). The calibration (1) at the step S21*a* requires to detect the output voltages Vp and Vs from the light receiver units 670*p* and 670*s* as they are when the light emitter element 601 of the density sensor 60 is OFF, and to store these as dark outputs Vpo and Vso. Next, during the calibration (2) at the step S21*b*, the light amount control signal Slc to be fed to the light emitter element 601 is changed so as to achieve two types of ON-states which are a low light amount and a high light amount, and the output voltage Vp from the light receiver unit 670*p* with each light amount is detected. From these three values, a reference light amount of the light emitter element 601 is calculated which ensures that the output voltage Vp in a toner adhesion-free state will be at a predetermined reference level (which is a value obtained by adding the dark output Vpo to 3 V in this preferred embodiment). A level of the light amount control signal Slc which ensures that the light amount of the light emitter element 601 will be the reference light amount is thus calculated, and the calculated value is set as a reference light amount control signal (Step S22). Following this, when it becomes necessary to turn on the light emitter element 601, the CPU 101 outputs the reference light amount control signal to the irradiated light amount adjusting unit 605 and the light emitter element 601 is feedback-controlled so as to emit light always in the reference light amount.

The output voltages Vp and Vs as they are when the light emitter element 601 is OFF are stored as "dark outputs" of this sensor system. As these values are subtracted from the output voltages Vp and Vs at the time of detection of a density of a toner image, an influence of the dark outputs is eliminated and the density of the toner image is detected at a high accuracy, as described later.

An output signal from the light receiver element 672*p* with the light emitter element 601 turned on is dependent upon the amount of reflection light from the intermediate transfer belt 71. But as described later, since the condition of the surface of the intermediate transfer belt 71 is not always optically uniform, for the purpose of calculating the output in such a condition, it is desirable to calculate an average value across one round of the intermediate transfer belt 71. Further, while it is not necessary to detect output signals representing one round of the intermediate transfer belt 71 when the light emitter element 601 is OFF, in order to reduce a detection error, it is preferable to average out output signals obtained at more than one points.

In this preferred embodiment, since the surface of the intermediate transfer belt 71 is white, reflectance of light is high. The reflectance however decreases when the toner in any color adheres on the intermediate transfer belt 71. Hence, in this preferred embodiment, as the amount of the toner adhering to the surface of the intermediate transfer belt 71 increases, the output voltages Vp and Vs from the light emitter units decrease from the reference level. And therefore, it is possible to estimate the amount of the adhering toner, and further an image density of a toner image, from the values of the output voltages Vp and Vs.

In addition, since the reflection characteristics are different between color (Y, C, M) toner and black (K) toner, this preferred embodiment requires to calculate a density of a patch image formed with black toner described later based on the light amount of p-polarized light included in reflection light from the patch image, but to calculate a density of a patch image formed with color toner based on a light amount ratio of p-polarized light and s-polarized light. Hence, it is possible to accurately calculate an image density over a wide dynamic range.

Referring back to FIG. 7, the pre-operation will be continuously described. The condition of the surface of the intermediate transfer belt 71 is not always optically uniform, and fused toner during use may gradually lead to discoloration, dirt, etc. To prevent a change in surface condition of the intermediate transfer belt 71 from causing an error in detection of a density of a toner image, this preferred embodiment requires to acquire a foundation profile covering one round of the intermediate transfer belt 71, namely, information regarding shading on the surface of the intermediate transfer belt 71 which does not carry a toner image. To be more specific, the light emitter element 601 is made emit light in the reference light amount calculated earlier, the intermediate transfer belt 71 is made rotate one round while sampling the output voltages Vp and Vs from the light receiver units 670*p* and 670*s* (Step S23), and the sample data (the number of samples in this preferred embodiment: 312) are stored as a foundation profile in a RAM 107. With the shading in the respective areas on the surface of the intermediate transfer belt 71 grasped in advance in this fashion, it is possible to more accurately estimate a density of a toner image which is formed on the intermediate transfer belt 71.

Figure 8A:
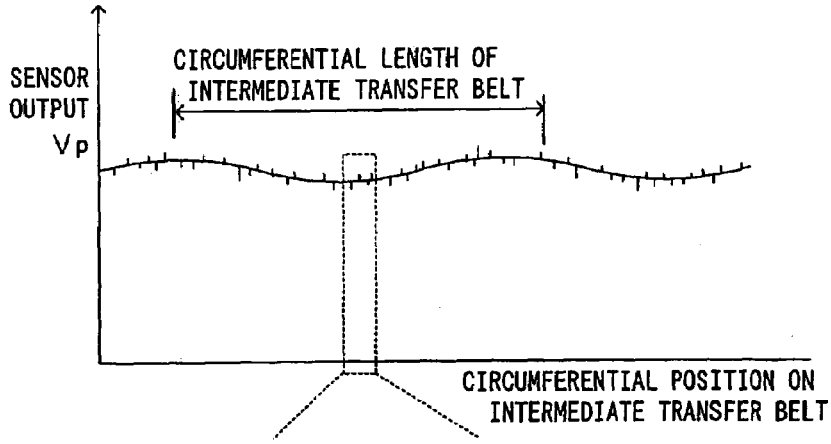
FIGS. 8A and 8B are drawings which show an example of a foundation profile of an intermediate transfer belt.
Figure 8B:
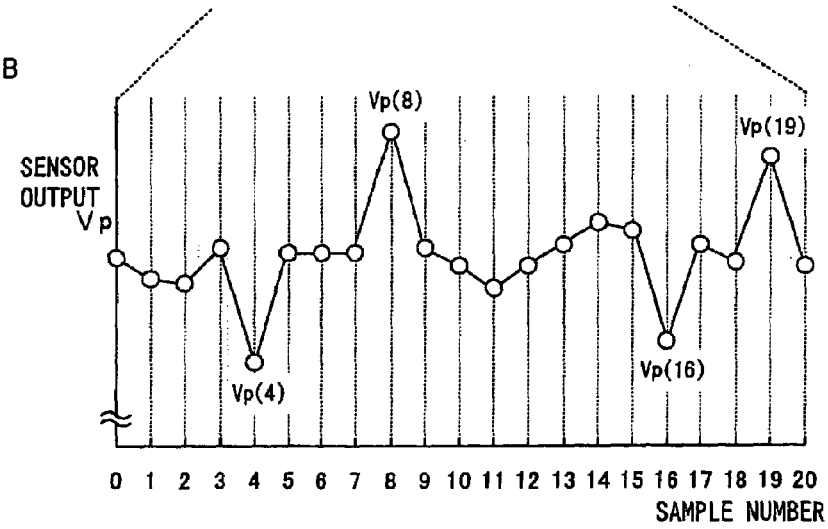

By the way, in some cases, changes in reflectance due to a very small scars or dirt on the roller 75 and the intermediate transfer belt 71, and further, spike-like noises attributed to an electric noise mixed in a sensor circuit may get superimposed on the output voltages Vp and Vs from the density sensor 60 described above. FIGS. 8A and 8B are drawings which show an example of the foundation profile of the intermediate transfer belt. When one detects with the density sensor 60 and plots the amount of reflection light from the surface of the intermediate transfer belt 71 over one round or more of the intermediate transfer belt 71, the output voltage Vp from the density sensor 60 cyclically changes in accordance with the circumferential length or the rotating cycles of the intermediate transfer belt 71, and further, narrow spike-like noises may sometimes get superimposed over the waveform of the output voltage Vp. These noises may possibly contain both a component which is in synchronization to the rotating cycles and an irregular component which is not in synchronization to the rotating cycles. FIG. 8B shows a part of such a sample data string as it is enlarged. In FIG. 8B, two data pieces denoted at Vp(8) and Vp(19) among the respective sample data pieces are dominantly larger than the other data pieces and two data pieces denoted at Vp(4) and Vp(16) are dominantly smaller than the other data pieces because of superimposition of the noises. Although only the p-polarized light component among the two outputs from the sensor is described here, a similar concept applies to the s-polarized light component, too.

A detectable spot diameter of the density sensor 60 is about 2 to 3 mm for instance, while discoloration, dirt and the like of the intermediate transfer belt 71 are generally in a size of a larger range. Hence, one can conclude that these local spikes in the data are due to the influence of the noises described above. When a foundation profile, a density of a patch image or the like is calculated based on such sample data which contain superimposed noises and density control factors are set in accordance with the result of the calculation, it may become impossible to set each density control factor always to a proper condition and an image quality may deteriorate.

Noting this, as shown in FIG. 7, after sampling the outputs from the sensor over one round of the intermediate transfer belt 71 at the step S23, the spike-like noises are removed in this preferred embodiment (Step S24).

Figure 9:
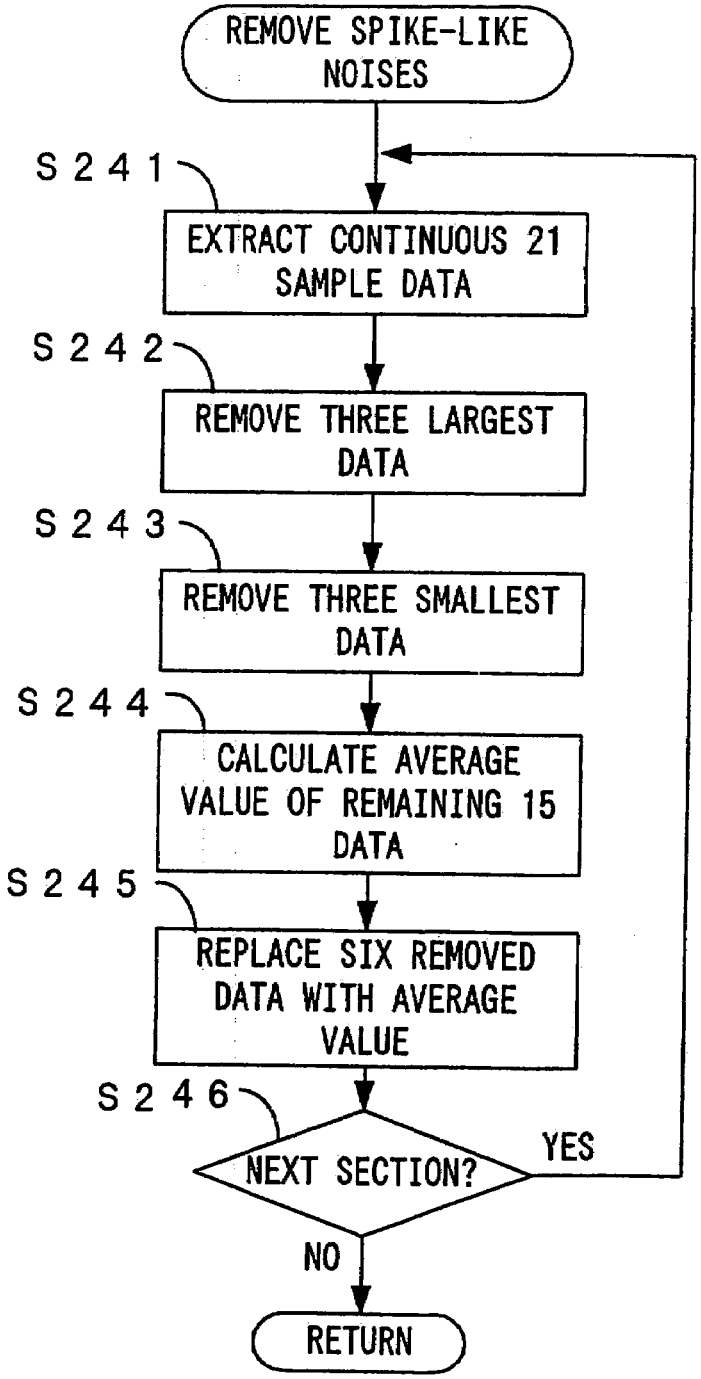
FIG. 9 is a flow chart which shows a spike-like noise removing process in the first preferred embodiment.

FIG. 9 is a flow chart which shows a spike-like noise removing process in this preferred embodiment. During the spike-like noise removing process, of an acquired sample data string as it is "raw," that is, as it has not been processed, a continuous local section (whose length corresponds to 21 samples in this preferred embodiment) is extracted (Step S241), and after removing data pieces having the three highest and the three lowest levels from the 21 sample data pieces contained in this section (Step S242, Step S243), an arithmetic average of the remaining 15 data pieces is calculated (Step S244). The average value is regarded as an average level in this section, and the six data pieces removed at the steps S242 and S243 are replaced with the average value, whereby a noise-free "corrected" sample data string is obtained (Step S245). Further, the steps S241 through S245 are repeated for the next section as well when necessary, thereby removing spike-like noises (Step S246).

Figure 10:
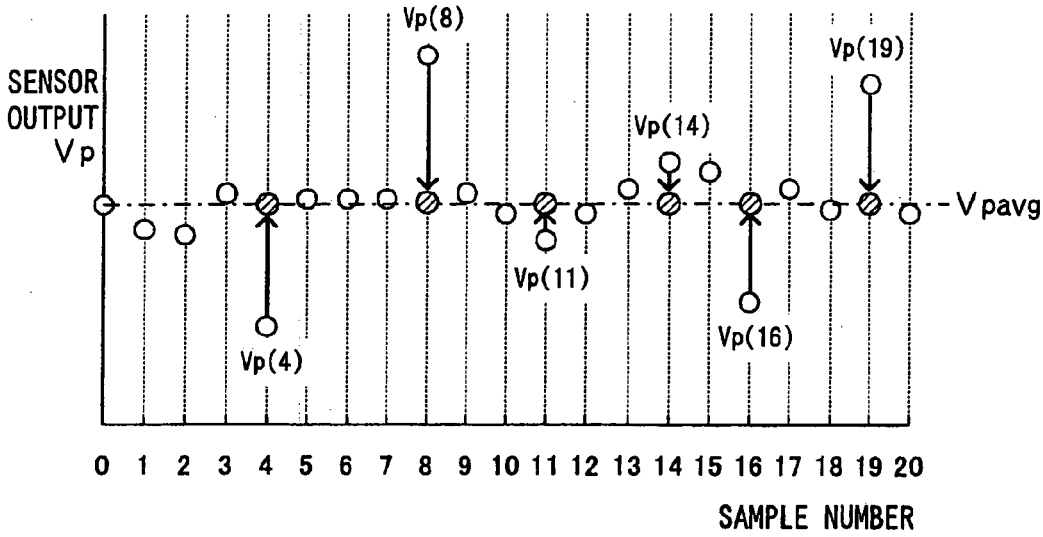
FIG. 10 is a drawing which shows spike-like noise removal in the first preferred embodiment.

Removal of spike-like noises during the process above will now be described in more detail on the data string shown in FIG. 8B, while referring to FIG. 10. FIG. 10 is a drawing which shows spike-like noise removal in this preferred embodiment. In the data string shown in FIG. 8B, the influence of the noises seems to be visible over the two data pieces Vp(8) and Vp(19) which are dominantly larger than the other data pieces and the two data pieces Vp(4) and Vp(16) which are dominantly smaller than the other data pieces. Since the spike-like noise removing process requires to remove the three largest sample data pieces (Step S242 in FIG. 9), those which are to be removed are the three data pieces Vp(8), Vp(14) and Vp(19) including the two data pieces which seem to contain the noises. In a similar manner, the three data pieces Vp(4), Vp(11) and Vp(16) including the two data pieces which seem to contain the noises are also removed (Step S243 in FIG. 9). As these six data pieces are replaced with the average value Vpavg of the other 15 data pieces (denoted at the shadowed circles) as shown in FIG. 10, the spike-like noises which used to be contained in the original data are removed.

For spike-like noise removal, the number of samples to be extracted and the number of data pieces to be removed are not limited to those described above but may be any desired numbers. However, since it becomes impossible to obtain a sufficient noise removing effect and an error may intensify depending on a choice of these numbers, it is desirable to carefully determine these numerical figures in view of the following points.

That is, extraction of too short a section of a data string as compared to the frequency of noises pushes up the possibility that noises are not included in the section within which spike-like noise removal will be executed and increases the number of calculations, and therefore, is not efficient. On the other hand, extraction of too long a section ends up in averaging out even significant variations in sensor output, namely, variations which represent a density change of an object of detection, and thus makes it impossible to correctly calculate a density profile despite the original purpose.

Further, since the frequency of noises is not constant, uniform removal of a predetermined number of largest or smallest data pieces from an extracted data string may result in removal of data such as data pieces Vp(11) and Vp(14) which do not contain noises, or on the contrary, may fail to sufficiently remove noises. Even when a few noise-free data components get removed, as shown in FIG. 10, since a difference between the data pieces Vp(11) and Vp(14) and the average value Vpavg is relatively small, an error attributed to replacement of these data pieces with the average value Vpavg is small. On the other hand, when the noise-containing data pieces are left not removed, replacement of the other data pieces with an average value calculated including these noise-containing data pieces may increase an error. Hence, it is desirable to calculate a ratio of the number of data pieces to be removed to the number of extracted sample data pieces such that the ratio will be comparable to or slightly higher than the frequency of noises created in the actual apparatus.

The spike-like noise removing process in this preferred embodiment is designed as described above, based on the empirical fact that the frequency of data pieces shifted to be larger than an originally intended profile due to an influence of noises was about the same as the frequency of data pieces shifted to be smaller than the originally intended profile due to the influence of the noises and that the frequency of the noises themselves was about 25% or lower (five or fewer samples out of 21 samples) as shown in FIG. 8A.

Various other methods than the one described above may be used as a method of removing spike-like noises. For instance, it is possible to remove spike-like noises by processing "raw" sample data obtained through sampling with conventional low-pass filtering. However, since conventional filtering changes not only noise-containing data but also neighboring data from original values although it is possible to make a noise waveform less sharp, a large error may arise depending on the state of noises.

On the contrary, according to this preferred embodiment, since the corresponding number of largest or smallest data pieces to the frequency of noises are replaced with an average value in sample data and the other data pieces are left unchanged, it is less likely that such an error will arise.

The spike-like noise removing process is executed not only for calculation of the foundation profile described above, but is performed also on sample data which were acquired as the amount of reflection light for the purpose of calculating an image density of a toner image as described later.

B-2. Idling of Developer (Pre-Operation 2)

It is known that when the power source is OFF or even when the power source is ON, if there has been continuation of the operation-suspended state without any image forming operation performed over a long period of time before the next image forming operation, an image may have a cyclic density variation. This phenomenon will be hereinafter referred to "shutdown-induced banding." The inventors of the present invention have found that the cause of shutdown-induced banding is because toner fixedly adheres to the developer roller 44 after left carried on the developer roller 44 of each developer for a long time and because the layer of the toner on the developer roller 44 gradually becomes uneven as the amount of the adhering toner and the retention force of the adhering toner are not uniform on the surface of the developer roller 44.

The inventors' findings on shutdown-induced banding will now be described.

Shutdown-induced banding is most prominently recognized in an image which is formed for the first time after the operation-suspended state. As images are formed repeatedly, how ever, density variations due to the shutdown induced banding gradually become less visible. After formation of a couple of images, density variations almost disappear. Meanwhile, predominant density variations appear in the event that the operation-suspended state has lasted for a long time or in a high temperature/high humidity environment.

Further, shutdown-induced banding becomes remarkable when a developer roller comprising a conductive surface is used. That is, in the case of an apparatus which uses a metallic developer roller or a developer roller whose surface of a non-conductive material seats a conductive layer, density variations due to shutdown-induced banding are noticeable.

To clarify a mechanism of shutdown-induced banding, using a developer having the structure shown in FIG. 3, the inventors conducted an experiment, made an observation and obtained the following findings. First, according to the observation on development of density variations in images, the following correlation was found between the shading in the images and positions within the surface of the developer roller 44. That is, an image developed with toner carried on a surface area within the surface of the developer roller 44 which used to be located inside the developer housing 41

(hereinafter referred to as a "inside section") during the operation-suspended state had a high density, whereas an image developed with toner carried on a surface area which used to be exposed outside the housing 41 (hereinafter referred to as an "outside section") had a low density.

In addition, using a surface electrometer, the inventors measured a potential distribution of a toner layer on the surface of the developer roller 44 after continuation of the operation-suspended state, and found that the absolute value of the potential of the toner layer was low in a portion corresponding to the inside section but was high in a portion corresponding to the outside section. The potential difference gradually decreased as the developer roller 44 rotated, and the surface potential finally became approximately uniform.

The inventors further measured a toner electrification amount (μ C/g) and a transported toner amount (mg/cm$^2$) on the surface of the developer roller 44, and found that the transported toner amount remained almost the same between the inside section and the outside section while the toner electrification amount was about twice higher in the outside section than in the inside section. It therefore is thought that the potential difference described above was attributed to the difference in toner electrification amount.

From this, the inventors have concluded that shutdown-induced banding occurs since the toner electrification amount is different at different positions, more precisely, between the inside section and the outside section on the developer roller 44 which has just escaped from the operation-suspended state. Since the electrification amount difference gradually decreases as the developer roller 44 rotates, it is believed that immediately after the end of the operation-suspended state, the state of the surface of the developer roller 44 which electrifies the toner by means of friction is different between the inside section and the outside section.

Observing the surface of the developer roller 44, one notices that there is a great amount of fine powder such as toner having small particle diameters, an additive which fell off from the toner, etc. Differences in terms of the amount of adhering fine powder components, the water content and the like influence the condition of frictional between the developer roller 44 and the toner and consequent electrification. Inside the developer, the toner containing such fine powder components always remains in contact with the developer roller 44, and is therefore urged against the developer roller 44 under pressure as the supply roller 43, the restriction blade 45, the seal member 46 and the like stay abutting on the developer roller 44. For this reason, of the surface of the developer roller 44, within the area which remains inside the developer during the operation-suspended state (the inside section), the fine powder components tend to solidify and adhere to the surface. On the contrary, solid adhesion of the fine powder components occurs only on a relatively small scale in the outside section which is exposed outside the developer, since the toner adheres only because of electrostatic force.

As described above, when the apparatus is left in the operation-suspended state for a long period of time, the condition of solid adhesion of the fine powder components becomes uneven on the surface of the developer roller 44 and the toner electrification amount becomes different. This is a major cause of shutdown-induced banding.

In addition, whether shutdown-induced banding easily occurs is also dependent upon the structure of the apparatus. Shutdown-induced banding attributed to fine powder components particularly easily occurs when the apparatus uses a developer, such as the developer 4K and the like according to this embodiment, in which the restriction blade 45 for creating a toner layer having predetermined thickness on the developer roller 44 is disposed below the developer roller 44. This is because such fine powder components tend to remain in a lower portion of the developer housing and hence there are a large number of fine powder components in the vicinity of the abutting position (the restricting position) at which the restriction blade 45 abuts on the developer roller 44.

Particularly in the event that the toner is peeled off from the developer roller 44 on the upstream side to the restricting position in the rotation direction D3 of the developer roller 44 and the peeling position of toner peeling is located above the restricting position as shown in FIG. 3, shutdown-induced banding is more remarkable. The reason is as follows. Around the peeling position, there are fine powder components which are newly created because of friction between the supply roller 43 and the developer roller 44, fine powder components which have been scraped off from the developer roller 44, etc. Due to rotations of the supply roller 43 and the developer roller 44, the gravity and the like, these fine powder components are fed one after another to the abutting position at which the supply roller 43 abuts on the developer roller 44 and the restricting position. Solid adhesion of the fine powder components therefore easily occurs on the surface of the developer roller 44, which in turn easily leads to shutdown-induced banding.

Meanwhile, in the event that the surface of the developer roller 44 is made of a conductive material, solid adhesion of fine powder owing to image force is strong. Hence, an apparatus which comprises such a developer roller easily gives rise to shutdown-induced banding.

A typical structure of a developer roller is that the roller as a whole is formed into a cylindrical shape using the same material or that a core member and a sleeve of different materials are coaxially combined with each other. Examples of the structure which easily bring the shutdown-induced banding may be: i) a structure that the entire roller or at least a sleeve is made of metal or an alloy; ii) a structure that the entire roller or at least a sleeve is made of conductive rubber, a conductive resin or the like; and iii) a structure that a surface of an insulation or conductive roller is covered with a conductive surface layer. In this context, "conductive" means that the specific resistance by volume is approximately $1\times10^{-2}$ Ω·m or lower, and materials meeting this requirement include metal, metallic oxides, metallic nitrides, graphites, etc. With respect to the examples above, the surface layer referred to in the example iii) may be a conductive material such as metal, an alloy and a conductive resin or alternatively a layer which is obtained by dispersing a conductive material in an insulating material. A method of coating with such a surface layer may be plating, vapor deposition, pressure bonding, thermal spraying, spray coating, dipping coating, etc.

Whether shutdown-induced banding easily occurs is further dependent upon the nature of the toner. In other words, shutdown-induced banding easily occurs in the case of an apparatus which uses toner which contains a wax component which serves as a parting agent for prevention of fixing offset. This is because fine powder of wax liberated from toner particles, some of toner particles with the wax component exposed to the particle surfaces and the like easily allow the toner to adhere to the developer roller 44 because of the van der Waals force.

Referring back to FIG. 7, the pre-operation 2 will be continuously described. When density control factors are to be newly optimized prior to formation of the next image after the apparatus has been in the operation-suspended state for long with the surface of the developer roller 44 uneven, a density variation appearing in a patch image owing to shutdown-induced banding may affect optimization. An image forming apparatus which has any one of the structures described above easily creates density variations attributed to shutdown-induced banding, and therefore, it is necessary to implement some measures to eliminate shutdown-induced banding.

Noting this, for the purpose of eliminating shutdown-induced banding before formation of a patch image, each developer roller 44 is rotated idle in the image forming apparatus according to this preferred embodiment. As the right-hand side flow (the pre-operation 2) in FIG. 7 shows, first, the yellow developer 4Y is positioned at the developing position facing the photosensitive member 2 (Step S25), and after setting the average developing bias Vavg to a value having the smallest absolute value within a variable range of the average developing bias (Step S26), the developer roller 44 is rotated at least one round using the rotation driver (not shown) which is disposed to the main section (Step S27). Following this, while rotating the developer unit 4 and thereby switching the developer (Step S28), the other developers 4C, 4M and 4K are positioned at the developing position in turn and the developer roller 44 disposed to each developer is rotated one round or more. As each developer roller 44 is rotated idle one round or more in this manner, a toner layer on the surface of each developer roller 44 is peeled off and re-formed by the supply roller 43 and the restriction blade 45. Hence, thus reformed more uniform toner layer is used for subsequent formation of a patch image, which makes it less likely to see a density variation attributed to shutdown-induced banding.

During the pre-operation 2 described above, the average developing bias Vavg is set so as to have the smallest absolute value at the step S26. The reason is as follows.

As described later, with respect to the average developing bias Vavg serving a density control factor which affects an image density, the larger the absolute value |Vavg| of the average developing bias Vavg is, the higher a density of a formed toner image becomes. This is because the larger the absolute value |Vavg| becomes, a potential difference increases which develops between an area in the electrostatic latent image on the photosensitive member 2 exposed with the light beam L, namely, the surface area which the toner is to adhere to, and the developer roller 44, and the movement of the toner from the developer roller 44 is further facilitated. However, at the time of acquisition of the foundation profile of the intermediate transfer belt 71, a such toner movement is not desirable. This is because as the toner which has moved from the developer roller 44 to the photosensitive member 2 transfers onto the intermediate transfer belt 71 within the primary transfer region TR1, the transferred toner changes the amount of reflection light from the intermediate transfer belt 71, and it becomes impossible to correctly calculate the foundation profile.

In this preferred embodiment, as described later, the average developing bias Vavg can be changed over stages within a predetermined variable range, as one of density control factors. Noting this, with the average developing bias Vavg set to a value having the smallest absolute value within the variable range, such a state is realized which least likely leads to a movement of toner from the developer roller 44 to the photosensitive member 2, and adhesion of the toner to the intermediate transfer belt 71 is suppressed to minimum. For a similar reason, in an apparatus in which a developing bias contains an alternating current component, it is preferable that the amplitude of the developing bias is set to be smaller than an amplitude for ordinary image formation. For example, as described earlier, in an apparatus requiring the peak-to-peak voltage Vpp of the developing bias to be 1400 V, the peak-to-peak voltage Vpp may be about 1000 V. In an apparatus using a duty ratio of the developing bias, the charging bias and the like for instance as density control factors, too, it is preferable that the density control factors are set appropriately so as to realize a condition which less likely leads to a movement of toner as that described above.

Further, this preferred embodiment requires to simultaneously execute the pre-operation 1 and the pre-operation 2 described above parallel to each other, for the purpose of shortening a processing time. In other words, while the pre-operation 1 demands, for acquisition of the foundation profile, to rotate the intermediate transfer belt 71 idle at least one round or more preferably three rounds including two rounds needed for calibration of the sensor, it is preferable to rotate the developer roller 44 idle as much as possible also during the pre-operation 2. Since these processes can be executed independently of each other, parallel execution makes it possible to shorten a period of time needed for the entire operation while ensuring time needed for each one of these processes. In this preferred embodiment, two pre-operation processes, namely, the pre-operation 1 which includes "preceding processing" of the present invention and the pre-operation 2 which includes "idling" of the present invention, are executed in parallel.

C. Derive Control Target Value

In the image forming apparatus according to this preferred embodiment, as described later, two types of toner images are formed as patch images and each density control factor is adjusted so that densities of these toner images will have a density target value. The target value is not a constant value but may be changed in accordance with an operating state of the apparatus. The reason is as follows.

As described earlier, in the image forming apparatus according to this preferred embodiment, the amount of reflection light from a toner image which has been visualized on the photosensitive member 2 and primarily transferred on the surface of the intermediate transfer belt 71 is detected, and an image density of the toner image is estimated. While there are widely used conventional techniques for calculating an image density from the amount of reflection light from a toner image, as described below in detail, a correlation between the amount of reflection light from a toner image carried on the intermediate transfer belt 71 (or the sensor outputs Vp and Vs which correspond to the light amount) and an optical density (OD value) of a toner image formed on the sheet S which is a final recording medium is not determined uniformly but changes slightly depending on the conditions of the apparatus, the toner, etc. Hence, even when each density control factor is controlled so that the amount of reflection light from a toner image will be constant according to conventional techniques, a density of an image eventually formed on the sheet S will change depending on the condition of the toner.

Figure 11A:
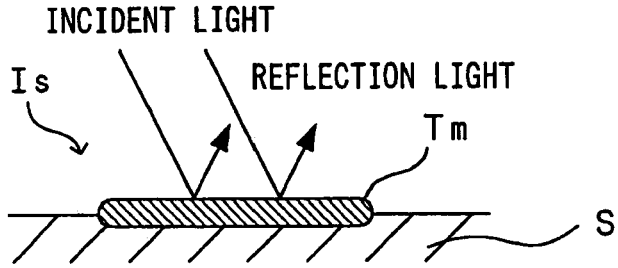
FIGS. 11A, 11B and 11C are schematic diagrams which show a relationship between a particle diameter of toner and the amount of reflection light.
Figure 11B:
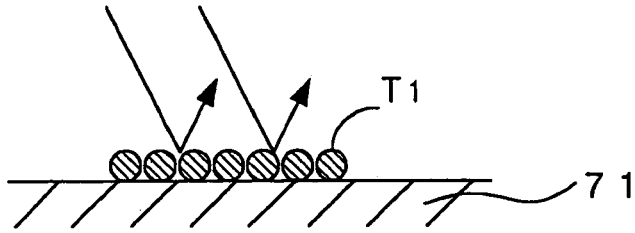
Figure 11C:
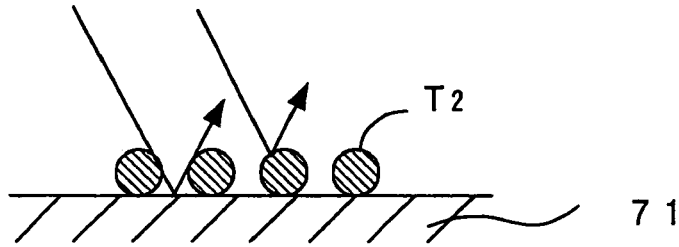

One cause that the sensor outputs fail to match with an OD value on the sheet S is that toner fused on the sheet S after a fixing process reflects differently from toner merely adhering to the surface of the intermediate transfer belt 71 without getting fixed to the surface of the intermediate transfer belt 71. FIGS. 11A, 11B and 11C are schematic diagrams which show a relationship between a particle diameter of toner and the amount of reflection light. As shown in FIG. 11A, in an image Is eventually formed on the sheet S, toner Tm melted by heat and pressure during the fixing process has fused on the sheet S. Hence, while an optical density (OD value) of the image represents the amount of reflection light as it is with the toner fused, the value of the optical density is determined mainly by a toner density on the sheet S (which can be expressed as a toner mass per unit surface area for instance).

On the contrary, in the case of the toner image on the intermediate transfer belt 71 which has not been through the fixing process, toner particles merely adhere to the surface of the intermediate transfer belt 71. Hence, even when the toner density is the same (That is, even when the OD value after the fixing is the same.), the amount of reflection light is not necessarily the same between a state that toner T1 having a small particle diameter shown in FIG. 11B has adhered in a high density and a state that toner T2 having a large particle diameter shown in FIG. 11C has adhered in a low density and the surface of the intermediate transfer belt 71 is locally exposed. In other words, even when the amount of reflection light from the pre-fixing toner image is the same, a post-fixing image density (OD value) does not always become the same. The experiment conducted by the inventors of the present invention has identified that in general, when the amount of reflection light is the same, if a ratio of toner having a large particle diameter to toner particles which form a toner image, a post-fixing image density tends to be high.

Figure 12A:
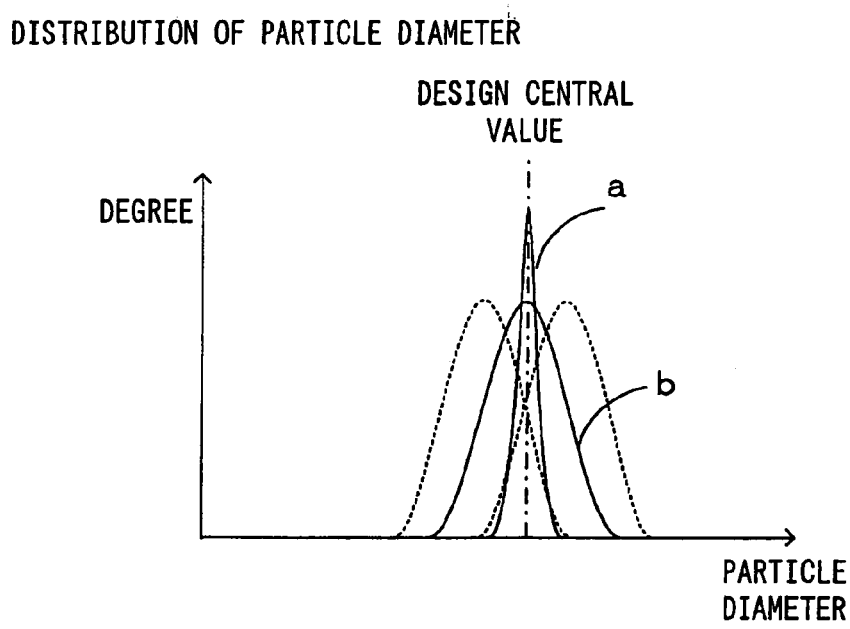
FIGS. 12A and 12B are drawings which show how a toner particle diameter distribution and a change in OD value relate to each other.
Figure 12B:
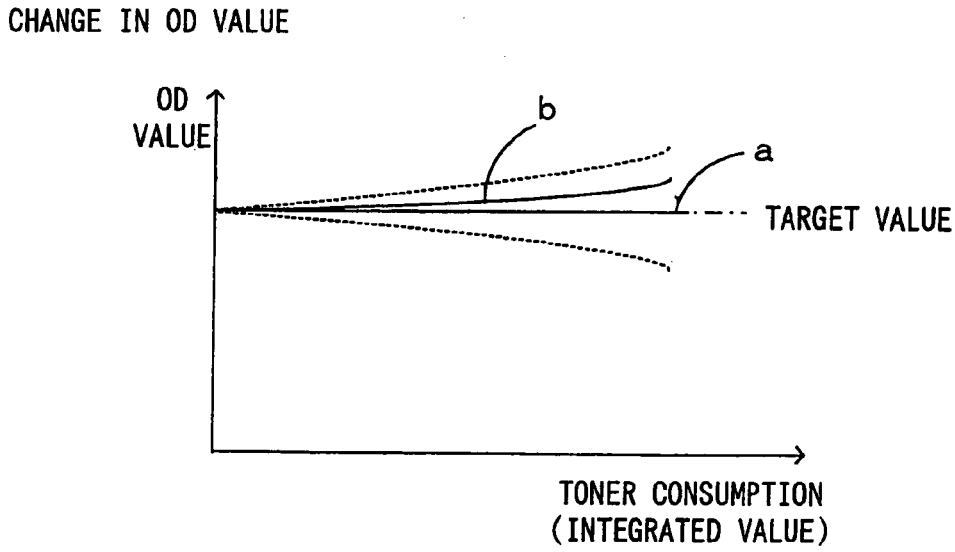

In this manner, a correlation between an OD value on the sheet S and the amount of reflection light from a toner image on the intermediate transfer belt 71 changes in accordance with the condition of toner, and particularly, a distribution of toner particle diameters. FIGS. 12A and 12B are drawings which show how a particle diameter distribution of toner and a change in OD value relate to each other. It is ideal that particle diameters of toner particles housed for formation of a toner image in the respective developers are all aligned to a design central value. However, as shown in FIG. 12A, in reality, the particle diameters are distributed in various manners depending on the type of the toner, a method of manufacturing the toner and the like of course. Even in the case of toner manufactured to meet the same specifications, the distribution slightly changes for each production batch and each product.

Since the mass, the electrification amount and the like of toner having various particle diameters are different, when an image is formed with the toner having such a particle diameter distribution, use of these toner is not uniform. Rather, such toner whose particle diameters are suitable to the apparatus is selectively used, and the other toner are left in the developers without used very much. Hence, as the toner consumption increases, the particle diameter distribution of the toner remaining in the developers changes.

As described earlier, since the amount of reflection light from a pre-fixing toner image changes in accordance with the diameters of the particles which form the toner, even though each density control factor is adjusted so that the amount of reflection light will be constant, a density of a image fixed on the sheet S does not always become constant. FIG. 12B shows a change in optical density (OD value) of an image on the sheet S which was formed while controlling each density control factor so that the amount of reflection light from a toner image, namely, the output voltages from the density sensor 60 will be constant. In the event that the toner particle diameters are well aligned in the vicinity of the design central value as denoted at the curve a in FIG. 12A, even when the consumption of the toner in the developers advances, the OD value is maintained approximately at a target value, as denoted at the curve a in FIG. 12B. On the contrary, as denoted at the curve b in FIG. 12A, when toner whose particle diameter distribution is wider is used, although toner whose particle diameters are close to the design central value is mainly used and an OD value almost the same as a target value is obtained initially as denoted at the curve b in FIG. 12B, as the toner consumption increases, the proportion of the popular toner decreases, toner having larger particle diameters starts to be used for formation of an image, and the OD value gradually increases. Further, as denoted at the dotted curves in FIG. 12A, a median value of the distribution is sometimes off the design value from the beginning depending on a production batch of the toner or the developers, and the OD value on the sheet S accordingly changes in various manners as more toner is used as denoted at the dotted curves in FIG. 12B.

Factors which influence a characteristic of toner include, in addition to a particle diameter distribution of the toner described above, the condition of pigment dispersion within mother particles of the toner, a change in electrifying characteristic of the toner owing to the condition of mixing of the toner mother particles and an additive, etc. Since a toner characteristic slightly varies among products, an image density on the sheet S is not always constant and the extent of a density change varies depending on toner which is used. Hence, in a conventional image forming apparatus in which each density control factor is controlled so that output voltages from a density sensor will be constant, a variation in image density because of a variation in toner characteristic is unavoidable and it therefore is not always possible to obtain a satisfactory image quality.

Figure 13:
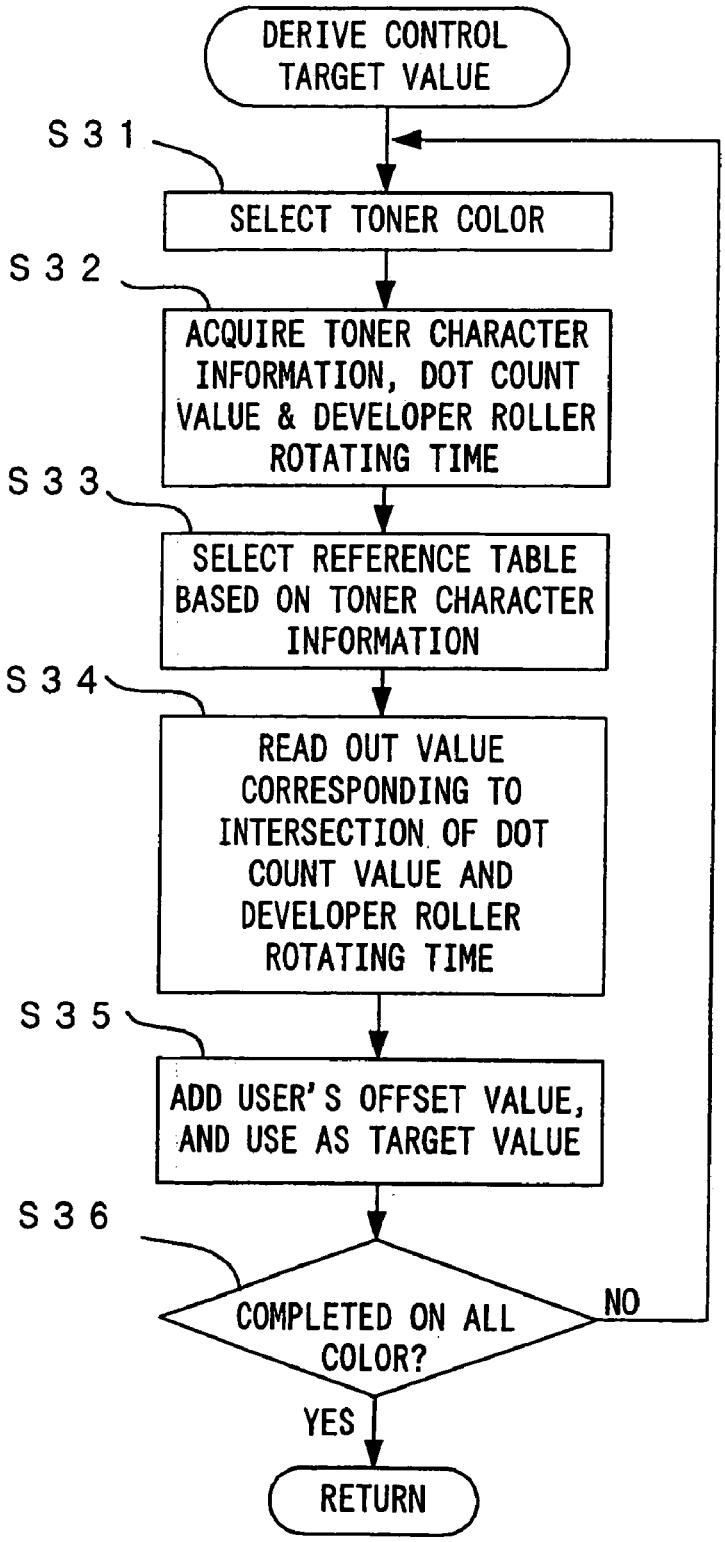
FIG. 13 is a flow chart which shows a process of deriving a control target value in the first preferred embodiment.

Noting this, in this preferred embodiment, with respect to each one of two types of patch images described later, a control target value for an image density evaluation value (described later) which represents the image density is set in accordance with an operating state of the apparatus, and each density control factor is adjusted so that the evaluation value for each patch image will be the control target value, whereby an image density on the sheet S is maintained constant. FIG. 13 is a flow chart which shows a process of deriving the control target values in this preferred embodiment. In this process, for each toner color, a control target value suiting the condition of use of the toner, namely, an initial characteristic such as a particle diameter distribution of the toner upon introduction into the developers, and the amount of the toner which remains the developer, are calculated. First, one of the toner colors is selected (Step S31), and the CPU 101 acquires, as information for estimating the condition of use of the toner, "toner character information" regarding the selected toner color, a "dot count" value which expresses the number of dots formed by the exposure unit 6 and information regarding a "developer roller rotating time (Step S32)". Although the description here relates to an example that a control target value corresponding to the black color is calculated, the description should remain similar on the other toner colors, too.

"Toner character information" is data written in a memory 94 which is disposed to the developer 4K in accordance with characteristics of the toner which is housed in the developer 4K. In this apparatus, noting that various characteristics such as the particle diameter distribution of the toner described above are different among different production batches, the characteristics of the toner are classified into eight types. The type of the toner is then determined based on an analysis during production, and 3-bit data representing the type are fed as toner character information to the developer 4K. This data are read out from the memory 94 when the developer 4K is mounted to the developer unit 4 and stored in the RAM 107 of the engine controller 10.

Meanwhile, a "dot count value" is information for estimating the amount of the toner which remains within the developer 4K. While to calculate from an integrated value of the number of formed images is the simplest method of estimating the remaining amount of the toner, it is difficult to learn about an accurate remaining amount with this method since the amount of the toner consumed by formation of one image is not constant. On the other hand, the number of dots formed by the exposure unit 6 on the photosensitive member 2 is indicative of the number of dots which are visualized on the photosensitive member 2 with the toner, the number of dots more accurately represents the consumed amount of the toner. Noting this, in this preferred embodiment, the number of dots as it is when the exposure unit 6 has formed an electrostatic latent image on the photosensitive member 2 which is to be developed by the developer 4K is counted and stored in the RAM 107. Thus stored dot count value is used as information which represents the amount of the toner which remains within the developer 4K.

In addition, a "developer roller rotating time" is information for estimating in more detail the characteristics of the toner which remains within the developer 4K. As described earlier, there is the toner layer on the surface of the developer roller 44, and some of the toner moves onto the photosensitive member 2 and development is realized. At this stage, on the surface of the developer roller 44, the toner which has not contributed to the development is transported to an abutting position on the supply roller 43 and peeled off by the supply roller 43, thereby forming a new toner layer. As adhesion to and peeling off from the developer roller 44 is repeated in this manner, the toner is fatigued and the characteristics of the toner gradually change. Such a change in toner characteristics intensifies as the developer roller 44 rotates further. Hence, even when the amounts of toner remaining within the developer 4K is the same, there sometimes is a difference in characteristics between fresh toner which has not been used yet and old toner which has repeatedly adhered and has been peeled off. Densities of images formed using these toner may not necessarily be the same.

Noting this, in this preferred embodiment, the condition of the toner housed inside the developer 4K is estimated based on a combination of two pieces of information, one being a dot count value which represents a remaining toner amount and the other being a developer roller rotating time which represents the extent of a change in toner characteristics, and a control target value is set more finely in accordance with the toner condition in order to stabilize an image quality.

These pieces of information are used also for the purpose of enhancing the ease of maintenance through management of the states of wear-out of the respective portions of the apparatus. That is, one dot count corresponds to a toner amount of 0.015 mg. When 12000000 dot counts are reached, the consumption of the toner is about 180 g, which means that almost all of the toner stored in each developer has been used up. With respect to a developer roller rotating time, an integrated value of 10600 sec derived from the developer roller rotating time corresponds to 8000 pages of continuous printing in the JIS (Japanese Industrial Standard) A4 size, and therefore, it is not preferable to continue formation of images any more considering an image quality. In this preferred embodiment, therefore, when any one of these pieces of information reaches the value above, a message indicative of the end of the toner appears in a display not shown to thereby encourage a user to exchange the developers.

From these information regarding the operating state of the apparatus thus acquired, a control target value suiting the operating state is determined. This preferred embodiment requires to calculate in advance through experiments optimal control target values which are proper to toner character information which expresses the type of the toner and to characteristics of the remaining toner estimated based on a combination of the dot count value and the developer roller rotating time. These values are stored as look-up tables by toner type in the ROM 106 of the engine controller 10. Based on thus acquired toner character information, the CPU 101 selects one table which is to be referred to in accordance with the type of the toner (Step S33), and reads out from the table a value which corresponds to the combination of the dot count value and the developer roller rotating time at that time (Step S34).

Further, in the image forming apparatus according to this preferred embodiment, as a user enters an input through a predetermined operation on an operation part not shown, a density of an image to be formed is increased or decreased within a predetermined range in accordance with the user's preference or when such is necessary. In short, every time the user increases or decreases the image density by one notch in response to the value thus read out from the look-up table described above, a predetermined offset value which may be 0.005 per notch for instance is added or subtracted, and the result of this is set as a control target value Akt for the black color at that time and stored in the RAM 107 (Step S35). The control target value Akt for the black color is determined in this manner.

FIGS. 14A and 14B are drawings which show examples of look-up tables which are for calculating a control target value. This table is a table which is referred to when toner whose color is black and whose characteristics belong to "type 0" is to be used. This preferred embodiment uses, for each one of two types of patch images, one for a high density and the other for a low density as described later, and for each toner color, eight types of tables which respectively correspond to eight types of toner characteristics, and these tables are stored in the ROM 106 of the engine controller 10. Shown in FIG. 14A is an example of a table which corresponds to a high-density patch image, while shown in FIG. 14B is an example of a table which corresponds to a low-density patch image.

When the toner character information acquired at the step S32 described above expresses the "type 0" for example, at the following step S33, the table shown in FIGS. 14A and 14B corresponding to the toner character information "0" is selected respectively out from the eight types of tables. The control target value Akt is then calculated based on thus acquired dot count value and developer roller rotating time. For example, for a high-density patch image, when the dot count value is 1500000 counts and the developer roller rotating time is 2000 sec. the value 0.984 which corresponds to the combination of these two is found to be the control target value Akt with reference to FIG. 14A. Further, when a user has set the image density one notch higher than a standard level, the value 0.989 which is obtained by adding 0.005 to this value is the control target value Akt. In a similar manner, it is possible to calculate a control target value for a low-density patch image.

The control target value Akt calculated in this fashion is stored in the RAM 107 of the engine controller 10. During later setting of each density control factor, it is ensured that an evaluation value calculated based on the amount of reflection light from a patch image matches with this control target value.

As described above the control target value is calculated for the toner color through execution of the steps S31 through S35 described above. The process above is repeated for each toner color (Step S36), and control target values Ayt, Act and Amt and the control target value Akt on all toner colors are found. The subscripts y, c, m and k represent the respective toner colors, i.e., yellow, cyan, magenta and black, while the subscript t expresses that these values are control target values.

D. Setting of Developing Bias

In this image forming apparatus, the average developing bias Vavg fed to the developer roller 44 and an energy E per unit surface area of the exposure beam L which exposes the photosensitive member 2 (hereinafter referred to simply as "exposure energy") are variable, and with these values adjusted, an image density is controlled. The following describes an example that optimal values of these two are calculated while changing the average developing bias Vavg over six stages of V0 to V6 from the low level side and changing the exposure energy E over four stages of a level 0 to a level 3 from the low level side. The variable ranges and the number of stages in each variable range, however, may be changed appropriately in accordance with the specifications of the apparatus. In an apparatus wherein the variable range of the average developing bias Vavg described above is from (−110 V) to (−330 V), the lowest level V0 corresponds to (−110 V) with the smallest absolute voltage value and the highest level V5 corresponds to (−330 V) with the largest absolute voltage value.

Figure 15:
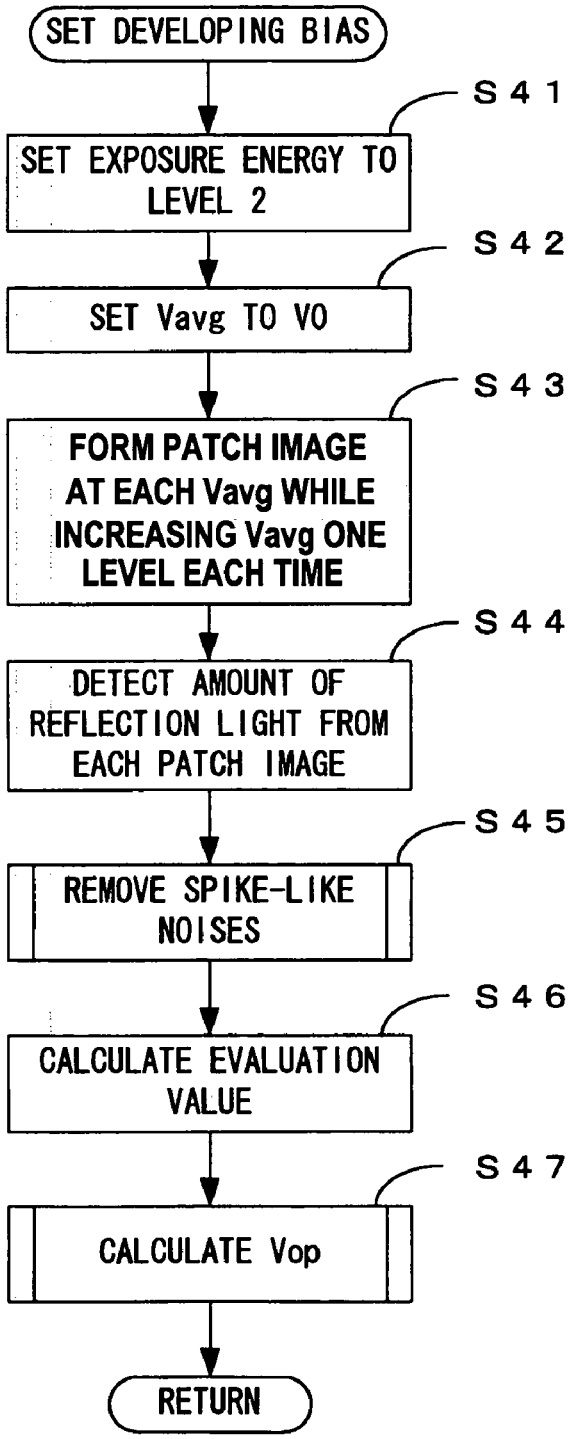
FIG. 15 is a flow chart which shows a developing bias setting process in the first preferred embodiment.
Figure 16:
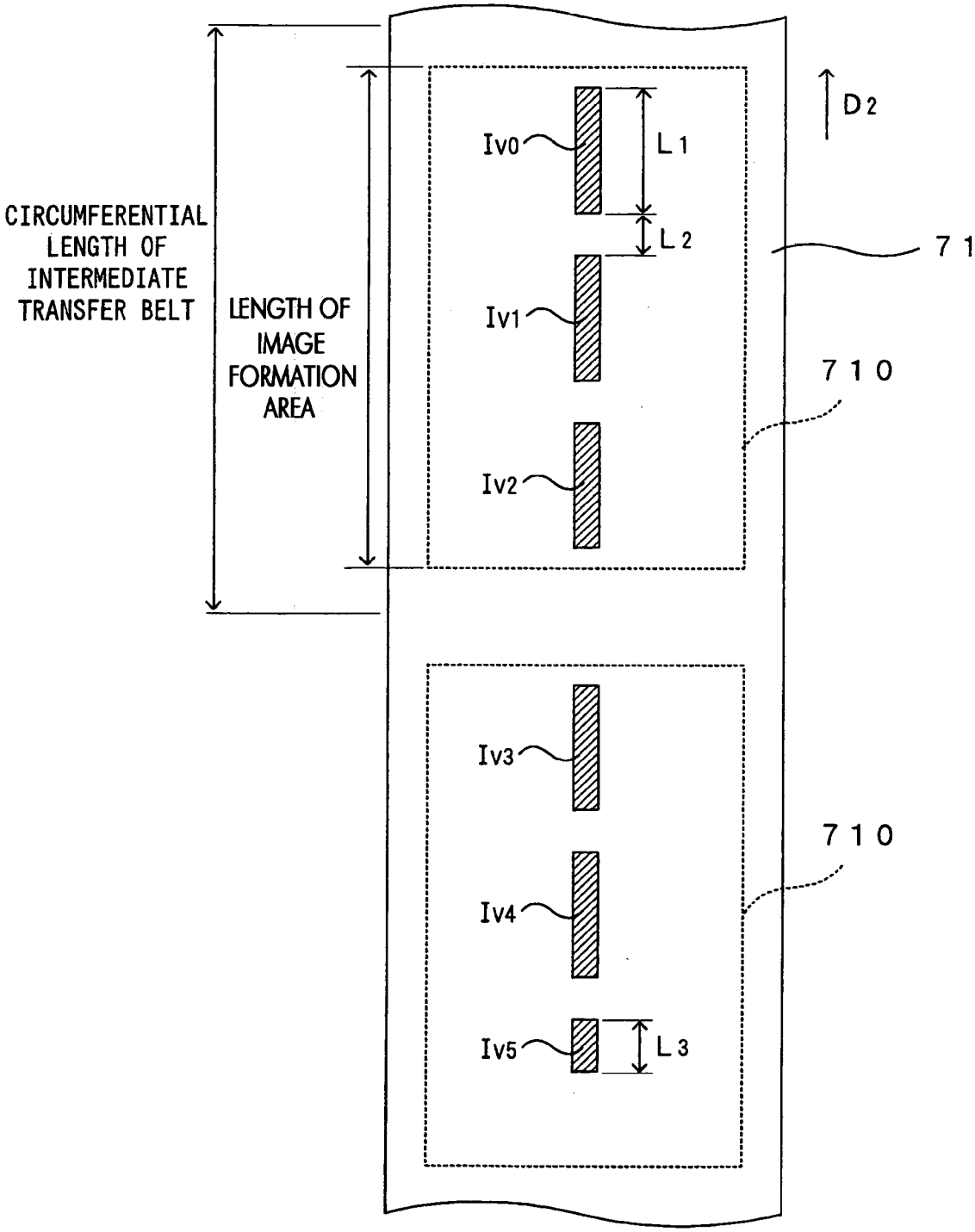
FIG. 16 is a drawing which shows a high-density patch image.

FIG. 15 is a flow chart which shows a developing bias setting process in this preferred embodiment, and FIG. 16 is a drawing which shows a high-density patch image. During this process, first, the exposure energy E is set to the level 2 (Step S41), and while increasing the average developing bias Vavg from the lowest level V0 by one level each time, a solid image which is to serve a high-density patch image is formed with each bias value (Step S42, Step S43).

While six patch images Iv0 through Iv5 are sequentially formed on the surface of the intermediate transfer belt 71 as shown in FIG. 16 in response to the average developing bias Vavg which is changed over the six stages, the first five patch images Iv0 through Iv4 have a length L1. The length L1 is set to be longer than the circumferential length of the photosensitive member 2 which has a cylinder-like shape. On the other hand, the last patch image Iv5 is formed to have a shorter length L3 than the circumferential length of the photosensitive member 2. The reason will be described later. Further, when the average developing bias Vavg is changed, there is a slight delay until the potential of the developer roller 44 becomes uniform, and therefore, the patch images are formed at intervals L2 considering the delay. While an area which can carry a toner image within the surface of the intermediate transfer belt 71 is an image formation area 710 in reality which is shown in FIG. 16, since the patch images have such shapes and arrangement as described above, about three patch images can be formed in the image formation area 710. The six patch images are thus distributed over two rounds of the intermediate transfer belt 71 as shown in FIG. 16.

Figure 17A:
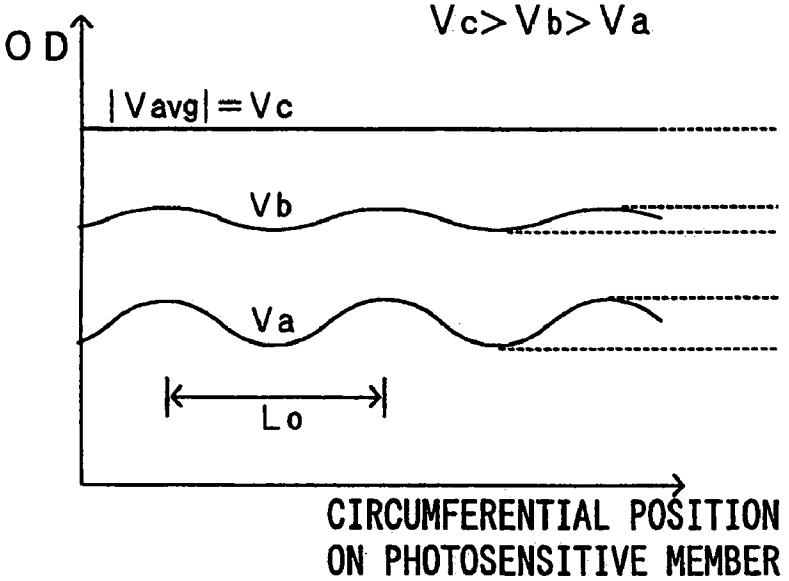
FIGS. 17A and 17B are drawings which show a variation in image density which appears at the cycles of rotation of a photosensitive member.
Figure 17B:
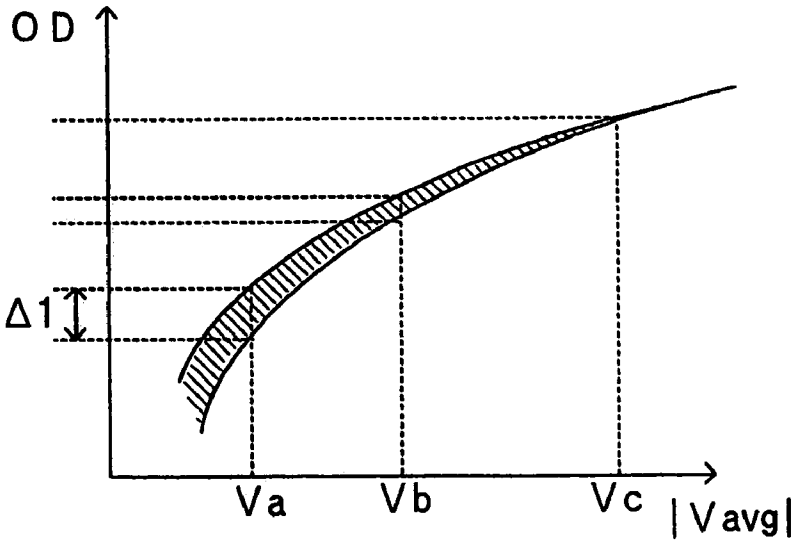

The reason that the lengths of the patch images are set as above will now be described with reference to FIGS. 17A and 17B. FIGS. 17A and 17B are drawings which show a variation in image density which appears at the cycles of rotation of the photosensitive member. As shown in FIG. 1, while the photosensitive member 2 is formed in a cylindrical shape (with a circumferential length of L0), the shape may not sometimes be completely cylindrical or may sometimes have eccentricity due to a production-induced variation, thermal deformation, etc. In such a case, an image density of a toner image may include cyclic variations which correspond to the circumferential length L0 of the photosensitive member 2. The reason is as follows. In an apparatus of the contact developing type in which development with toner is achieved with the photosensitive member 2 and the developer roller 44 abutting on each other, the abutting pressure between the two changes. Meanwhile, in an apparatus of the non-contact developing type in which development using toner is achieved with the two disposed away from each other, the strength of an electric field which causes transfer of the toner between the two changes. Therefore, a probability of a toner movement from the developer roller 44 to the photosensitive member 2 accordingly changes cyclically at the rotating cycles of the photosensitive member 2 in any apparatus.

The widths of the density variations are large particularly when the absolute value |Vavg| of the average developing bias Vavg is relatively small and decrease as the value |Vavg| increases as shown in FIG. 17A. For instance, when a patch image is formed with the absolute value |Vavg| of the average developing bias set to a relatively small value V0, as shown in FIG. 17B, the corresponding image density OD changes within the range of a width . 1 depending on the location on the photosensitive member 2. In a similar manner, even when a patch image is formed with other developing bias, the corresponding image density changes within a certain range as denoted at the shadowed portion in FIG. 17B. In this fashion, the density OD of the patch image varies depending on not only the average developing bias Vavg but also the position of the patch image formed on the photosensitive member 2. Hence, to calculate an optimal value of the average developing bias Vavg from the image density of the patch image, it is necessary to eliminate an influence of density variations which correspond to the rotating cycles of the photosensitive member 2 exerted over the patch image.

Noting this, in this preferred embodiment, a patch image having the length L1 which exceeds the circumferential length L0 of the photosensitive member 2 is formed, and an average value of densities calculated over the length L0 of the patch image is used as the image density of the patch image. This effectively suppresses an influence of density variations which correspond to the rotating cycles of the photosensitive member 2 exerted over the density of each patch image, which in turn makes it possible to properly calculate an optimal value of the average developing bias Vavg based on the density.

In this preferred embodiment, as shown in FIG. 16, of the respective patch images Iv0 through Iv5, the last patch image Iv5 formed with the average developing bias Vavg set to the maximum has the shorter length L3 than the circumferential length L0 of the photosensitive member 2. This is because it is not necessary to calculate an average value over the cycles of the photosensitive member 2 as density variations corresponding to the rotating cycles of the photosensitive member 2 are small in a patch image formed under the condition that the absolute value |Vavg| is large as shown in FIG. 17B and as described above. In this manner, a period of time needed to form and process a patch image is shortened, and the consumption of toner during formation of the patch image is reduced.

It is desirable to form a patch image in such a manner that the length of the patch image will be larger than the circumferential length L0 of the photosensitive member 2, for the purpose of eliminating an influence of density variations created in accordance with the cycles of the photosensitive member over optimization of density control factors. However, it is not necessary that all patch images have such a length. How many patch images should have such a length needs be determined appropriately in accordance with the extent of density variations which appear in each apparatus, a desired image quality level, etc. For instance, in the event that an influence of density variations at the cycles of the photosensitive member is relatively small, the patch image Iv0 formed with the average developing bias Vavg set to the minimum may have the length L1 and the other patch images Iv1 through Iv5 may have the shorter length L3.

Although all patch images may be formed to have the length L1 on the contrary, in this case, there arises a problem that a processing time and the consumption of toner increase. In addition, it is not preferable in terms of image quality to create density variations corresponding to the cycles of rotation of the photosensitive member even when the average developing bias Vavg is maximum, and therefore, the variable range of the average developing bias Vavg should be determined so that such density variation will not appear at least when the average developing bias Vavg is set to the maximum value. When the variable range of the average developing bias Vavg is set so, such density variations will not appear while the variable range of the average developing bias Vavg is at the maximum, and hence, it is not necessary that a patch image has the length L1.

Referring back to FIG. 15, the developing bias setting process will be continuously described. As for the patch images Iv0 through Iv5 thus formed each with the average developing bias Vavg, the voltages Vp and Vs outputted from the density sensor 60 in accordance with the amounts of reflection light from the surfaces of the patch images are sampled (Step S44). In this preferred embodiment, at 74 points (corresponding to the circumferential length L0 of the photosensitive member 2) as for the patch images Iv0 through Iv4 having the length L1 and at 21 points (corresponding to the circumferential length of the developer roller 44) as for the patch image Iv5 which has the length L3, sample data are obtained from the output voltages Vp and Vs from the density sensor 60 at sampling cycles of 8 msec. In a similar manner to that during derivation of the foundation profile (FIG. 7) described earlier, removal of spike-like noises from the sample data is executed (Step S45). And then, an "evaluation value" on each patch image is calculated (Step S46) from the resulting data after the removal of dark outputs of the sensor system, an influence of the foundation profile and the like.

As described earlier, the density sensor 60 of this apparatus exhibits a characteristic that an output level with no toner adhering to the intermediate transfer belt 71 is the largest but decreases as the amount of the toner increases. Further, an offset due to the dark outputs has been superimposed on the output. Therefore, the output voltage data from the sensor as they directly are hard to be handled as information which is for evaluating the amount of the adhering toner. Noting this, in this preferred embodiment, thus obtained data are processed into such data which express the amount of the adhering toner, that is, converted into an evaluation value, so as to make it easy to execute the subsequent processing.

A method of calculating the evaluation value will now be more specifically described, in relation to an example of a patch image in the black color. Of six patch images developed with the black toner, an evaluation value Ak(n) for an n-th patch image Ivn (where n=0, 1, . . . , 5) is calculated from the formula below:

$$Ak(n)=1-\{Vpmeank(n)-Vpo\}/\{Vpmean_b-Vpo\}$$

The respective terms included in the formula mean the following.

First, the term Vpmeank(n) denotes a noise-removed average value of sample data outputted from the density sensor 60 as the output voltage Vp, which corresponds to the p-polarized light component of reflection light from the n-th patch image Ivn, and thereafter sampled. That is, a value Vpmeank(0) corresponding to the first patch image Iv0 for instance denotes an arithmetic average of 74 pieces of sample data which were detected as the output voltage Vp from the density sensor 60 over the length L0 of this patch image, subjected to spike-like noise removal and stored in the RAM 107. The subscript k appearing in each term of the formula above expresses that these values are on the black color.

Meanwhile, the term Vpo denotes a dark output voltage from the light receiver unit 670*p* acquired during the pre-operation 1 described earlier with the light emitter element 601 turned off. As the dark output voltage Vpo is subtracted from the sampled output voltage, it is possible to calculate a density of a toner image at a high accuracy while eliminating an influence of the dark output.

Further, the term Vpmean_b denotes an average value of sample data which were, of the foundation profile data stored in the RAM 107 obtained earlier, detected at the same positions as positions at which the 74 pieces of sample data used for the calculation of Vpmeank(n) were detected.

Hence, in a condition that no toner has adhered at all as a patch image to the intermediate transfer belt 71, Vpmeank (n)=Vpmean_b holds satisfied and the evaluation value Ak(n) accordingly becomes zero. On the other hand, in a condition that the surface of the intermediate transfer belt 71 is completely covered with the black toner and the reflectance is zero, Vpmeank(n)=Vpo holds satisfied and hence the evaluation value Ak(n)=1.

When the evaluation value Ak(n) is used instead of using the value of the sensor output voltage Vp as it directly is, it is possible to measure an image density of a patch image at a high accuracy while canceling an influence due to the condition of the surface of the intermediate transfer belt 71. In addition, because of correction in accordance with the shading of the patch image on the intermediate transfer belt 71, it is possible to further improve the accuracy of measuring the image density. In addition, this permits to normalize the density of the patch image Ivn using a value ranging from the minimum value 0, which expresses a state that no toner has adhered, to the maximum value 1, which expresses a state that the surface of the intermediate transfer belt 71 is covered with high-density toner, and accordingly express the density of the patch image Ivn, which is convenient to estimate a toner image density during the subsequent processing.

As for the other toner color than black, that is, the yellow color (Y), the cyan color (C) and the magenta color (M), since the reflectance is higher than on the black color and the amount of reflection light is not zero even when the surface of the intermediate transfer belt 71 is covered with toner, there may be a case that a density can not be accurately expressed using the evaluation value obtained in the manner above. In this embodiment therefore, used as sample data at the respective positions for calculation of evaluation values Ay(n), Ac(n) and Am(n) for these toner colors is not the output voltage Vp corresponding to the p-polarized light component but is a value PS which is obtained by dividing a value obtained by subtracting the dark output Vpo from the output voltage Vp by a value obtained by subtracting the dark output Vso from the output voltage Vs corresponding to the s-polarized light component, that is, PS=(Vp−Vpo)/(Vs−Vso), which makes it possible to accurately estimate image densities also in these toner colors. In addition, as in the case of the black color, a sensor output obtained at the surface of the intermediate transfer belt 71 prior to toner adhesion is considered, thereby canceling an influence exerted by the condition of the surface of the intermediate transfer belt 71. Further, owing to correction in accordance with the shading of a patch image on the intermediate transfer belt 71, it is possible to further improve the accuracy of measuring an image density.

For example, as for the cyan color (C), the evaluation value Ac(n) is calculated from:

$$Ac(n)=1-\{PSmeanc(n)-Pso\}/\{PSmean_b-Pso\}$$

The symbol PSmeanc(n) denotes an average value of noise-removed PS values calculated from the sensor outputs. Vp and Vs at the respective positions of the n-th patch image Ivn in the cyan color. Meanwhile, the symbol Pso denotes a value PS which corresponds to the sensor outputs Vp and Vs as they are in a condition that the surface of the intermediate transfer belt 71 is completely covered with the color toner, and is the minimum possible value of PS. Further, the symbol PSmean_b denotes an average value of the values PS calculated from the sensor outputs Vp and Vs as they are sampled as a foundation profile at the respective positions on the intermediate transfer belt 71.

When the evaluation values for the color toner are defined as described above, as in the case of the black color described earlier, it is possible to normalize the density of the patch image Ivn using a value ranging from the minimum value 0, which expresses a state that no toner has adhered to the intermediate transfer belt 71 (and that PSmeanc(n)=PSmean_b is satisfied), to the maximum value 1, which expresses a state that the intermediate transfer belt 71 is covered completely with the toner (and that PSmeanc (n)=PSo is satisfied), and express the density of the patch image Ivn.

Figure 18:
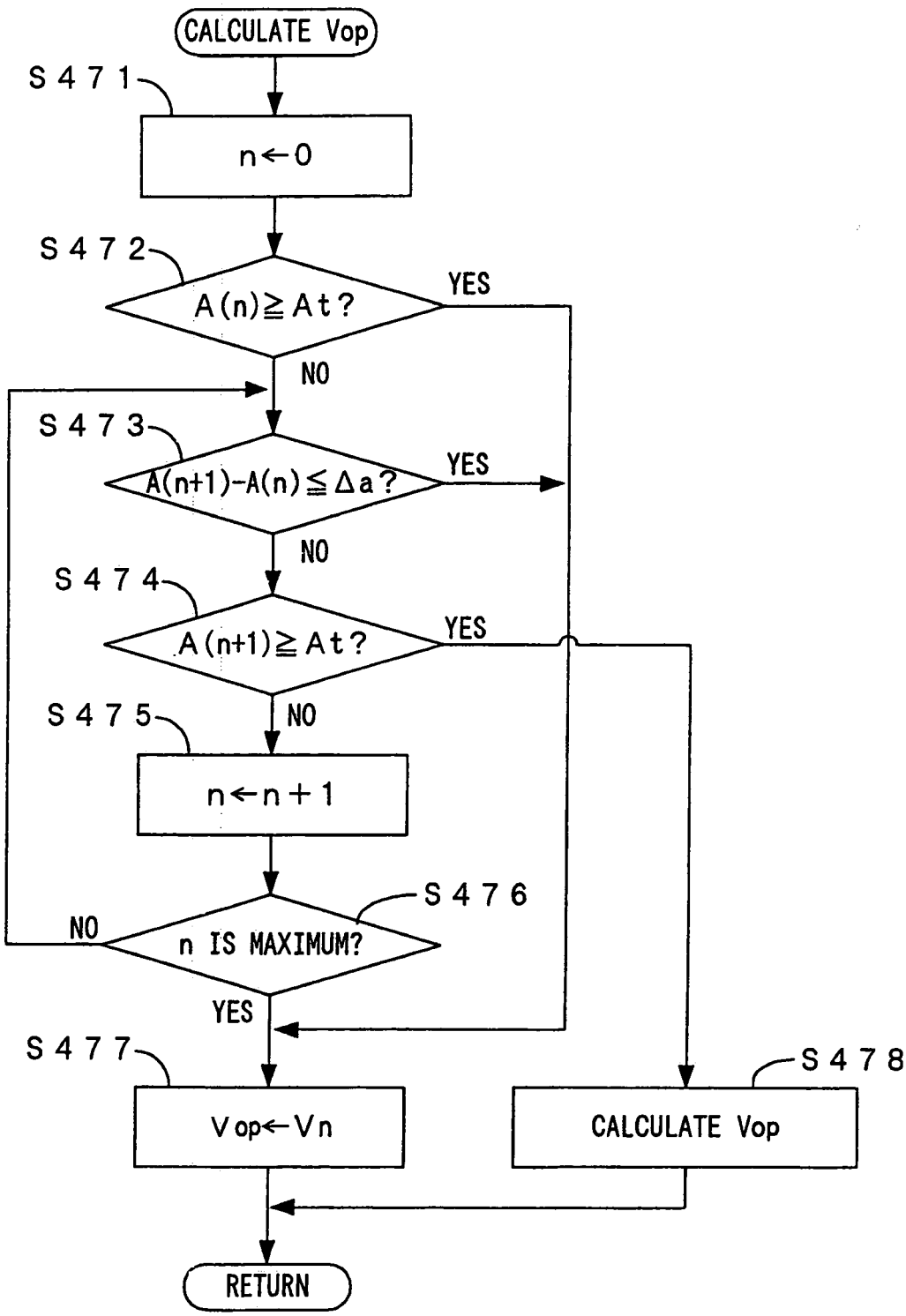
FIG. 18 is a flow chart which shows a process of calculating an optimal value of developing bias in the first preferred embodiment.

As the densities of the patch images (to be more specific, the evaluation values for the patch images) are thus calculated, an optimal value Vop of the average developing bias Vavg is calculated based on these values (Step S47). FIG. 18 is a flow chart which shows a process of calculating the optimal value of the developing bias in this preferred embodiment. This process remain unchanged in terms of content among the toner colors, and therefore, the subscripts (y, c, m, k) expressing evaluation values and corresponding to the toner colors are omitted in FIG. 18. However, the evaluation values and target values for the evaluation values may of course be different value among the different toner colors.

First, a parameter n is set to 0 (Step S471), and an evaluation value A(n), namely A(0), is compared with a control target value At (Akt for the black color for instance) which was calculated earlier (Step S472). At this stage, the evaluation value A(0) being equal to or larger than the control target value At means that an image density over a target density has been obtained with the average developing bias Vavg set to the minimum value V0. Hence, there is no need to study a higher developing bias, and the process is ended acknowledging that the minimum developing bias V0 at this stage is the optimal value Vop (Step S477).

On the contrary, when the evaluation value A(0) is yet to reach the control target value At, an evaluation value A(1) for a patch image Iv1 formed with a developing bias V1 which is one level higher is read out, a difference from the evaluation value A(0) is calculated, and whether thus calculated difference is equal to or smaller than a predetermined value . a is judged (Step S473). In the event that the difference between the two is equal to or smaller than the predetermined value . a, in a similar fashion to the above, the average developing bias V0 is acknowledged as the optimal value Vop. The reason for this will be described in detail later.

On the other hand, when the difference between the two is larger than the predetermined value . a, the process proceeds to a step S474 and the evaluation value A(1) is compared with the control target value At. At this stage, when the evaluation value A(1) is the same as or over the control target value At, since the control target value At is larger than the evaluation value A(0) but is equal to or smaller than the evaluation value A(1), that is since A(0) <At≦A(1), the optimal value Vop of the developing bias for obtaining the target image density must be between the developing biases V0 and V1. In short, V0<Vop≦V1.

In such a case, the process proceeds to a step S478 to calculate the optimal value Vop through computation. While various methods may be used as the calculation method, an example may be to approximate a change in evaluation value in accordance with the average developing bias Vavg as a proper function within a section from V0 to V1 and thereafter to use, as the optimal value Vop, such an average developing bias Vavg with which a value derived from the function is the control target value At. Of these various methods, while the simplest one is a method which requires to linearly approximate an evaluation value change, when the variable range of the average developing bias Vavg is properly selected, it is possible to calculate the optimal value Vop at a sufficient accuracy. Of course, although the optimal value Vop may be calculated by other method, e.g., using a more accurate approximate function, this is not always practical considering a detection error of the apparatus, a variation among apparatuses, etc.

On the other hand, in the event that the control target value At is larger than the evaluation value A(1) at the step S474, n is incremented by 1 (Step S475) and the optimal value Vop is calculated while repeating the steps S473 through S475 described above until n reaches the maximum value (Step S476). In the meantime, when calculation of the optimal value Vop has not succeeded, i.e., when any one of the evaluation values corresponding to the six patch images has not reached the target value, even after n has reached the maximum value (n=5) at the step S476, the developing bias V5 which makes the density largest is used as the optimal value Vop (Step S477).

As described above, in this embodiment, each one of the evaluation values A(0) through A(5) corresponding to the respective patch images Iv0 through Iv5 is compared with the control target value At and the optimal value Vop of the developing bias for achieving the target density is calculated based on which one of the two is larger than the other. But at the step S473, as described earlier, when a difference between the evaluation values A(n) and A(n+1) corresponding to continuous two patch images is equal to or smaller than the predetermined value . a, the developing bias Vn is used as the optimal value Vop. The reason is as follows.

As shown in FIG. 17B, the apparatus exhibits a characteristic that while an image density OD on the sheet S increases as the average developing bias Vavg increases, the growth rate of the image density decreases in an area where the average developing bias Vavg is relative large, but gradually saturates. This is because as toner has adhered at a high density to a certain extent, an image density will not greatly increase even though the amount of the adhering toner increases further. To increase the average developing bias Vavg to further increase an image density in an area wherein the growth rate of the image density is small ends up in excessively increasing the toner consumption although a very large increase in density can not be expected, and as such, is not practical. On the contrary, in such an area, with the average developing bias Vavg set as low as possible just to an extent which tolerates a density change, it is possible to remarkably reduce the toner consumption while suppressing a drop in image density to minimum.

Noting this, in this preferred embodiment, in a range where the growth rate of the image density in response to the average developing bias Vavg is smaller than a predetermined value, a value as low as possible is used as the optimal value Vop. To be more specific, when a difference between the evaluation values A(n) and A(n+1) respectively expressing the densities of the patch images Ivn and Iv(n+1) formed with the average developing bias Vavg set to the two types of biases Vn and Vn+1 respectively is equal to or smaller than the predetermined value . a, the lower developing bias, namely, the value Vn is set as the optimal value Vop. As for the value . a, it is desirable that when there are two images on which evaluation values are different by . a from each other, the value . a is selected such that the density difference between the two will not be easily recognized with eyes or will be tolerable in the apparatus.

This prevents the average developing bias Vavg from being set to an unnecessarily high value although there is almost no increase in image density, thereby trading the image density off with the toner consumption.

The optimal value Vop of the average developing bias Vavg with which a predetermined solid image density will be obtained is thus set to any value which is within the range from the minimum value V0 to the maximum value V5. For improvement in image quality, this image forming apparatus ensures that a potential difference is always constant (325 V for instance) between the average developing bias Vavg and a surface potential in "non-scanning portion", or a portion within an electrostatic latent image on the photosensitive member 2 to which toner will not adhere in accordance with an image signal. As the optimal value Vop of the average developing bias Vavg is determined in the manner above, the charging bias applied upon the charger unit 3 by the charger controller 103, too, is changed in accordance with the optimal value Vop, whereby the potential difference mentioned above is maintained constant.

E. Setting Exposure Energy

Figure 19:
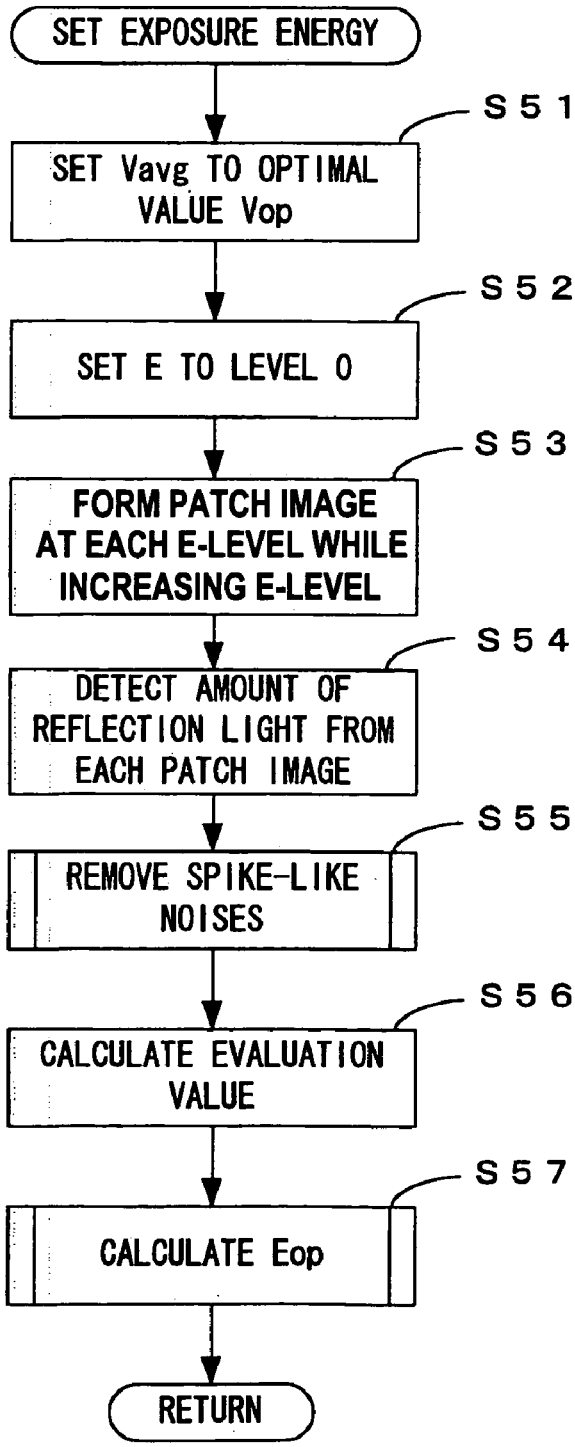
FIG. 19 is a flow chart which shows a process of setting an exposure energy in the first preferred embodiment.

Following this, the exposure energy E is set to an optimal value. FIG. 19 is a flow chart which shows a process of setting the exposure energy in this preferred embodiment. As shown in FIG. 19, the content of this process is basically the same as that of the developing bias setting process described earlier (FIG. 15). That is, first, the average developing bias Vavg is set to the optimal value Vop calculated earlier (Step S51), and while increasing the exposure energy E from the lowest level 0 by one level each time, a patch image is formed at each level (Step S52, Step S53). The sensor outputs Vp and Vs corresponding to the amount of reflection light from each patch image are sampled (Step S54), spike-like noises are removed from the sample data (Step S55), an evaluation value expressing a density of each patch image is calculated (Step S56), and the optimal value Eop of the exposure energy is calculated based on the result (Step S57).

During this process (FIG. 19), only differences from the developing bias setting process described earlier (FIG. 15) are patterns and the number of patch images to be formed and a calculation of the optimal value Eop of the exposure energy from evaluation values. The two processes are almost the same regarding the other aspects. These differences will now be described mainly.

In this image forming apparatus, while an electrostatic latent image corresponding to an image signal is formed as the surface of the photosensitive member 2 is exposed with the light beam L, in the case of a high-density image such as a solid image which has a relatively large area to be exposed, even when'the exposure energy E is changed, a potential profile of the electrostatic latent image does not change very much. On the contrary, for instance, in a low-density image such as a line image and a halftone image in which areas to be exposed are scattered like spots on the surface of the photosensitive member 2, the potential profile of the image greatly changes depending on the exposure energy E. Such a change in potential profile leads to a change in density of a toner image. In other words, a change in exposure energy E does not affect a high-density image very much but largely affects a density of a low-density image.

Noting this, in this preferred embodiment, first, a solid image is formed as a high-density patch image in which an image density is less influenced by the exposure energy E, and the optimal value of the average developing bias Vavg is calculated based on the density of the high-density patch image. Meanwhile, for calculation of the optimal value of the exposure energy E, a low-density patch image is formed. Hence, the exposure energy setting process uses a patch image having a different pattern from that of the patch image (FIG. 16) formed during the developing bias setting process.

While an influence of the exposure energy E over a high-density image is small, if a variable range of the exposure energy E is excessively wide, a density change of the high-density image increases. To prevent this, the variable range of the exposure energy E preferably ensures that a change in surface potential of an electrostatic latent image corresponding to a high-density image (which is a solid image for example) in response to a change in exposure energy from the minimum (level 0) to the maximum (level 3) is within 20 V, or more preferably, within 10 V.

Figure 20:
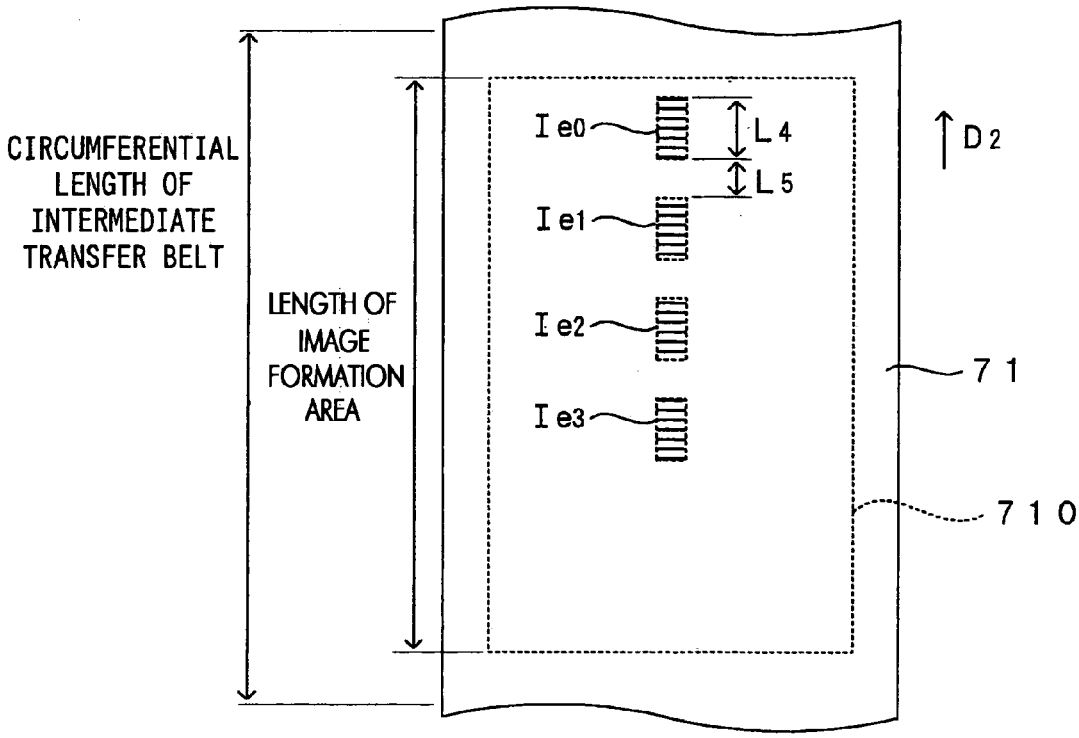
FIG. 20 is a drawing which shows a low-density patch image.

FIG. 20 is a drawing which shows a low-density patch image. As described earlier, this preferred embodiment requires to change the exposure energy E over four stages. In this example, one patch image at each level and four patch images Ie0 through Ie3 in total are formed. A pattern of the patch images used in this example is formed by a plurality of thin lines which are isolated from each other as shown in FIG. 20. To be more specific, the pattern is a 1-dot line pattern that one line is ON and ten lines are OFF. Although a pattern of a low-density patch image is not limited to this, use of a pattern that lines or dots are isolated from each other allows to express a change in exposure energy E as a change in image density and more accurately calculate the optimal value of the exposure energy E.

Further, a length L4 of each patch image is smaller than the length L1 of the high-density patch images (FIG. 16). This is because a density variation will not appear at the cycles of rotation of the photosensitive member 2 during the exposure energy setting process since the average developing bias Vavg has already been set to the optimal value Vop. In other words, present Vop is not the optimal value of the average developing bias Vavg if such a density variation appears even in this condition. However, considering a possibility that there may be density variations associated with deformation of the developer roller 44, it is preferable an average value covering a length which corresponds to the circumferential length of the developer roller 44 is used as the density of the patch image. A circumferential length of the patch image is therefore set to be longer than the circumferential length of the developer roller 44. When moving velocities (circumferential speeds) of the surfaces of the photosensitive member 2 and the developer roller 44 are not the same in an apparatus of the non-contact developing type, considering the circumferential speeds, a patch image whose length corresponds to one round of the developer roller 44 may be formed on the photosensitive member 2.

Gaps L5 between the respective patch images may be narrower than the gaps L2 shown in FIG. 16. This is because it is possible to change an energy density of the light beam L from the exposure unit 6 in a relatively short period of time, and particularly when a light source of the light beam is formed by a semiconductor laser, it is possible to change the energy density of the light beam in an extremely period of time. Such a shape and arrangement of the respective patch images, as shown in FIG. 20, permits to form all of patch images Ie0 through Ie3 over one round of the intermediate transfer belt 71, and hence, to shorten a processing time.

Figure 21:
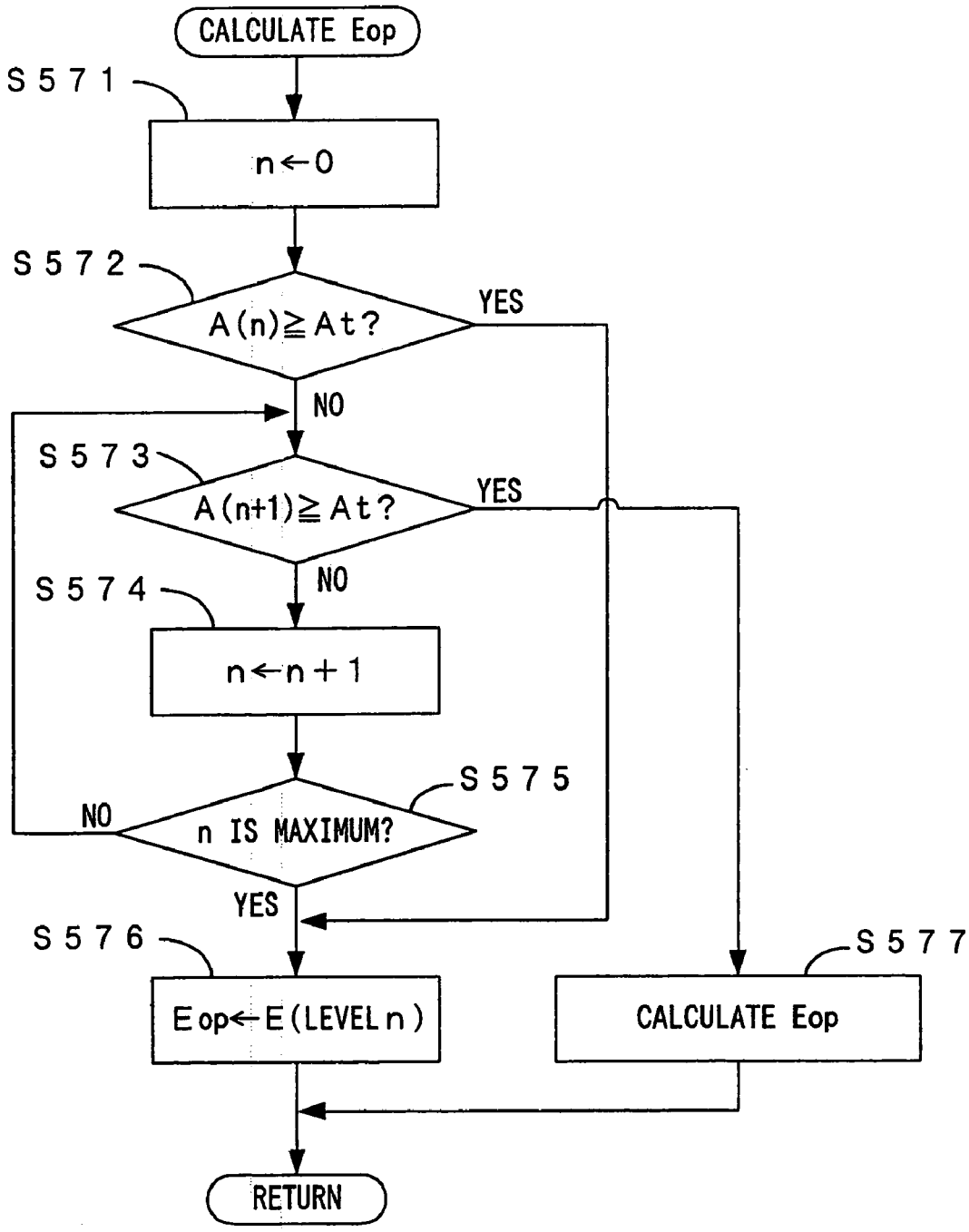
FIG. 21 is a flow chart which shows a process of calculating an optimal value of an exposure energy in the first preferred embodiment.

As for thus formed low-density patch images Ie0 through Ie3, evaluation values expressing the densities of these images are calculated in a similar manner to that described earlier for the high-density patch images. Based on the evaluation values and control target values derived from the look-up table (FIG. 14B) for low-density patch images separately prepared from the look-up table for high-density patch images, the optimal value Eop of the exposure, energy is calculated. FIG. 21 is a flow chart which shows a process of calculating the optimal value of the exposure energy in this preferred embodiment. During this process as well, as in the process of calculating the optimal value of the direct current developing bias shown in FIG. 18, the evaluation value is compared with a target value At on the patch images starting from the one formed at a low energy level, and a value of the exposure energy E which makes the evaluation value match with the target value is then calculated, thereby determining the optimal value Eop (Step S571 through Step S577).

However, since within a range of the exposure energy E which is usually used, a saturation characteristic (FIG. 17B) found on the relationship between the solid image densities and the direct current developing bias will not be found on a relationship between the line image densities and the exposure energy E, a process corresponding to the step S473 shown in FIG. 18 is omitted. In this manner, the optimal value Eop of the exposure energy E with which a desired image density will be obtained is calculated.

F. Post-Process

As the optimal values of the average developing bias Vavg and the exposure energy E are calculated in the manner above, it is now possible to form an image to have a desired image quality. Hence, the optimization of the density control factors may be terminated at this stage, or the apparatus may be made remain on standby after stopping the rotations of the intermediate transfer belt 71 and the like, or further alternatively, some adjustment may be implemented to control still other density control factors. The post-process may be any desired process, and therefore, will not be described here.

(3) Effect of the Operation

As described above, during the adjustment operation of the density control factors in this preferred embodiment, prior to formation of the patch images, the developer rollers 44 disposed to the respective developers 4Y, 4C, 4M and 4K are rotated idle. This effectively prevents density variations attributed to the unevenness of the toner which has been left on the surfaces of the developer rollers 44 from influencing the densities of the patch images, and makes it possible to accurately calculate, based on the densities of these images, the optimal values of the average developing bias Vavg and the exposure energy E which serve as the density control factors. Forming images under thus optimized conditions, this image forming apparatus realizes stable formation of a toner image whose image quality is excellent.

Further, the density sensor 60 detects the amounts of reflection light from the patch image area on the intermediate transfer belt 71 both before and after the formation of patch images and the evaluation values corresponding to the densities of the patch images are calculated from the detection results. Thus, the densities of the patch images are accurately calculated while eliminating an influence exerted by discoloration, a scratch and the like within the patch image areas before the patch image formation, a change in amount of reflection light, etc.

In addition, since the developing bias is set to the minimum, such a condition is identified which is less likely to cause a movement of the toner from the developer roller 44 to the photosensitive member 2 and the amounts of reflection light from the intermediate transfer belt 71 are detected while at the same time effectively preventing the toner from adhering to the intermediate transfer belt 71 and influencing the detection result, it is possible to optimize the density control factors in a short time.

Second Preferred Embodiment

The preferred embodiment above requires that the density sensor 60 is disposed facing the surface of the intermediate transfer belt 71 and detects a density of a toner image which has been primarily transferred onto the intermediate transfer belt 71 and serves as a patch image. Although, preferred embodiments of the present invention are not limited to this. For instance, as shown in FIG. 22, a density sensor may be disposed facing toward the surface of the photosensitive member 2 and detect a density of a toner image which has been developed on the photosensitive member 2.

Figure 22:
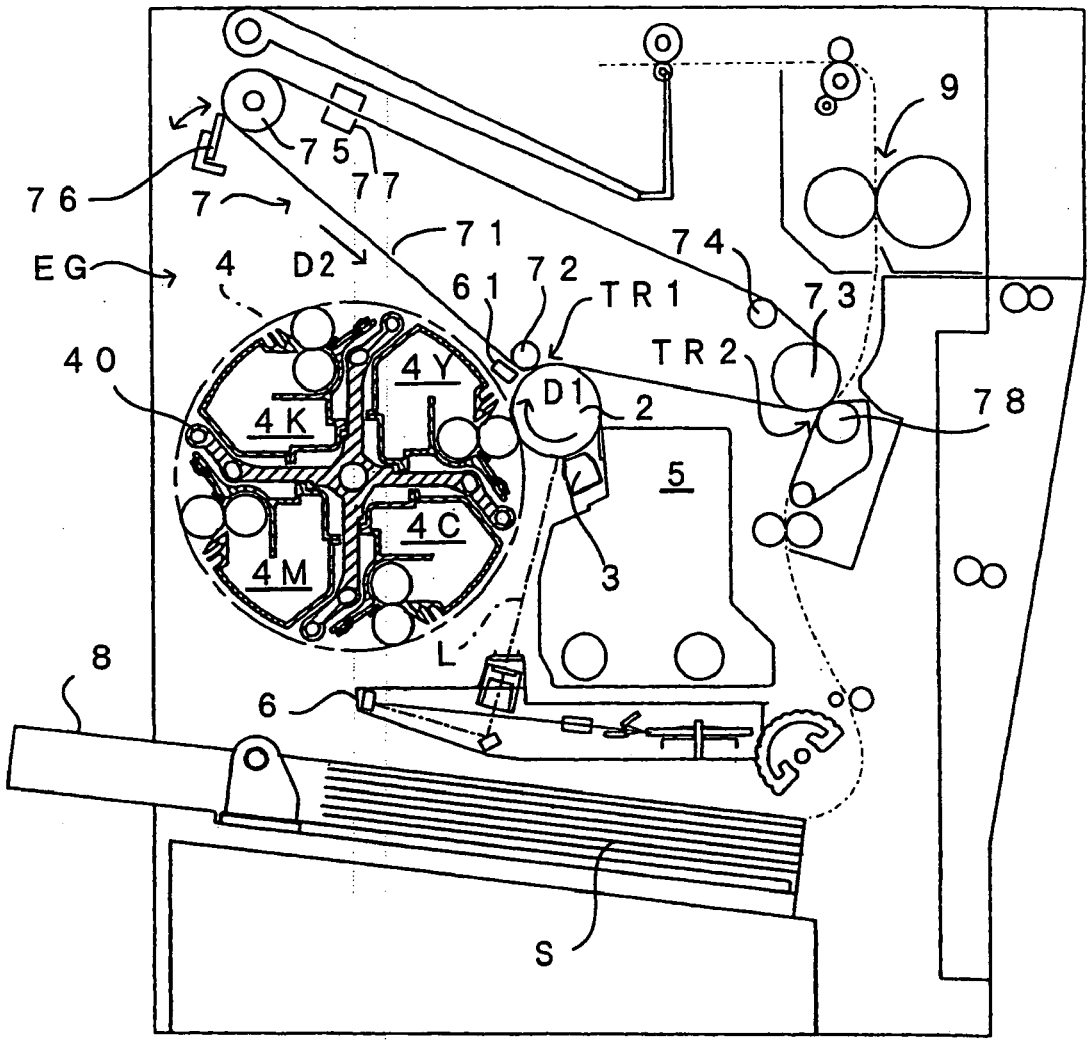
FIG. 22 is a drawing of a second preferred embodiment of the image forming apparatus according to the present invention.

FIG. 22 is a drawing of a second preferred embodiment of the image forming apparatus according to the present invention. In the image forming apparatus of this embodiment, instead of the density sensor 60 disposed facing the intermediate transfer belt 71, a density sensor. 61 is disposed which faces the photosensitive member 2 on the downstream side to an opposed position facing the developer roller 44 in the rotation direction D1 of the photosensitive member 2, as is evident from a comparison with the first preferred embodiment of the image forming apparatus shown in FIG. 1. The other structures and operations are similar to those of the apparatus of the first preferred embodiment, and therefore, will be simply denoted at the same reference symbols but will not be described again.

A structure of the density sensor 61 is approximately the same as the structure of the density sensor 60 according to the first preferred embodiment shown in FIG. 4. However, there is a difference that the sensor detects the amount of reflection light from the surface of the photosensitive member 2, not from the surface of the intermediate transfer belt 71. That is, in the second preferred embodiment, an image density of a toner image formed as a patch image on the photosensitive member 2 is obtained, and optimization of density control factors is performed based on the calculated image density. Although this process can be basically similar to the process according to the first preferred embodiment described earlier, in the event that an optical characteristic of the surface is different because of the material used, it is necessary to appropriately change the sensor sensitivity, the reference light amount, etc.

Thus, the present invention is applicable not only to an apparatus which detects a density of a patch image on an intermediate member such as the intermediate transfer belt 71, but also to an apparatus which detects a density of a patch image on an image carrier such as the photosensitive member 2.

Third Preferred Embodiment

In the first and the second preferred embodiments described above, optimization of density control factors is performed upon turning on of the power source of the apparatus, after exchange of the units, etc. Further, during the operation, the developer rollers 44 are rotated idle before forming a patch image, thereby preventing a density variation from appearing in the patch image. A similar effect is achievable with a third preferred embodiment of the image forming apparatus according to the present invention will now be described. The third preferred embodiment is an embodiment which is suitable to an image forming apparatus in which there often is a long period of time that an image is not formed although the power source of the apparatus is ON.

For example, in the case of a printer installed in an office, even in a state that the power source is always ON to permit formation of an image immediately at any time, there is not a very high frequency that the main controller 11 is actually fed with an image signal in response to a user's request for image formation and an image is actually formed. Therefore, in some cases, a few hours could elapses without forming an image. An energy save mode often called a "sleep mode" and the like in a conventional image forming apparatus has been made in light of such an actual use of the apparatus for the purpose of suppressing an unnecessary electric power consumption when an image is not formed.

When a long period of time continues without forming an image, shutdown-induced banding described earlier occurs, which may create a density variation in an image formed through the next image forming operation. Further, an image density may gradually change as a surrounding environment such as a temperature changes. Noting this, this preferred embodiment executes the optomization not only at the time of turning on of the power source and immediately after exchange of any one of the units but also after continuation of a certain period of time that an image has not been formed although the power source is ON, that is, after a long operation-suspended time.

Figure 23:
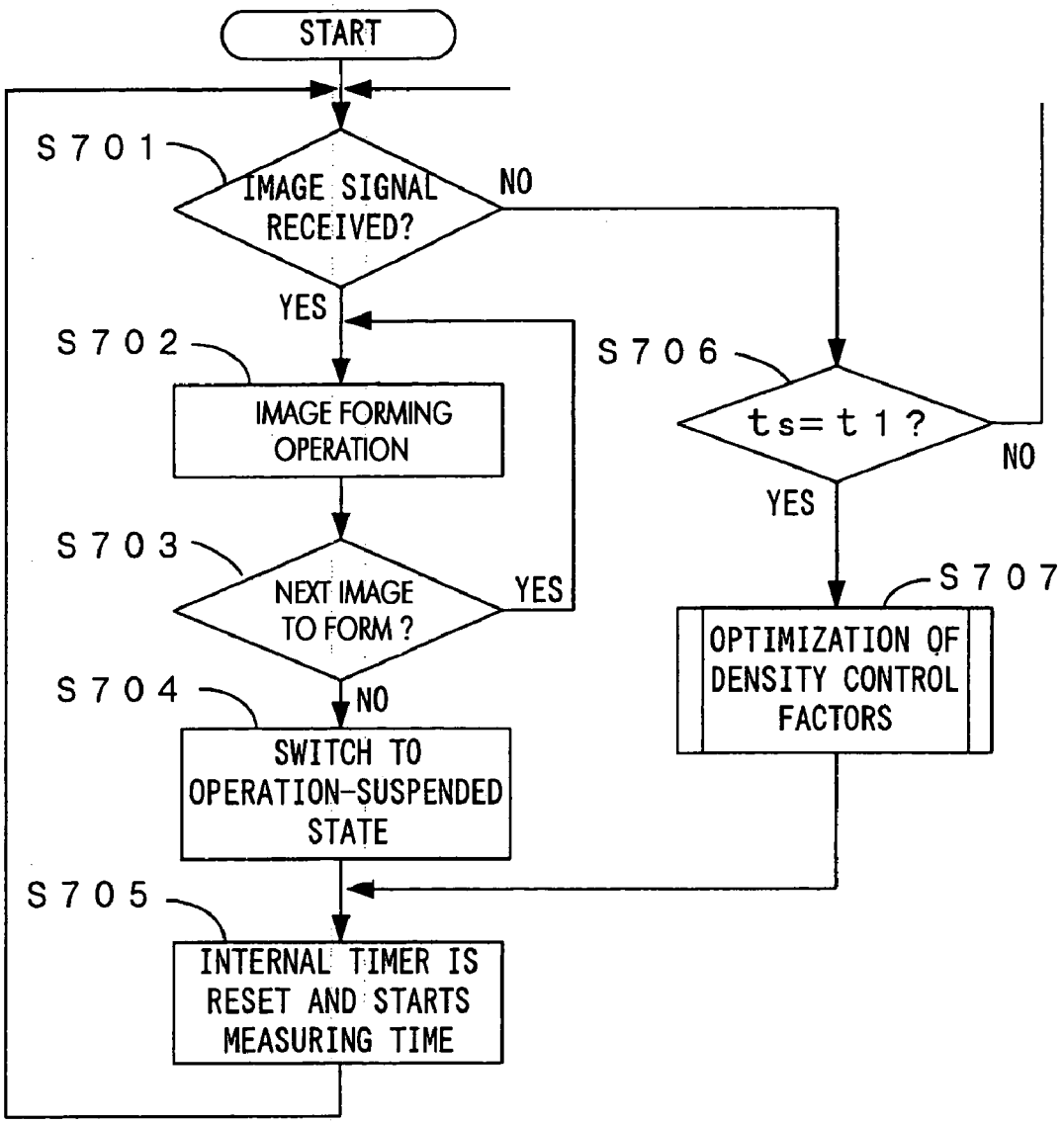
FIG. 23 is a flow chart which shows an image forming operation and an operation-suspended state in a third preferred embodiment.
Figure 24A:
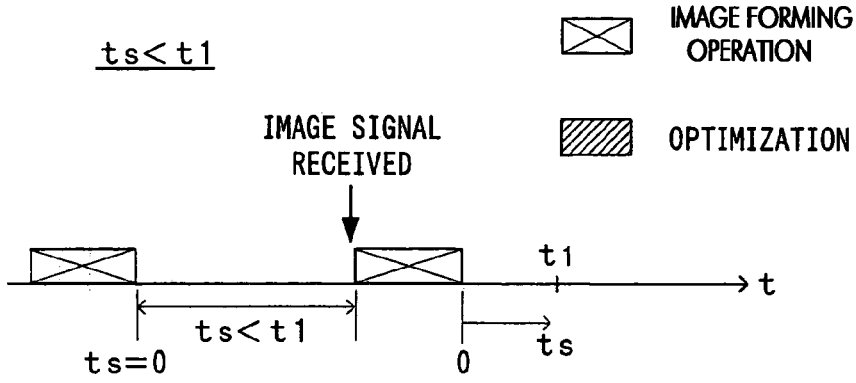
FIGS. 24A and 24B are timing charts which show a difference in operation in the apparatus depending on the length of an operation-suspended time.
Figure 24B:
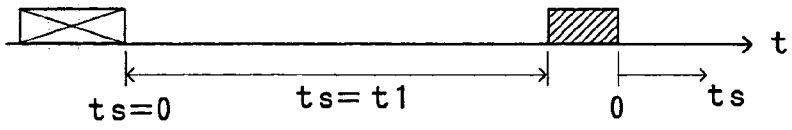

FIG. 23 is a flow chart which shows an image forming operation and an operation-suspended state in a third preferred embodiment. FIGS. 24A and 24B are timing charts which show a difference in operation in the apparatus depending on the length of the operation-suspended time. In this image forming apparatus, whether an image signal has been fed from an external apparatus via the interface 112 is always judged (Step S701), and when there is an image signal fed, the series of image forming operation described earlier is executed, thereby forming an image corresponding to the image signal on the sheet S (Step S702). The image forming operation is repeated when necessary (Step S703), a predetermined number of images are formed. As the series of image forming operation ends, the rotations of the intermediate transfer belt 71 and the like are stopped, application of the developing bias, the charging bias and the like is stopped, and the apparatus enters the operation-suspended state (Step S704). At this stage, i.e., at the time that outputting of the charging bias to the charger unit 3 from the charger controller 103 has been just stopped, the CPU 101 resets an internal timer and starts measuring the time (Step S705), and the apparatus returns to the step S701 again to wait for an image signal. In short, using the internal timer, the CPU 101 measures a period that the apparatus remains in the operation-suspended state, namely, an operation-suspended time ts in this embodiment.

At this stage, when the next image signals is fed immediately, the step S702 through the step S703 above are repeated thereby forming a necessary number of images, and then the internal timer starts measuring the time again (Step S705). On the contrary, when there is no incoming image signal, the apparatus proceeds to a step S706 while the measurement of time continues. When the operation-suspended time ts reaches a predetermined period of time t1 which will be described later, the apparatus proceeds to a step S707 to thereby optimize density control factors described earlier and further to the step S705 to thereby reset the internal timer, and then returns to the step S701. However, when the operation-suspended time ts has not reached the period t1 yet at the step S706, the apparatus directly returns to the step S701.

In this apparatus, when there is no image signal newly fed from an external apparatus in response to a user's request for image formation after the image forming operation, the apparatus switches the operation-suspended state and waits for receipt of the next image signal while the internal timer continues measuring the operation-suspended time ts. As shown in FIG. 24A, in the event that the next image signal is supplied before the operation-suspended time ts reaches the predetermined period t1, the apparatus immediately recovers from the operation-suspended state and executes the image forming operation.

On the other hand, when the operation-suspended time ts has reached the period t1 without the next image signal received as shown in FIG. 24B, the apparatus comes back up from the operation-suspended state and starts executing optimization of density control factors described earlier. The apparatus returns to the operation-suspended state as this process ends. Since the timer is reset also at this time, every time the operation-suspended time ts reaches the predetermined period t1 afterward, optimization of density control factors is executed in a similar fashion. In this embodiment, as the optimization (Step S707), it is applicable the optimization sequence (Steps S3 through S5 in FIG. 5) or the other conventional method.

As described above, as the operation-suspended time ts reaches the predetermined period t1 after the end of the image forming operation in response to an image signal fed from an external apparatus or the operation of formation a patch image, the image forming apparatus of the third preferred embodiment executes optimization of density control factors. Hence, a period that the operation-suspended state continues in this apparatus is about the period t1 at maximum. The period t1 corresponds to a "first predetermined period" of the present invention.

Owing to optimization of density control factors executed at regular intervals to contain the operation-suspended time ts of the apparatus to or shorter than the first predetermined period t1, this image forming apparatus suppresses shutdown-induced banding which arises when toner is left carried by the developer rollers 44 for long. Further, since suppression of shutdown-induced banding prevents a density variation which would otherwise appear in a patch image, it is possible to set density control factors always to optimal conditions based on a density of a patch image, and hence, stably form a toner image having an excellent image quality with this image forming apparatus.

In addition, since density control factors are kept always in optimal conditions even when the apparatus is in the operation-suspended state, it is possible for the apparatus to quickly recover from the operation-suspended state upon receipt of a new image signal from outside, and hence, swiftly handle a user's request.

As described above, since optimization of density control factors is performed for every predetermined period in this embodiment, shutdown-induced banding is unlikely to occur. Hence, idling of the developer rollers 44 is not always necessary for optimization of density control factors. That is, during adjustment of density control factors in such a case, the "pre-operation 2" shown in FIG. 7 may be omitted, which will suppress advancement of fatigue-induced degradation of the developer rollers 44 and extend the lifetime of the apparatus. However, it is preferable that the developer rollers 44 are rotated idle in this case as well, considering an improvement in image quality.

How long the first predetermined period t1 should be set is an issue here. In short, since consumption of toner advances every time a patch image is formed, it is necessary to decrease the frequency of patch image formation as much as possible for the purpose of suppressing a running cost of the apparatus, and therefore, it is preferable that the first predetermined period t1 is long. Meanwhile, it is desirable that the first predetermined period t1 is as short as possible for the purpose of maintaining image qualities, since a long operation-suspended time ts leads to a density variation caused by shutdown-induced banding. It is thus difficult to uniformly determine the first predetermined period t1. Noting this, the first predetermined period t1 may be appropriately set in accordance with the specifications of the apparatus, characteristics of toner, etc.: The first predetermined period t1 may be short, e.g., about one hour, in an apparatus which is equipped with developers which can house a large amount of toner, an apparatus which places more importance on an image quality, etc. But may be longer, e.g., about three hours, in an apparatus which places more importance on the cost effectiveness and therefore tolerates density variations to a certain extent.

Various methods may be used to determine when the image forming operation and optimization of density control factors were started or ended. In line with the objects of the present invention, the only requirement in this context is to determine whether a certain period of time has elapsed since the end of the preceding image forming operation without forming a new image. Hence, measurement of time may start either at the end of any one of the processes unique to the image forming operation or upon execution of any one of the processes which are needed for the apparatus to enter the operation-suspended state. The following is workable, for instance.

Figure 25:
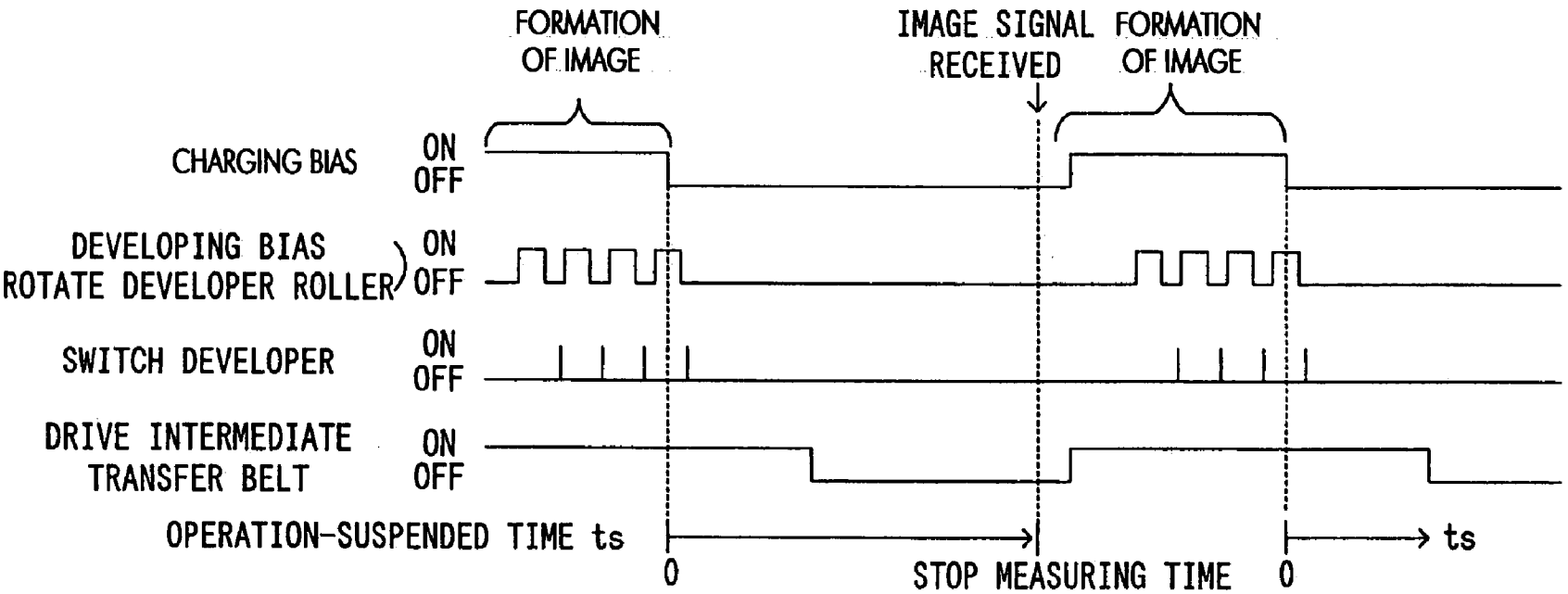
FIG. 25 is a timing chart which shows operations in respective portions in the apparatus upon recovery from the operation-suspended state.

FIG. 25 is a timing chart which shows operations in the respective portions in the apparatus upon recovery from the operation-suspended state. The biases are applied upon the respective portions of the apparatus and discontinued while the respective portions are driven into rotations and deprived of driving as the image forming operation or optimization of density control factors starts and ends. Therefore, it is possible to define the starts and the ends of the image forming operation and optimization by referring to any one of the timing of the turning on and the turning off. For example, as shown in FIG. 25, measuring of the operation-suspended time ts may be started from discontinuation of application of the charging bias upon the charger unit 3 after image formation. Further, for instance, when there is an image signal fed from outside in response to the image formation request, measuring of the operation-suspended time ts may be ended at the time of the receipt of the image signal, or alternatively, measuring of the operation-suspended time ts may be ended at the time that the intermediate transfer belt 71 has started rotating in response to this request.

In this preferred embodiment as well, as in the second preferred embodiment described above, a density sensor may be disposed facing the surface of the photosensitive member 2 and detect a density of a toner image which has been developed on the photosensitive member 2 as a patch image. This remains similar in each preferred embodiment described below, too.

Fourth Preferred Embodiment

The fourth preferred embodiment of the image forming apparatus according to the present invention is a further development of the third preferred embodiment described above. While the fourth preferred embodiment is similar to the third preferred embodiment in that optimization of density control factors is executed when the operation-suspended state has exceeded the first predetermined period t1, the fourth preferred embodiment requires to additionally execute the following operation. In short, when the operation-suspended time ts is shorter than the first predetermined period t1 described above but is the same or longer than a second predetermined period t2 which is shorter than the first predetermined period t1, upon receipt of an image signal in response to a user's image formation request, optimization of density control factors is carried out first, and the image forming operation is then executed based on the image formation request.

Figure 26:
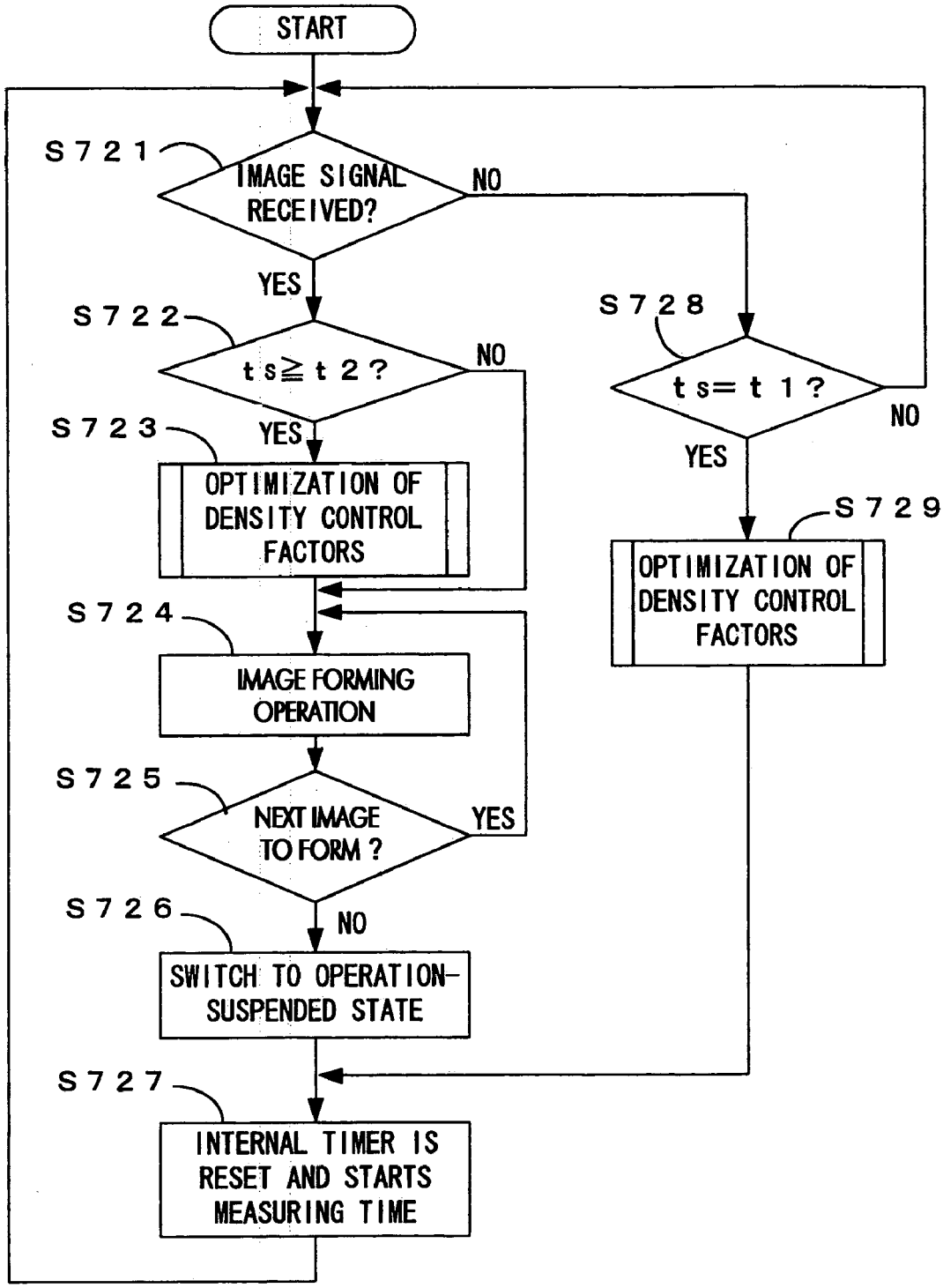
FIG. 26 is a flow chart which shows an image forming operation and an operation-suspended state in a fourth preferred embodiment of the image forming apparatus according to the present invention.
Figures 27A, 27B, 27C:
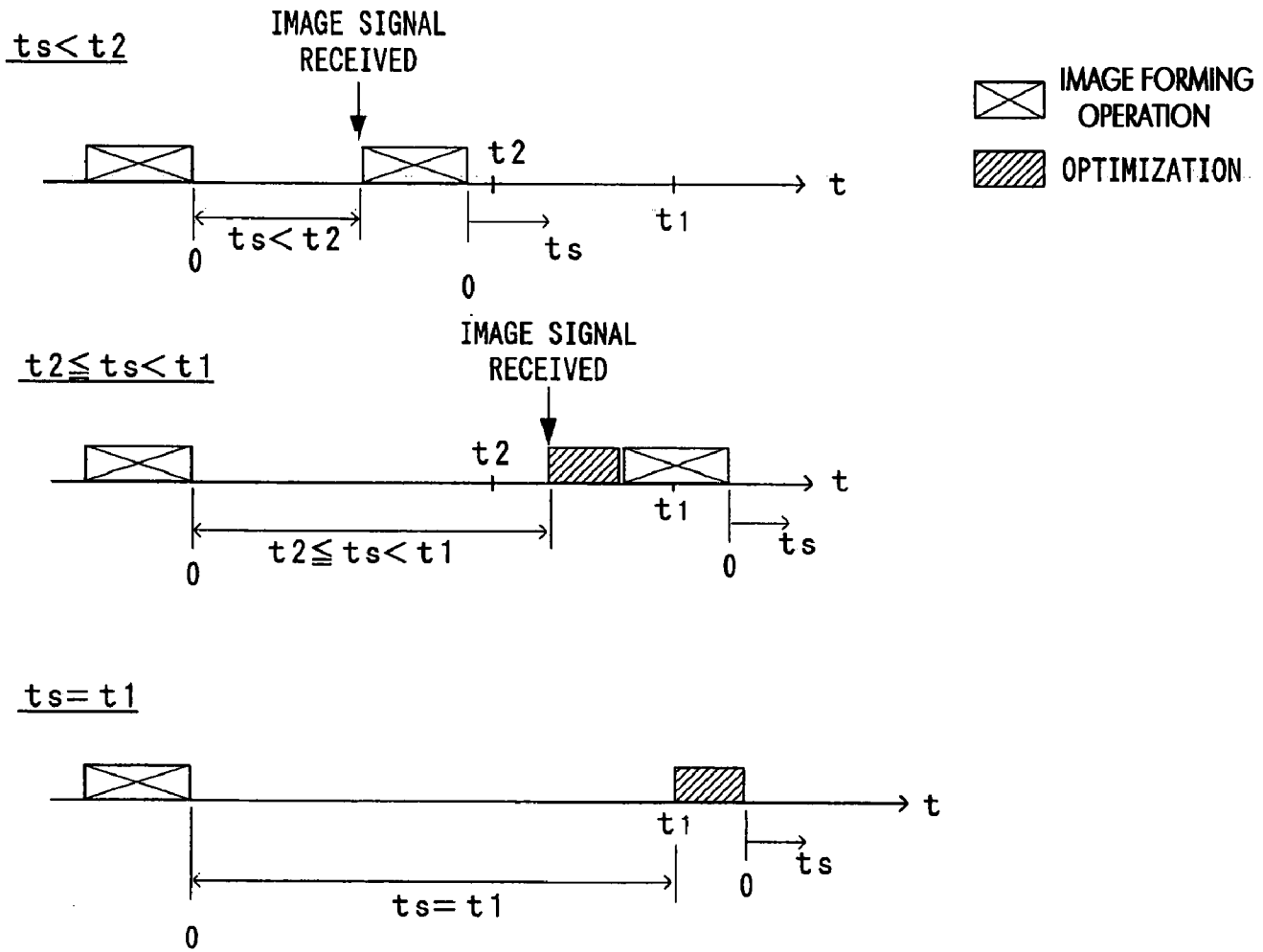
FIGS. 27A, 27B and 27C are timing charts which show a difference in operation in the apparatus depending on the length of an operation-suspended time.

FIG. 26 is a flow chart which shows the image forming operation and the operation-suspended state in the fourth preferred embodiment of the image forming apparatus according to the present invention. FIGS. 27A, 27B and 27C are timing charts which show a difference in operation in the apparatus depending on the length of the operation-suspended time.

In the fourth preferred embodiment, too, as shown in FIG. 26, whether there is an image signal fed from an external apparatus via the interface 112 in response to a user's image formation request is determined (Step S721). There is another similarity to the third preferred embodiment that optimization of density control factors is executed as the operation-suspended time ts reaches the predetermined period t1 without any image signal inputted.

When there is an image signal fed, an image corresponding to the image signal is formed on the sheet S through execution of the series of image forming operation described earlier (Step S704). The fourth preferred embodiment however requires that the operation-suspended time ts is compared with the second predetermined period t2 prior to the image forming operation (Step S722), a step S723 is skipped to immediately proceed to formation of an image when the operation-suspended time ts is shorter than the second predetermined period t2, but optimization of density control factors as that described above is executed when the operation-suspended time ts is the same as or beyond the second predetermined period t2 (Step S723), and an image corresponding to the image signal is thereafter formed (Step S724).

Further, the image forming operation is repeated when necessary (Step S725), a predetermined number of images are formed. As the series of image forming operation ends, the rotations of the intermediate transfer belt 71 and the like is stopped, application of the developing bias, the charging bias and the like is terminated, and the apparatus enters the operation-suspended state (Step S726). In this manner, the CPU 101 resets the internal timer at the time that the image forming operation has been just stopped, e.g., at the end of applying of the charging bias to the charger unit 3, and starts measuring time (Step S727), and the apparatus returns to the step S721 again to wait for an image signal.

In short, this apparatus switches to the operation-suspended state and waits for a new image signal in the event that a new image formation request has not been received after the image forming operation. At this stage, the internal timer is still continuously measuring the operation-suspended time ts. The operation of the apparatus follows the following three courses depending on at what timing a new image signal is received.

$$ts<t2 \text{ (FIG. 27A)} \quad (1)$$

This is a situation that a new image signal is received before the operation-suspended time ts reaches the second predetermined period t2. Since the step S723 shown in FIG. 26 is skipped in this situation, as shown in FIG. 27A, the image forming operation is executed immediately in accordance with the image signal. After the end of the image forming operation, the internal timer is reset and starts measuring the operation-suspended time ts from zero.

In this manner, since it is considered that there is not a large change 92. in image density in the event that a long time has not yet elapsed since the previous image formation, the image forming operation is executed immediately in accordance with the received image signal, thereby quickly forming an image having a predetermined image quality.

$$t2 \leqq ts<\mu t1 \text{ (FIG. 27B)} \quad (2)$$

When a new image signal is received after the operation-suspended time ts has reached the second predetermined period t2 but before the operation-suspended time ts reaches the first predetermined period t1, the step S723 shown in FIG. 26 is executed. Hence, as shown in FIG. 27B, after inputting of the image signal, optimization of density control factors is carried out first, and an image corresponding to the image signal is thereafter formed. During the optimization at this stage, since the optimization is to be followed by the image forming operation, it is not always necessary for the apparatus to switch to the operation-suspended state during the post-process (Step S6 shown in FIG. 5).

In this manner, when the operation-suspended time ts reaches or exceeds the second predetermined period t2, optimization of density control factors is executed prior to formation of an image. Hence, even when a long period of time has elapsed since the previous image formation, it is possible to form an image having a predetermined image quality.

$$ts=\mu t1 \text{ (FIG. 27C)} \quad (3)$$

This is a situation that the operation-suspended time ts has reached the first predetermined period t1 without a new image signal inputted. As this occurs, optimization of density control factors is executed at the step S729 shown in FIG. 26, as in the third preferred embodiment. This means that the optimization of the density control factors is executed at the time that the operation-suspended time ts reaches t1 as shown in FIG. 27C. Since it is not necessary to further form an image at this stage, it is preferable that the apparatus switches to the operation-suspended state during the subsequent processing. The internal timer is reset in this situation, too, and therefore, if the time t1 elapses again without an image signal fed, optimization of density control factors is executed in a similar manner.

As described above, in this preferred embodiment, a toner image is formed as a patch image by means of execution of optimization of density control factors for every certain period of time even if there is no image signal fed. Since this prevents the operation-suspended time ts from exceeding the first predetermined period t1, a density variation attributed to shutdown-induced banding is effectively suppressed.

When a new image signal is received before the period t2 elapses after the density control factors were thus optimized, an image corresponding to the image signal is immediately formed.

The periods t1 and t2 correspond respectively to a "first predetermined period" and a "second predetermined period" of the present invention in this preferred embodiment as described above. How long the first and the second predetermined periods t1 and t2 should be set is an issue in this preferred embodiment, too. The periods may be determined in the following manner, for instance. A correlation between the operation-suspended time ts and the extent of a density variation attributed to shutdown-induced banding may be set such that the second predetermined period t2 is such a maximum value of the operation-suspended time ts with which a density variation within an image to be looked at by a user will remain tolerable and that the first suspend time t1 is such a maximum value of the operation-suspended time ts with which a density variation appearing in a patch image will not hold up optimization of density control factors.

Since it is possible to suppress advancement of shutdown-induced banding by means of formation of a patch image for every certain period of time also in this preferred embodiment, idling of the developer rollers 44 is not always indispensable. In short, during the pre-operation (FIG. 7) in the preferred embodiments above, the pre-operation 1 alone may be executed without rotating the developer rollers 44 idle (pre-operation 2). As described earlier, although characteristics of toner slightly change as the developer rollers 44 rotate, it is possible to minimize the change in characteristic by not performing the pre-operation 2.

Whether to execute the pre-operation 2 may be determined in accordance with the level of an image quality which the apparatus needs promise. In short, the pre-operation 2 may be executed when an application demands a high image quality to thereby optimize density control factors at an even higher accuracy but may not be executed when an application views the cost effectiveness, in terms of running cost of toner for instance, more important.

Figure 28:
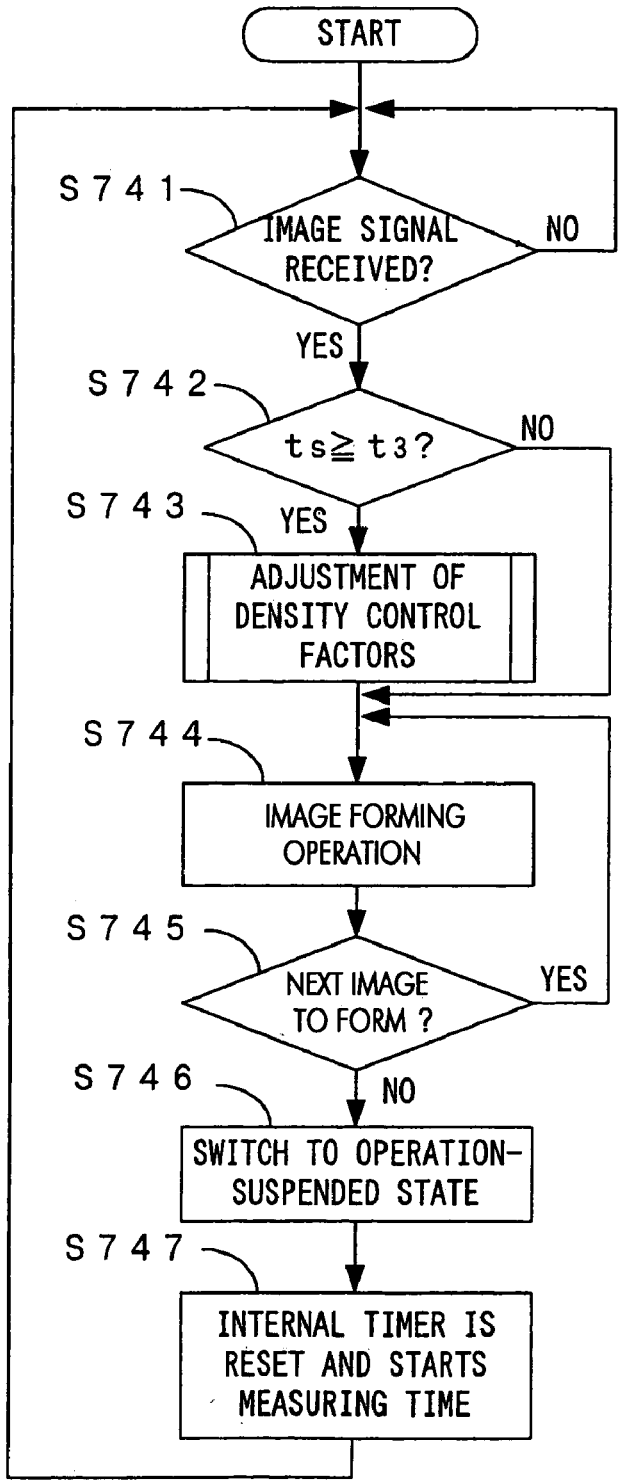
FIG. 28 is a flow chart which shows a modified example of an image forming operation and an operation-suspended state in the fourth preferred embodiment.

Alternatively, this process (FIG. 26) may be modified as shown in FIG. 28 and executed. FIG. 28 is a flow chart which shows a modified example of the image forming operation and the operation-suspended state in this preferred embodiment. In the modified example, the apparatus returns to a step S741 in the absence of an image signal at the same step S741. Hence, the operation-suspended state stays until inputting of an image signal. Further, at a step S742, the process is modified, as the operation-suspended time ts is compared with a third predetermined period t3.

That is, in the event that an image signal is fed when the operation-suspended time ts is less than t3, a toner image is formed immediately in accordance with the image signal (Step S744). On the other hand, in the event that an image signal is fed when the operation-suspended time ts exceeds t3, a toner image is formed in accordance with the image signal (Step S744) after executing optimization of density control factors (Step S743).

The process is otherwise the same as the process shown in FIG. 26. But in this case, the adjustment operation (Step S743) includes idling of the developer rollers (pre-operation 2 shown in FIG. 7) as the adjustment operation of the first preferred embodiment.

The ground for requiring this is as follows. That is, first, the developer rollers 44 are rotated idle (the pre-operation 2) prior to formation of an image corresponding to an image signal, and the operation of forming a patch image is thereafter executed, whereby density variations attributed to shutdown-induced banding are suppressed in this embodiment. These two operations each individually achieve the effect of reducing shutdown-induced banding, and therefore, execution of these two one after another makes the effect stronger.

In this manner, it is possible to effectively suppress shutdown-induced banding by continuously performing the two operations. Therefore, it may be sometimes permissible to omit the operation of "optimizing density control factors every predetermined period" which is demanded in the third or the fourth preferred embodiment described above, as in a situation that shutdown-induced banding is not so evident. An example is a situation that in an image forming apparatus wherein an average continuous operating time is about eight hours, a density variation attributed to shutdown-induced banding could be tolerated if an operation-suspended time in a day is about half the average continuous operating time, that is, about four hours.

In such an apparatus, in the event that an image signal is fed when the operation-suspended time ts is less than four hours, a toner image is formed immediately in accordance with the image signal. On the other hand, in the event that an image signal is fed when the operation-suspended time ts is four hours or longer, a toner image is formed after executing optimization of density control factors accompanying idling of the developer rollers 44. In this manner, it is possible to stably form a toner image having an excellent image quality while suppressing density variations attributed to shutdown-induced banding. Such a situation corresponds to an example that the "third predetermined period" is four hours in the present invention.

Figure 29A:
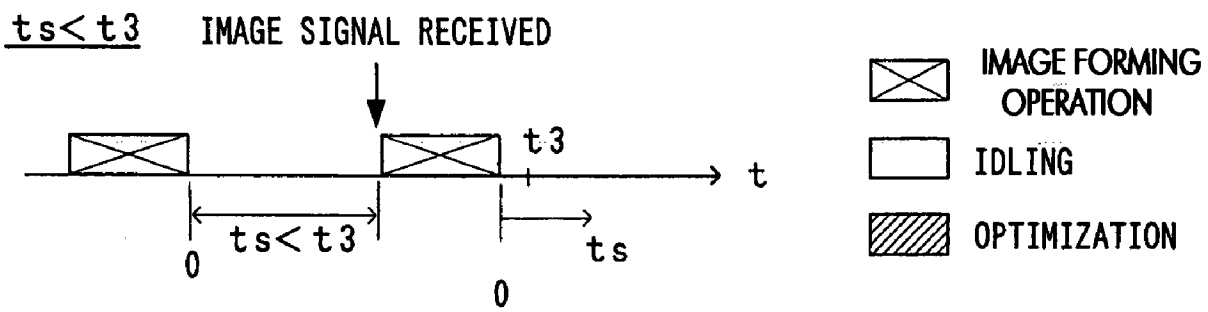
FIGS. 29A and 29B are timing charts which show a difference in operation in the apparatus depending on the length of an operation-suspended time.
Figure 29B:
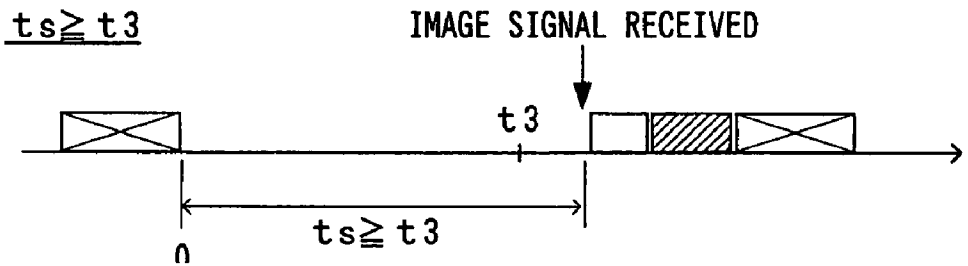

FIGS. 29A and 29B are timing charts which show a difference in operation in the apparatus depending on the length of an operation-suspended time. In the operation shown in FIG. 28 is executed, in the event that an image signal is fed when the operation-suspended time ts is less than t3, as shown in FIG. 29A, a toner image is formed immediately in accordance with the image signal.

On the contrary, as shown in FIG. 29B, in the event that an image signal is fed when the operation-suspended time ts exceeds t3, optimization of density control factors accompanying idling of the developer rollers is executed and then a toner image is formed. Thus, if it is necessary to form an image after long lasting operation-suspended state, prior to formation of an image, execution of idling and optimization can reduce the density variation caused by the shutdown-induced banding.

As described above, in this image forming apparatus, toner images of a certain nature are formed for every constant period of time t1 by formation of a image in accordance with an image signal fed from an external apparatus or formation of a patch image during optimization of density control factors. Hence, the operation-suspended state will not continue beyond the period t1 when the power source of the apparatus is ON, thereby effectively suppressing density variations which would appear in an image because of shutdown-induced banding. Further, even before the operation-suspended time ts reaches the time t1, in the event that an image signal is fed after the relatively long period t2 or a longer time, optimization of density control factors is executed prior to image formation. In such a case, too, it is therefore possible to form a toner image having an excellent image quality.

Idling of the developer rollers 44 prior to formation of a patch image for the purpose of optimization of density control factors makes it possible to form a patch image with even toner and to accurately calculate optimal values of the average developing bias Vavg and the exposure energy E based on a density of the patch image. As an image is formed under thus optimized conditions, it is possible to stably form a toner image having an excellent image quality with this image forming apparatus.

Further, another method can form a toner image having an excellent image quality same as the execution of the optimization periodically. That is, prior to execution of the image forming operation after long lasting operation-suspended state exceeding t3, it is preferable to execute the optimization operation accompanying with idling of the developer rollers.

Modified Example of First through Fourth Preferred Embodiments

The present invention is not limited to the preferred embodiments above, but may be modified in various manners in addition to the preferred embodiments above, to the extent not deviating from the object of the invention. For instance, the following modified example may be implemented in each one of the preferred embodiments described above.

For example, while the density sensor 60 is formed by a reflection-type photosensor which irradiates light toward the surface of the intermediate transfer belt 71 and detects the amount of reflection light from the surface of the intermediate transfer belt 71 in each one of the preferred embodiments described above, instead of this, the light emitter element and the light receiver element of the density sensor for instance may be disposed facing each other across the intermediate transfer belt and may detect the amount of light which is transmitted by the intermediate transfer belt.

In addition, each one of the preferred embodiments described above uses a solid image as a high-density patch image but uses, as a low-density patch image, an image formed by a plurality of 1-dot lines including one ON line and ten OFF lines for instance. However, a pattern of each patch image is not limited to this. A halftone image or the like having a different pattern may be used instead.

Further, in the first preferred embodiments described above, for optimization of density control factors, after the respective developer rollers 44 are rotated idle while positioning the developers at the developing position one after another, patch images are formed one after another while switching the respective developers. Instead of this, idling the developer roller and patch image formation may be performed continuously for each developer. Since this reduces the number of times that the developers are switched, in an apparatus which must realize quietness in the standby state, it is possible to minimize the frequency of occurrence of operating sounds which develop as the developers switch with each other.

The sequence of optimization of density control factors in each one of the preferred embodiments described above is merely one example and may be other sequence. For example, although the preferred embodiments described above require to execute the image forming operation and optimization of density control factors in the order of yellow, cyan, magenta and black, the order may be different from this.

Further, although the respective preferred embodiments described above require to store each piece of sample data obtained as a foundation profile of the intermediate transfer belt 71 by sampling an output from the density sensor 60 over one round of the intermediate transfer belt 71, positions at which patch images will later be formed, namely, sample data only from patch image areas may be stored instead, in which case it is possible to reduce the volume of data to be stored. In this case, when the positions on the intermediate transfer belt 71 at which patch images will later be formed are matched with each other as much as possible, calculations may be conducted using a common foundation profile to the respective patch images, which is further effective.

In addition, although the developing bias and the exposure energy serving as density control factors for controlling an image density are variable in the respective preferred embodiments described above, only one of these two may be changed for control of an image density, or other density control factor may be used. Further, although the charging bias changes in accordance with the average developing bias in the respective preferred embodiments described above, this is not limiting. Instead, the charging bias may be fixed or changed independently of the average developing bias.

Fifth Preferred Embodiment

In the respective preferred embodiments described so far, image forming conditions are optimized even in the absence of the image formation request, toner images are formed as patch images at regular intervals, and shutdown-induced banding is therefore prevented from affecting an image quality. In contrast, in a fifth and a sixth preferred embodiments described below, the developer rollers 44 are rotated idle at regular intervals, for the purpose of eliminating shutdown-induced banding.

Figure 30:
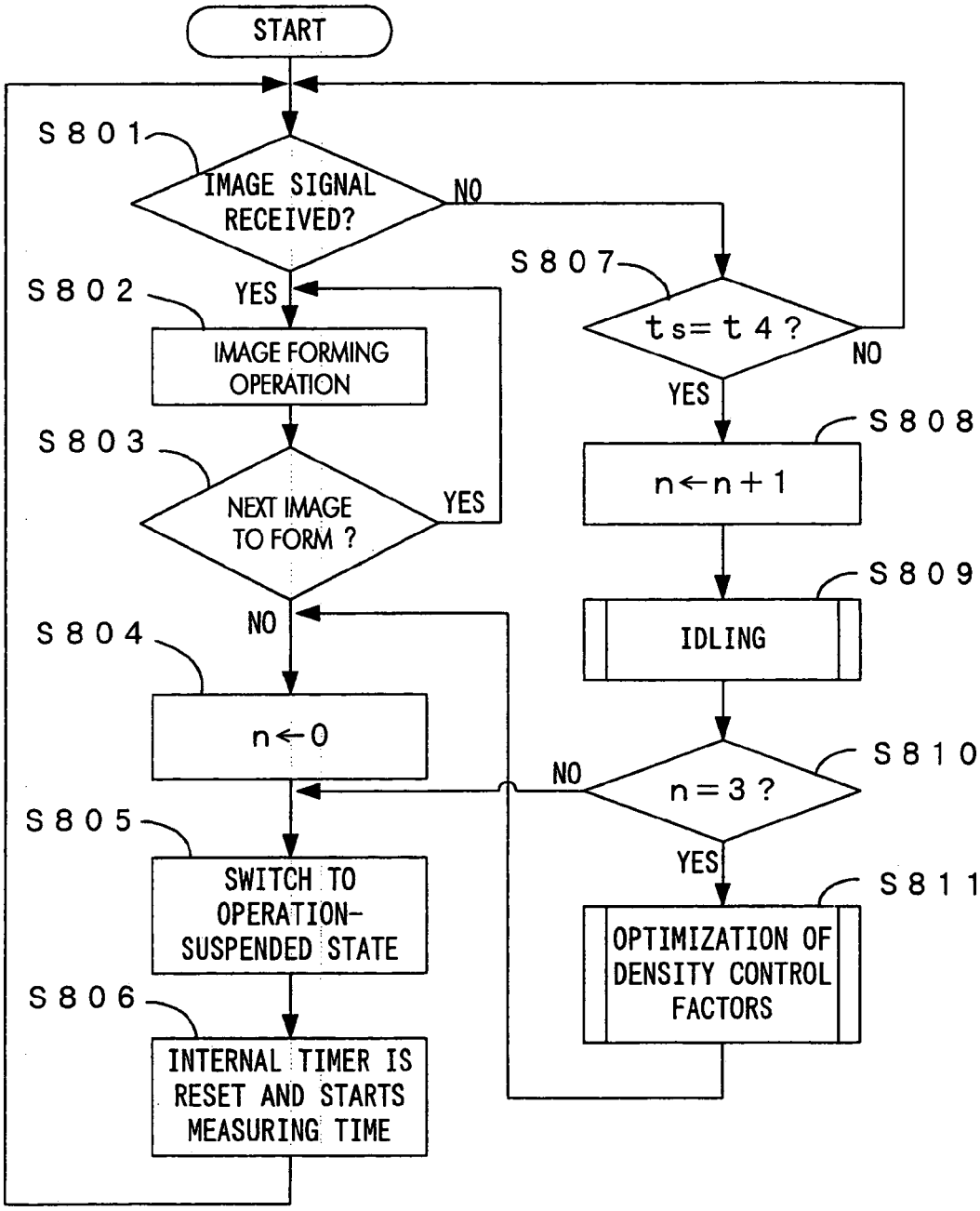
FIG. 30 is a flow chart which shows a main process in a fifth preferred embodiment.

FIG. 30 is a flow chart which shows a main process in the fifth preferred embodiment. In the engine controller 10 according to the fifth preferred embodiment, the CPU 101 judges whether an image signal has been fed from the CPU 111 of the main controller 11 (Step S801). The apparatus proceeds to a flow described below when the CPU 101 determines that an image signal has been inputted, thereby executing the image forming operation-described earlier and forming an image which is equivalent to one sheet (Step S802). Whether there is an image to be formed next is determined (Step S803), and when there is such an image to be formed next, the apparatus returns to the step S802 and the image forming operation is repeated for a necessary number of sheets. As the image forming operation ends in this manner, as described later, a count n of an electronic counter disposed inside the CPU 101 is reset to zero (Step S804), and the apparatus switches to the operation-suspended state (Step S806).

In this preferred embodiment, too, the internal timer of the CPU 101 measures a period of time that the engine EG stays in the operation-suspended state, namely, the operation-suspended time ts. The internal timer is reset as the engine EG enters the operation-suspended state as described above, and the internal timer starts measuring the operation-suspended time ts from the beginning again (Step S806). While this example requires to start measuring the operation-suspended time ts from termination of application of the charging bias fed to the charger unit 3 by the charger controller 103, the operation-suspended time ts may be measured at other timing than this.

As the series of image forming operation ends and the apparatus enters the operation-suspended state in this fashion, the apparatus returns back to the step S801 again and enters "standby" state waiting for a new image signal. This standby state includes the operation-suspended and the idling state described below.

When it is determined at the step S801 that there is no image signal fed, the CPU 101 executes a process which is along the right-hand side flow. That is, after the apparatus entered the operation-suspended state, whether the operation-suspended time ts which is being measured by the internal timer has reached a fourth predetermined period t4 is determined (Step S807). In the event that the internal timer has not reached the fourth predetermined period t4 yet, the apparatus returns to the step S801 once again and waits for a new image signal. On the contrary, when the internal timer has reached the fourth predetermined period t4, the count n of the electronic counter increments (Step S808) and the developer rollers 44 are rotated idle to eliminate shutdown-induced banding (Step S809).

Figure 31:
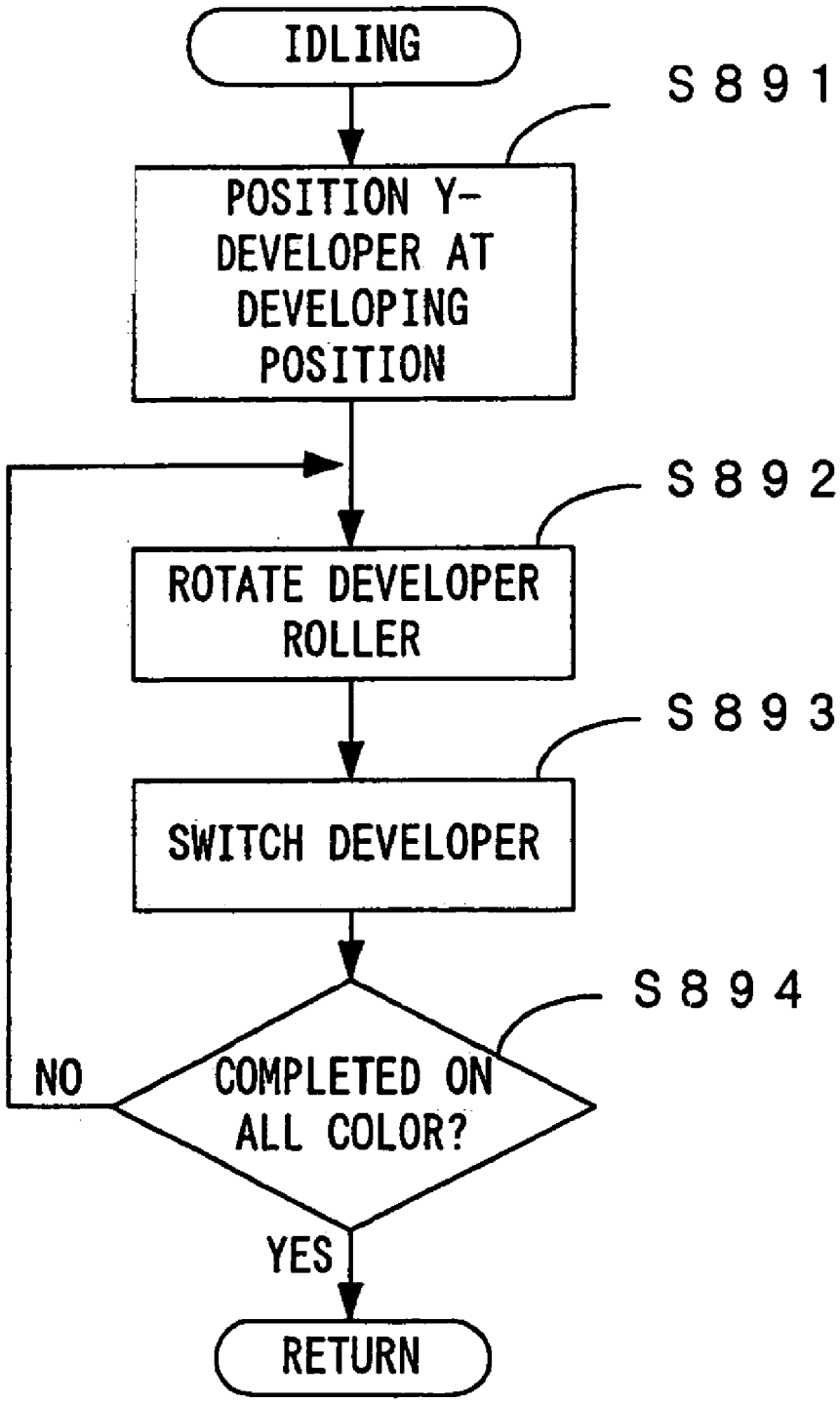
FIG. 31 is a flow chart which shows idling operation of a developer roller in the fifth preferred embodiment.

FIG. 31 is a flow chart which shows idling operation of the developer rollers in this preferred embodiment. During idling operation, first, the yellow developer 4Y is positioned at the developing position (Step S891), and the developer roller 44 of the yellow developer 4Y rotates one round or more after engaged with the rotation driver which is disposed to the main section (Step 892). Following this, the rotary developer unit 4 is rotated thereby switching the developer (Step S893). The developer rollers 44 are rotated one round or more for the other developers 4C, 4M and 4K in a similar manner. As idling ends on all toner colors (Step S894), the apparatus returns back to the main process.

The operation in the main process will now be continued with reference to FIG. 30 again. The electronic counter which increments at the step S808 is for counting the number of times that idling operation has been performed. When it is determined at the step S810 that the count n of the electronic counter has reached a predetermined value (which is 3 in this example), i.e., that idling was performed three times in a row, optimization of density control factors which influence an image density is executed after the idling (Step S811). After the optimization or after the image forming operation described earlier, the count n is reset to zero (Step S804). On the other hand, when the count n is a value other than 3 at the step S810, the electronic counter is not reset after the end of the idling, and the apparatus returns to the operation-suspended state again while holding the count n as it is (Step S805).

Figures 32A, 32B, 32C:
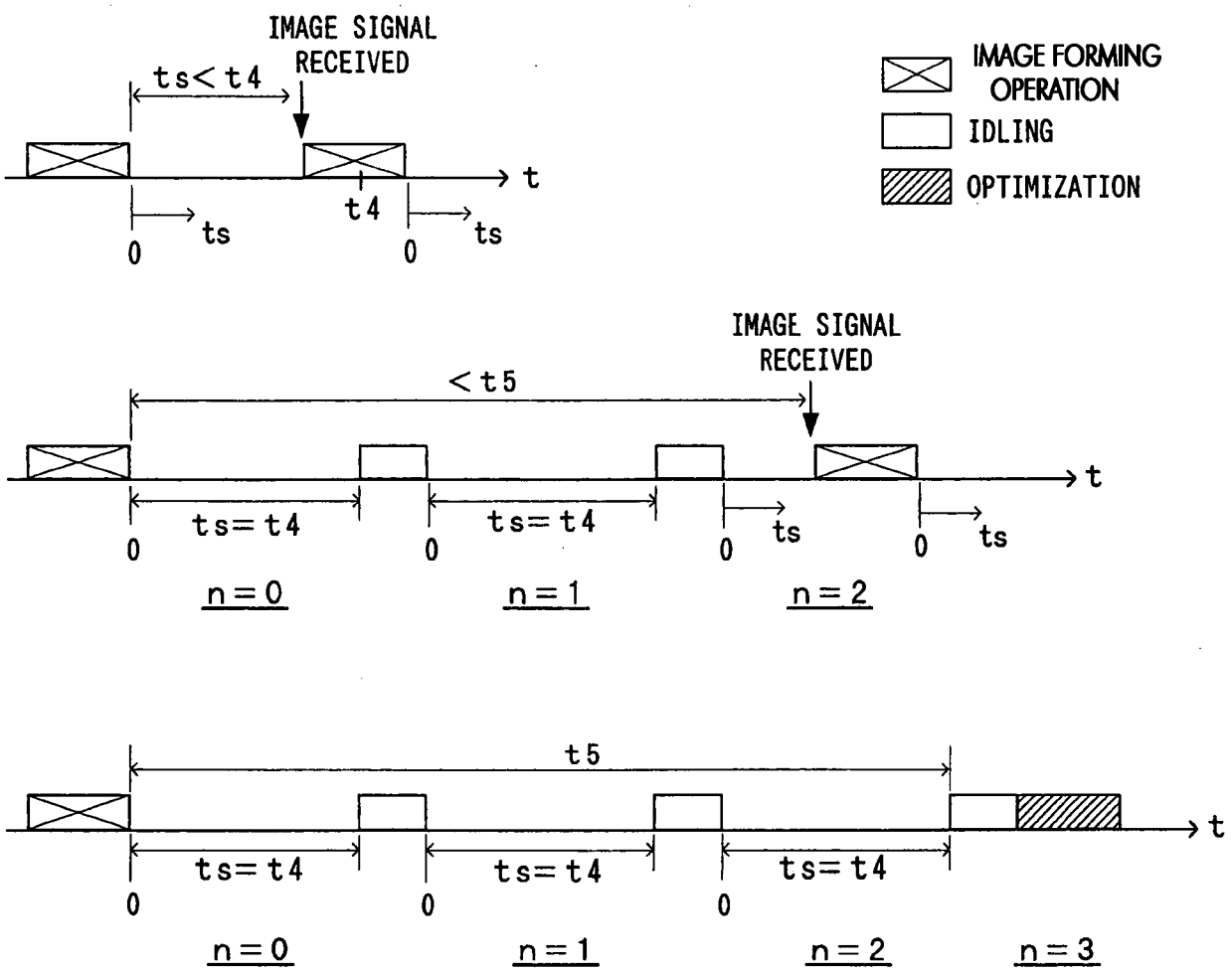
FIGS. 32A, 32B and 32C are timing charts which show an operation during the main process in the fifth preferred embodiment.

Since the main process shown in FIG. 30 is executed while measuring the operation-suspended time ts and counting the number of times that idling has been performed, the operation in this preferred embodiment becomes different depending on a period of time from the end of the preceding image forming operation until receipt of the next image signal. FIGS. 32A, 32B and 32C are timing charts which show a difference in operation depending on the timing of inputting of an image signal during the main process in this preferred embodiment. In the event that the next image signal is newly fed before the operation-suspended time ts reaches the predetermined period t4 since the apparatus entered the operation-suspended state, as shown in FIG. 32A, the image forming operation is executed immediately and a toner image corresponding to the image signal is accordingly formed.

Meanwhile, in the event that the operation-suspended time ts has reached the period t4 although a new image signal has not been fed after the end of the preceding image forming operation, as shown in FIG. 32B, the apparatus escapes the operation-suspended state and performs idling. The apparatus then returns to the operation-suspended state again as the idling ends, and measuring of the operation-suspended time ts is started from the beginning. As the operation-suspended time ts reaches the period t4 again, idling is performed again. On the contrary, when a new image signal is received before the operation-suspended time ts reaches the period t4, the image forming operation is executed immediately.

In this manner, according to this preferred embodiment, the developer rollers 44 are rotated idle for every certain time (t4) also when a long period of time has elapsed without receiving an image signal, and the count n of the electronic counter increments every time the idling is repeated. Upon the third idling (n=3), optimization of density control factors is performed following the idling as shown in FIG. 31C. In short, optimization of density control factors is executed as a period t5 elapses although the image formation request has not been received since the end of the preceding image forming operation. The period of time t5 is about 3 times as long as the period t4.

Assuming that the period t4 is four hours for instance, since idling takes about a few seconds per round, the period t5 is about twelve hours. As described earlier, an image density changes in accordance with a change in surrounding environment such as a temperature and humidity, and hence, in order to stably obtain images always at a constant density, it is desirable to optimize density control factors as frequently as possible. However, too frequent execution of optimization of density control factors based on patch image densities increases the consumption of toner which is used during formation of patch images. This increases the frequency of supplying of toner (or exchange of the developer) particularly in a small-size image forming apparatus in which only small amounts of toner can be housed in the developers, which in turn lowers the convenience of the apparatus and pushes up a running cost of the apparatus.

Noting this, in this preferred embodiment, idling of the developer rollers alone is executed during such cycles in which a change in surrounding environment is considered to be relatively small, whereby shutdown-induced banding is prevented. Meanwhile, optimization of density control factors is executed after a longer period of time has elapsed and a larger change has occurred in surrounding environment, whereby the consumption of toner is suppressed to minimum while stabilizing an image quality. Further, it is possible to form a patch image which does not contain a density variation attributed to shutdown-induced banding since the developer rollers are rotated idle prior to optimization of density control factors, and therefore, it is possible to accurately optimize density control factors based on a density of thus formed patch image.

In this manner, in this preferred embodiment, the cycle t4 for rotating the developer rollers 44 idle corresponds to a "fourth predetermined period" of the present invention. And the period t5, which lasts before idling of the developer rollers 44 accompanying optimization of density control factors since the image forming operation ended, corresponds to a "fifth predetermined period" of the present invention.

As described above, although the image forming apparatus according to this preferred embodiment enters the standby state for waiting for a new image signal after the end of the previous image formation, the image forming apparatus is not necessarily in a complete operation-suspended state while remaining on standby. Rather, the image forming apparatus temporarily escapes the operation-suspended state every time the certain period t4 elapses and rotates the developer rollers 44 idle. This effectively suppresses shutdown-induced banding which will otherwise arise when the apparatus is left unused for long, and permits to stably form a toner image having an excellent image quality.

Since optimization of density control factors is executed as the period from the end of the image formation reaches the period t5 which is longer than the period t4 described above, even when the apparatus is left unused over a long period of time, it is possible to minimize a change in image density. In addition, since the developer rollers are rotated idle prior to the optimization, a density of a patch image is not affected by shutdown-induced banding, and therefore, it is possible to more accurately optimize the density control factors.

With this image forming apparatus, it is thus possible to effectively suppress a change in image density caused by shutdown-induced banding, a change in surrounding environment and the like while suppressing the consumption of toner by forming patch images less frequently, and to stably form a toner image having an excellent image quality.

Sixth Preferred Embodiment

A sixth preferred embodiment of the image forming apparatus according to the present invention will now be described. The main process in the sixth preferred embodiment is different in terms of content from that in the fifth preferred embodiment, and therefore, the apparatus of the sixth preferred embodiment behaves differently during the standby state from the fifth preferred embodiment. The operation during the main process will be therefore mainly described.

The fifth preferred embodiment of the image forming apparatus requires to rotate the developer rollers 44 idle for every certain period even in the absence of an image signal, for prevention of shutdown-induced banding (FIGS. 32A, 32B and 32C). In contrast, in the sixth preferred embodiment, the apparatus remains in the operation-suspended state while there is no image signal inputted, but when fed with a new image signal, performs pre-processing which is necessary based on how long the operation-suspended time has continued so far, such as idling of the developer rollers 44 and optimization of density control factors, before executing the image forming operation in accordance with the received image signal.

Figure 33:
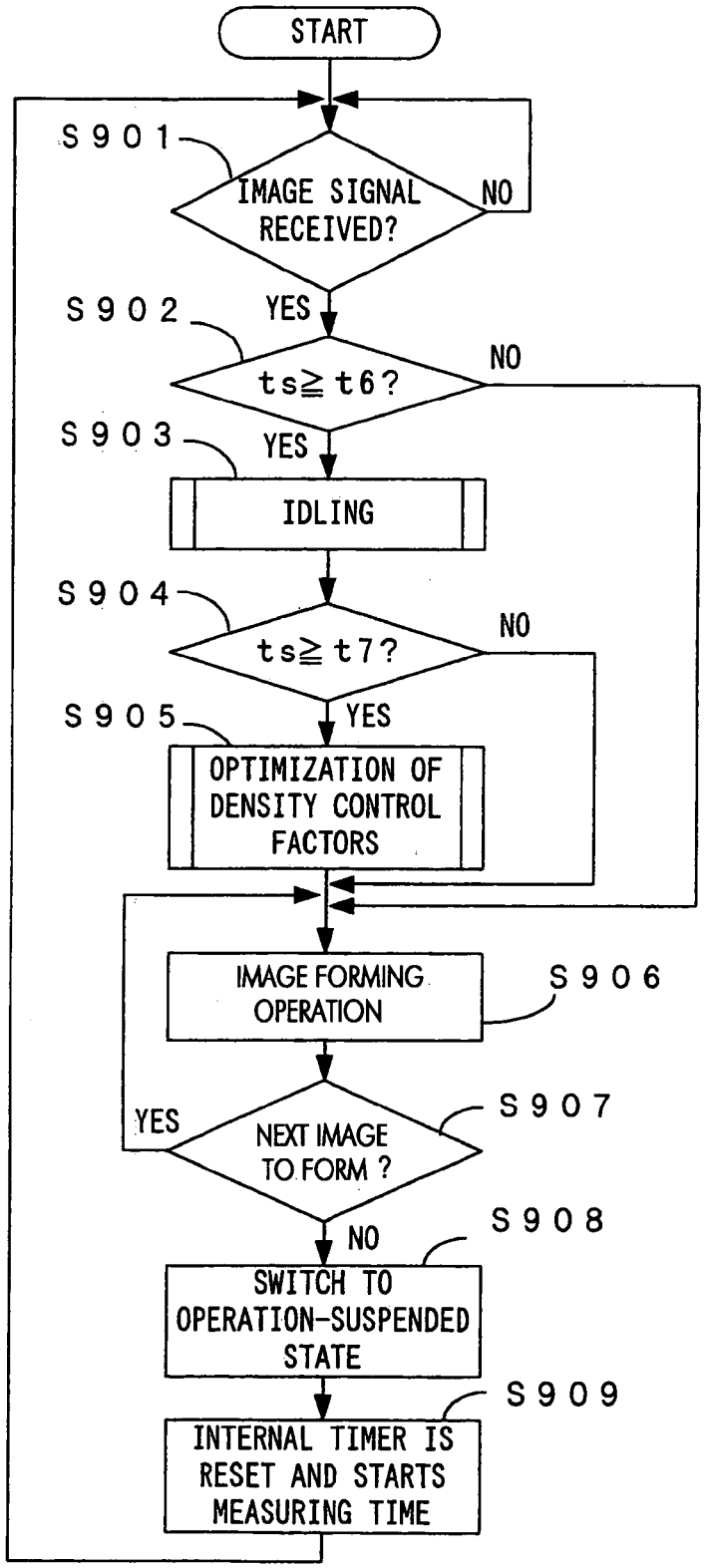
FIG. 33 is a flow chart which shows a main process in a sixth preferred embodiment of the image forming apparatus according to the present invention.
Figures 34A, 34B, 34C:
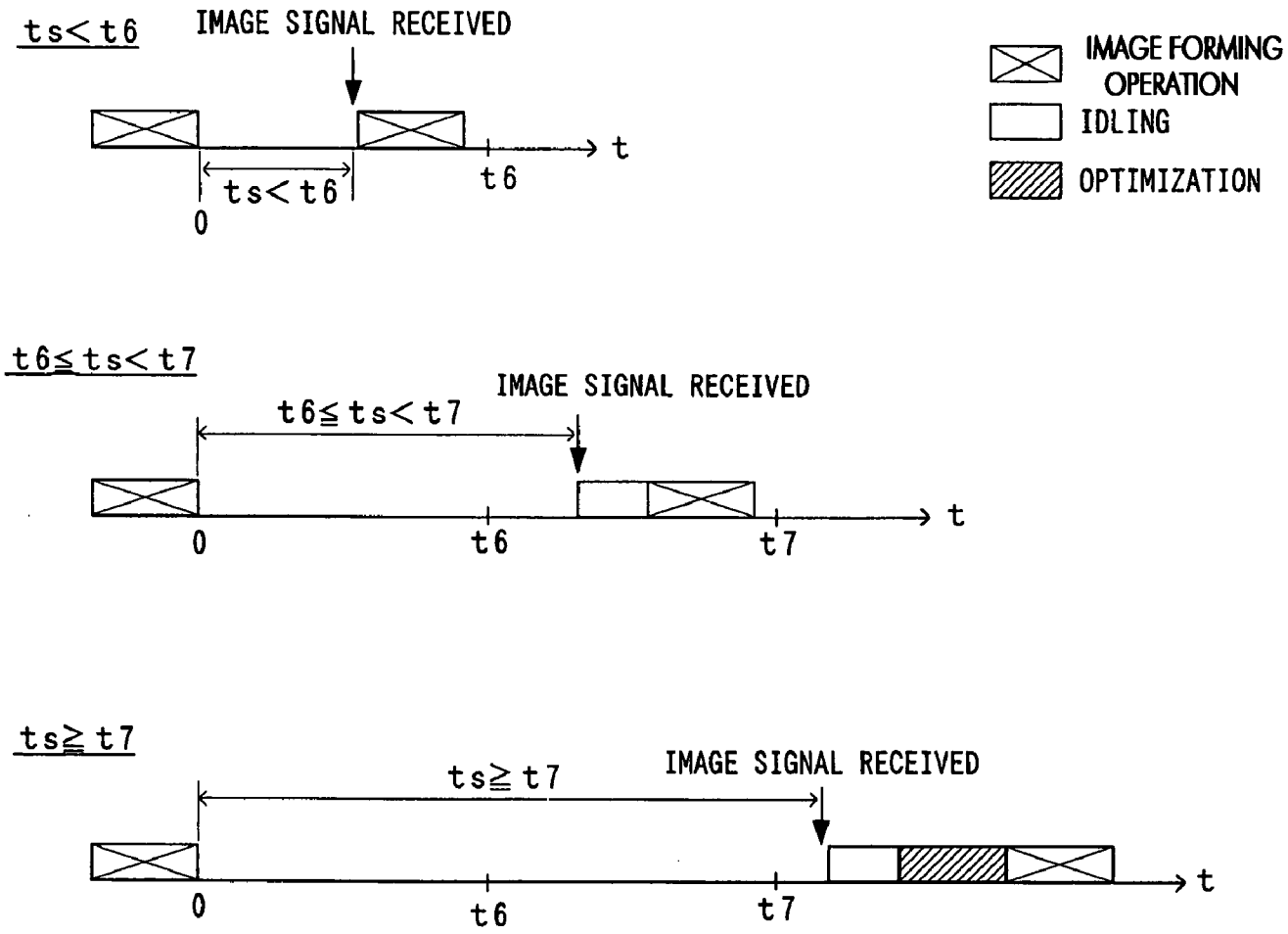
FIGS. 34A, 34B and 34C are timing charts which show a difference in operation depending on the timing of receipt of an image signal during the main process in the sixth preferred embodiment.

The main process in the sixth preferred embodiment will now be described with reference to FIG. 33 and FIGS. 34A, 34B and 34C. FIG. 33 is a flow chart which shows the main process in the sixth preferred embodiment of the image forming apparatus according to the present invention, while FIGS. 34A, 34B and 34C are timing charts which show a difference in operation depending on the input timing an image signal during the main process in the sixth preferred embodiment. During the main process according to the sixth preferred embodiment, the CPU 101 of the engine controller 10 determines whether an image signal has been inputted as in the apparatus of the fifth preferred embodiment (Step S901). The apparatus of the sixth preferred embodiment however continuously stays in the operation-suspended state when not fed with an image signal.

As an image signal is inputted, the operation-suspended time ts which is being measured with the internal timer is compared with a predetermined period of time t6 (Step S902). When the operation-suspended time ts is the same or longer than the period t6 at this stage, the developer rollers 44 are rotated idle (Step S903). The content of the idling at this stage is identical to that in the fifth preferred embodiment (FIG. 30). On the contrary, when the operation-suspended time ts has not reached the period t6 yet, idling and subsequent steps S904 and S905 are skipped.

The operation-suspended time ts is further compared with a predetermined period of time t7 which is longer than the period t6 (Step S904). When the operation-suspended time ts is the same or longer than the period t7, optimization of density control factors is executed (Step S905). As in the apparatus of the fifth preferred embodiment, the optimization at this stage may be realized using conventional techniques. On the contrary, when the operation-suspended time ts has not reached the period t7 yet, this optimization is skipped.

The image forming operation is then executed after necessary preprocessing based on how long the operation-suspended time ts has continued in this manner, thereby forming a necessary number of images (Step S906 through Step S907). The apparatus switches to the operation-suspended state as the image formation ends (Step S908), the internal timer which measures the operation-suspended time ts is reset and starts measuring time again (Step S909), and the apparatus returns to the step S901.

Because of such a main process, the operations of the apparatus of the sixth preferred embodiment are classified into the following in accordance with an elapsed time until inputting of the next image since the end of the preceding image forming operation. First, in the event that a new image signal is fed before the operation-suspended time ts since the end of the preceding image forming operation reaches the predetermined period t6, as shown in FIG. 34A, the image forming operation is executed immediately in accordance with the received image signal. On the contrary, as shown in FIG. 34B, in the event that a new image signal is received when the operation-suspended time ts is equal to or longer than the period t6 but is shorter than the period t7, the image forming operation is executed after idling the developer rollers 44. In this manner, the developer rollers 44 are rotated idle prior to formation of an image when the operation-suspended time ts has become relatively long, which eliminates shutdown-induced banding and permits to form a toner image having an excellent image quality. The period t6 in the sixth preferred embodiment thus corresponds to a "sixth predetermined period" of the present invention.

Further, as shown in FIG. 34C, in the event that a new image signal is received after the operation-suspended time ts exceeded the period t7, the image forming operation is executed after idling the developer rollers 44 and subsequent optimization of density control factors. As optimization of density control factors is executed prior to formation of an image when the operation-suspended time ts has become even longer in this fashion, it is possible to form a toner image having a stable image quality regardless of a surrounding environment such as a temperature and humidity around the apparatus. In addition, since the developer rollers 44 are rotated idle prior to the optimization, it is possible to accurately optimize the density control factors while preventing an influence of shutdown-induced banding over a density of a patch image. The period t7 in the sixth preferred embodiment thus corresponds to a "seventh predetermined period" of the present invention.

As described above, upon receipt of a new image signal, the apparatus of the sixth preferred embodiment operates differently in accordance with the length of the operation-suspended time ts since the end of the preceding image forming operation. In other words, the apparatus immediately executes the image forming operation when the operation-suspended time ts is shorter than the period t6, but rotates the developer rollers 44 idle when the operation-suspended time ts is equal to or longer than the period t6. This eliminates shutdown-induced banding, which will arise when the developer rollers 44 are left carrying toner, before an image is formed. Hence, it is possible to stably form a toner image of an excellent image quality including no density variation.

Further, when the operation-suspended time ts is equal to or longer than the longer period t7, optimization of density control factors is executed after idling of the developer rollers 44. Hence, even when a surrounding environment around the apparatus has changed due to a long shutdown, it is possible to stably form a toner image while suppressing a variation in image density due to the change in surrounding environment.

As described above, although slightly different in terms of operation during the main process, the fifth and the sixth preferred embodiments are common to each other with respect to inherent technical concept. That is, the developer rollers 44 are rotated idle in accordance with the, length of the operation-suspended time ts, thereby eliminating shutdown-induced banding without increasing the consumption of toner. Further, density control factors are optimized when necessary, thereby stabilizing an image density. As a result, these image forming apparatuses can stably form a toner image having an excellent image quality. Hence, any one of the two preferred embodiments is workable as an application of the present invention to an image forming apparatus. Moreover, the frequency of idling of the developer rollers 44 and optimization of density control factors can be appropriately determined depending on the apparatus.

Modified Examples of Fifth and Sixth Preferred Embodiments

The present invention is not limited to the preferred embodiments above, but may be modified in various manners in addition to the preferred embodiments above, to the extent not deviating from the object of the invention. For instance, although the internal timer of the CPU 101 measures the operation-suspended time ts in each one of the preferred embodiments described above, the operation-suspended time ts may be measured with other clock means. A timer IC, a counter or the like may be disposed to the engine controller 10 separately from the internal timer for example, to thereby measure the operation-suspended time ts.

In addition, while the operation-suspended time ts is measured since discontinuation of application of the charging bias upon the photosensitive member 2 from the charger controller 103 in each one of the preferred embodiments described above for instance, the timing at which measuring of the operation-suspended time ts is started is not limited to this. For example, the operation-suspended time ts may be measured starting at termination of application of the developing bias upon the developer rollers 44 from the developer controller 104, driving of the photosensitive member 2 into rotations, driving of the intermediate transfer belt 71 into rotations, etc.

Further, while each one of the preferred embodiments described above requires to rotate the developer rollers 44 idle as the operation-suspended time ts has reached or exceeded a predetermined period but to optimize density control factors in addition to idling of the developer rollers 44 as the operation-suspended time ts has become further longer for instance, the latter may require only idling of the developer rollers 44. Optimization of density control factors may be executed only when particularly needed, such as when there is a request received from the main controller 11.

Figure 35A:
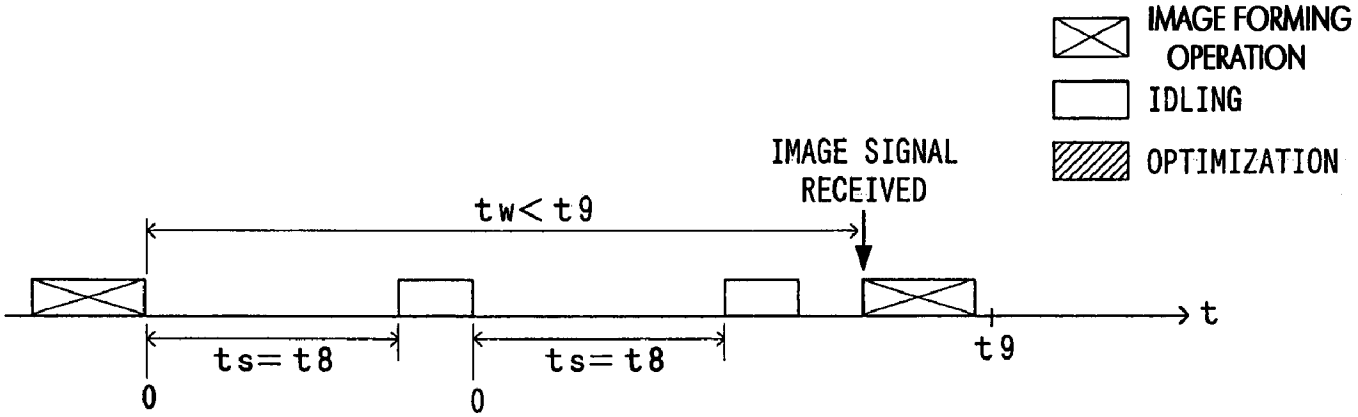
FIGS. 35A and 35B are drawings which show an operation during a modified example of a main process.
Figure 35B:
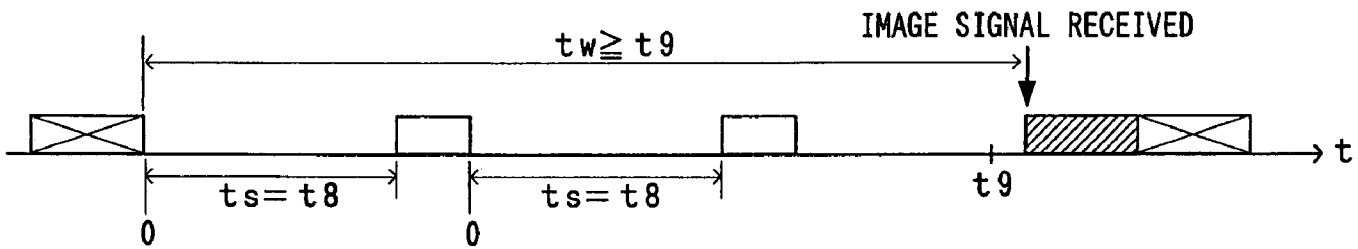

Alternatively, the following modified example may be implemented. FIGS. 35A and 35B are drawings which show an operation during a modified example of the main process. In the modified example, the developer rollers 44 are rotated idle every time the operation-suspended time ts reaches a predetermined period of time t8, and a waiting time tw since the end of the preceding image forming operation is measured. In the event that a new image signal is received before the waiting time tw reaches a predetermined period of time t9 (t8>t9 ) (FIG. 35A), the image forming operation is executed immediately in accordance with the received image signal. On the contrary, in the event that a new image signal is received after the waiting time tw has reached or exceeded the period t8 (FIG. 34B), optimization of density control factors is performed first, and an image corresponding to the image signal is then formed.

In this modified example as well, by means of idling of the developer rollers 44, it is possible to suppress a density variation attributed to shutdown-induced banding. Further, optimization of density control factors prior to image formation in the event that the waiting time tw is relatively long suppresses a variation in image density and permits to stably form a toner image having an excellent image quality.

Further, while the fifth preferred embodiment described above for instance requires to optimize density control factors soon after idling of the developer rollers 44 when the idling has been repeated three times in a row and therefore the period t5 corresponding to the "fifth predetermined period" of the present invention is about three times as long as the period t4 which corresponds to the "fourth predetermined period" of the present invention, a ratio of one period to the other period may not necessarily be such an integral ratio.

Modified Examples of First through Sixth Preferred Embodiments

While each one of the preferred embodiments described above is directed to an image forming apparatus comprising the intermediate transfer belt 71 which serves as an intermediate medium which temporarily carries a toner image which has been developed on the photosensitive member 2, the present invention is applicable also to an image forming apparatus comprising other intermediate medium such as a transfer drum and a transfer roller and an image forming apparatus in which no intermediate medium is used and a toner image formed on the photosensitive member 2 is transferred directly onto the sheet S which is a final transfer member to carry a toner image.

In addition, although each one of the preferred embodiments described above is directed to an image forming apparatus which is capable of forming a full-color image using toner in the four colors of yellow, cyan, magenta and black, the colors of toner to use and the number of the toner colors are not limited to this but may be freely determined. For example, the present invention is applicable also to an apparatus which forms a monochrome image using only black toner.

In addition, while the respective preferred embodiments described above are an application of the present invention to a printer which executes the image forming operation based on an image signal fed from an external apparatus, the present invention is of course applicable also to a copier machine which internally generates an image signal in accordance with a user's image formation request, which may be pressing of a copy button for instance, and executes the image forming operation based on the image signal, and to a facsimile machine which executes the image forming operation based on an image signal which is fed on a communications line.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

an image carrier which is structured to carry an electrostatic latent image on a surface of said image carrier;

a toner carrier which rotates in a predetermined direction while carrying toner and transports said toner to an opposed position facing said image carrier;

an image forming means which applies a predetermined developing bias upon said toner carrier, causes said toner carried by said toner carrier to move to said image carrier, visualizes said electrostatic latent image with said toner, and forms a toner image; and a timer which measures an elapsed period since an end of formation of a toner image by said image forming means, wherein an image forming operation for forming a toner image corresponding to an image formation request upon receipt of said image formation request by a user, and an optimization for forming a toner image as a patch image, are selectively executed to detect a density of said patch image and to optimize a density control factor influencing an image density based on the result of the detection to control an image density, wherein if said image formation request is not newly received after said elapsed period, measured by said timer, has reached a first predetermined period, said optimization is executed, and wherein if said image formation request is newly received when said elapsed period is shorter than said first predetermined period but is equal to or longer than a second predetermined period which is shorter than said first predetermined period, said image forming operation in response to said image formation request is executed after executing said optimization.

2. The image forming apparatus of claim 1, characterized in that said toner carrier is rotated at least one round or more before formation of said patch image.

3. The image forming apparatus of claim 1, further comprising charging means which charges said surface of said image carrier to a predetermined surface potential prior to formation of said electrostatic latent image, characterized in that said elapsed period is measured since termination of charge of said image carrier by said charging means.

4. The image forming apparatus of claim 1, further comprising restricting means which abuts on a surface of said toner carrier at a restricting position which is on the upstream side to said opposed position in a rotation direction of said toner carrier, and accordingly restricts the amount of said toner carried on said surface of said toner carrier, characterized in that with said toner carrier and said image carrier facing each other at said opposed position, said restricting position is below the center of rotations of said toner carrier.

5. The image forming apparatus of claim 4, further comprising peeling means which abuts on said surface of said toner carrier at a peeling position which is on the upstream side to said restricting position in the rotation direction of said toner carrier, and accordingly peels off said toner adhering to said surface of said image carrier, characterized in that with said toner carrier and said image carrier facing each other at said opposed position, said peeling position is above said restricting position.

6. The image forming apparatus of claim 1, characterized in that a surface of said toner carrier is conductive.

7. The image forming apparatus of claim 1, characterized in that said toner image is formed using said toner which contains a wax component which serves as a parting agent for prevention of fixing offset.

8. An image forming method comprising:

forming an electrostatic latent image on a surface of an image carrier in response to an image formation request from a user; and applying a predetermined developing bias upon a toner carrier which rotates while carrying toner on a surface of said toner carrier, to thereby move said toner carried by said toner carrier to said image carrier, visualize said electrostatic latent image with toner and form a toner image, wherein if said image formation request is not newly received after an elapsed period since an end of formation of a previous toner image, by an image forming means, has reached a first predetermined period, optimization is executed which includes forming the toner image as a patch image, to detect a density of said patch image and to optimize a density control factor influencing an image density based on the result of the detection to control an image density, and wherein if said image formation request is newly received when said elapsed period is shorter than said first predetermined period but is equal to or longer than a second predetermined period which is shorter than said first predetermined period, said image forming operation in response to said image formation request is executed after executing said optimization.

9. An image forming apparatus comprising:

an image carrier which is structured to carry an electrostatic latent image on a surface of said image carrier;

a toner carrier which rotates in a predetermined direction while carrying toner and transports said toner to an opposed position facing said image carrier; and image forming means which applies a predetermined developing bias upon said toner carrier, causes said toner carried by said toner carrier move to said image carrier, visualizes said electrostatic latent image with said toner, and forms a toner image, wherein in the event that said formation request is not newly received after an elapsed period, since an end of formation of a previous toner image, has reached a fourth predetermined period, idling of said toner carrier is executed which includes rotating said toner carrier at least one round, and wherein in the event that said image formation request is not newly received even after said fourth predetermined period from the end of said idling, said idling is executed once again.

10. An image forming apparatus comprising:

an image carrier which is structured to carry an electrostatic latent image on a surface of said image carrier;

a toner carrier which rotates in a predetermined direction while carrying toner and transports said toner to an opposed position facing said image carrier; and image forming means which applies a predetermined developing bias upon said toner carrier, causes said toner carried by said toner carrier move to said image carrier, visualizes said electrostatic latent image with said toner, and forms a toner image, wherein in the event that said image formation request is not newly received after an elapsed period, since an end of formation of a previous toner image, has reached a fourth predetermined period, idling of said toner carrier is executed which includes rotating said toner carrier at least one round, and wherein when said elapsed period reaches a fifth predetermined period which is longer than said fourth predetermined period, said idling is executed, a toner image is formed as a patch image, a density of said patch image is detected, and a density control factor influencing an image density is optimized based on the result of the detection.

11. The image forming apparatus of claim 9, further comprising restricting means which abuts on a surface of said toner carrier at a restricting position which is on the upstream side to said opposed position in a rotation direction of said toner carrier, and accordingly restricts the amount of said toner carried on said surface of said toner carrier, characterized in that with said toner carrier and said image carrier facing each other at said opposed position, said restricting position is below the center of rotations of said toner carrier.

12. The image forming apparatus of claim 11, further comprising peeling means which abuts on said surface of said toner carrier at a peeling position which is on the upstream side to said restricting position in the rotation direction of said toner carrier, and accordingly peels off said toner adhering to said surface of said image carrier, characterized in that with said toner carrier and said image carrier facing each other at said opposed position, said peeling position is above said restricting position.

13. The image forming apparatus of claim 9, characterized in that a surface of said toner carrier is conductive.

14. The image forming apparatus of claim 9, characterized in that said toner image is formed using said toner which contains a wax component which serves as a parting agent for prevention of fixing offset.

15. An image forming apparatus comprising:

an image carrier which is structured to carry an electrostatic latent image on a surface of said image carrier;

a toner carrier which rotates in a predetermined direction while carrying toner and transports said toner to an opposed position facing said image carrier; and image forming means which applies a predetermined developing bias upon said toner carrier, causes said toner carried by said toner carrier move to said image carrier, visualizes said electrostatic latent image with said toner, and forms a toner image, wherein an image forming operation is executed which includes forming the toner image corresponding to an image formation request upon receipt of said image formation request by a user, and in the event that said image formation request is newly received when an elapsed period, since an end of formation of a previous toner image, is equal to or longer than a sixth predetermined period, and before executing said image forming operation in response to said image formation request, idling of said toner carrier is executed which includes rotating said toner carrier at least one round.

16. The image forming apparatus of claim 15, characterized in that in the event that there is said image formation request newly received when said elapsed period is equal to or longer than a seventh predetermined period which is longer than said sixth predetermined period, before forming a toner image in response to said image formation request, said idling is executed and optimization is then executed which requires to form a toner image as a patch image, to detect a density of said patch image and to optimize a density control factor influencing an image density based on the result of the detection.

17. The image forming apparatus of claim 15, further comprising restricting means which abuts on a surface of said toner carrier at a restricting position which is on the upstream side to said opposed position in a rotation direction of said toner carrier, and accordingly restricts the amount of said toner carried on said surface of said toner carrier, characterized in that with said toner carrier and said image carrier facing each other at said opposed position, said restricting position is below the center of rotations of said toner carrier.

18. The image forming apparatus of claim 17, further comprising peeling means which abuts on said surface of said toner carrier at a peeling position which is on the upstream side to said restricting position in the rotation direction of said toner carrier, and accordingly peels off said toner adhering to said surface of said image carrier, characterized in that with said toner carrier and said image carrier facing each other at said opposed position, said peeling position is above said restricting position.

19. The image forming apparatus of claim 15, characterized in that a surface of said toner carrier is conductive.

20. The image forming apparatus of claim 15, characterized in that said toner image is formed using said toner which contains a wax component which serves as a parting agent for prevention of fixing offset.

21. An image forming method comprising:

forming an electrostatic latent image on a surface of an image carrier, and applying a predetermined developing bias upon a toner carrier which rotates in a predetermined direction while carrying toner on a surface of said toner carrier, to thereby move said toner carried by said toner carrier to said image carrier, visualize said electrostatic latent image with toner and form a toner image, wherein in the event that said image formation request is not newly received after an elapsed period, since an end of formation of a previous toner image, has reached a fourth determined period, idling of said toner carrier is executed which includes rotating said toner carrier at least one round, and wherein in the event that said image formation request is not newly received even after said fourth predetermined period from the end of said idling, said idling is executed once again.

22. An image forming method comprising:

forming an electrostatic latent image on a surface of an image carrier; and applying a predetermined developing bias upon a toner carrier which rotates in a predetermined direction while carrying toner on a surface of said toner carrier, to thereby move said toner carried by said toner carrier to said image carrier, visualize said electrostatic latent image with toner and form a toner image, wherein in the event that said image formation request is not newly received after an elapsed period, since an end of formation of a previous toner image, has reached a fourth predetermined period, idling of said toner carrier is executed which includes rotating said toner carrier at least one round, and wherein when said elapsed period reaches a fifth predetermined period which is longer than said fourth predetermined period, said idling is executed, a toner image is formed as a patch image, a density of said patch image is detected, and a density control factor influencing an image density is optimized based on the result of the detection.

23. An image forming method comprising:

forming an electrostatic latent image on a surface of an image carrier in response to an image formation request from a user; and applying a predetermined developing bias upon a toner carrier which rotates in a predetermined direction while carrying toner on a surface of said toner carrier, to thereby move said toner carried by said toner carrier to said image carrier, visualize said electrostatic latent image with toner and form a toner image, wherein in the event that said image formation request is newly received when an elapsed period, since an end of formation of a previous toner image, is equal to or longer than a sixth predetermined period, and before forming the toner image in response to said image formation request, idling of said toner carrier is executed which includes rotating said toner carrier at least one round.

24. The image forming method of claim 23, characterized in that in the event that there is said image formation request newly received when said elapsed period is equal to or longer than a seventh predetermined period which is longer than said sixth predetermined period, before forming a toner image in response to said image formation request, said idling is executed and optimization is then executed which requires to form a toner image as a patch image, to detect a density of said patch image and to optimize a density control factor influencing an image density based on the result of the detection.

25. The image forming apparatus of claim 10, further comprising restricting means which abuts on a surface of said toner carrier at a restricting position which is on the upstream side to said opposed position in a rotation direction of said toner carrier, and accordingly restricts the amount of said toner carried on said surface of said toner carrier, characterized in that with said toner carrier and said image carrier facing each other at said opposed position, said restricting position is below the center of rotations of said toner carrier.

26. The image forming apparatus of claim 25, further comprising peeling means which abuts on said surface of said toner carrier at a peeling position which is on the upstream side to said restricting position in the rotation direction of said toner carrier, and accordingly peels off said toner adhering to said surface of said image carrier, characterized in that with said toner carrier and said image carrier facing each other at said opposed position, said peeling position is above said restricting position.

27. The image forming apparatus of claim 10, characterized in that a surface of said toner carrier is conductive.

28. The image forming apparatus of claim 10, characterized in that said toner image is formed using said toner which contains a wax component which serves as a parting agent for prevention of fixing offset.

* * * * *